US010995526B2

(12) United States Patent
Jeong

(10) Patent No.: US 10,995,526 B2
(45) **Date of Patent: *May 4, 2021**

(54) DOOR LATCH SYSTEM

(71) Applicant: WOOBO TECH CO., LTD., Pyeongtaek-si (KR)

(72) Inventor: Hae Il Jeong, Incheon (KR)

(73) Assignee: Woobo Tech Co., Ltd., Pyeongtaek-si (KR)

( * ) Notice: Subject to any disclaimer, the term of this patent is extended or adjusted under 35 U.S.C. 154(b) by 603 days.

This patent is subject to a terminal disclaimer.

(21) Appl. No.: 15/738,269

(22) PCT Filed: Jun. 13, 2016

(86) PCT No.: PCT/KR2016/006271

§ 371 (c)(1),
(2) Date: Dec. 20, 2017

(87) PCT Pub. No.: WO2016/208900

PCT Pub. Date: Dec. 29, 2016

(65) Prior Publication Data

US 2018/0179790 A1 Jun. 28, 2018

(30) Foreign Application Priority Data

Jun. 26, 2015 (KR) ..... 10-2015-0091458

(51) Int. Cl.
*E05B 81/06* (2014.01)
*E05B 81/14* (2014.01)
(Continued)

(52) U.S. Cl.
CPC ..... *E05B 85/00* (2013.01); *E05B 79/20* (2013.01); *E05B 81/14* (2013.01); *E05B 81/16* (2013.01);
(Continued)

(58) Field of Classification Search
CPC ..... Y10T 292/1082; Y10T 292/1083; Y10T 292/1089; E05B 81/14; E05B 81/16;
(Continued)

(56) References Cited

U.S. PATENT DOCUMENTS 1,413,830 A * 4/1922 Cudera ..... E05B 47/0603 292/201
2,468,644 A * 4/1949 Springer ..... E05B 85/24 292/219
(Continued)

FOREIGN PATENT DOCUMENTS

CN 103967357 A 8/2014
CN 104514449 A 4/2015
(Continued)

OTHER PUBLICATIONS

Zhiheng Wu, Chinese Patent Office, First Office Action, Application No. 2016800376534, dated Jan. 2, 2019, 9 pages, with English translation.

*Primary Examiner* — Carlos Lugo
(74) *Attorney, Agent, or Firm* — Sunstein LLP

(57) ABSTRACT

The present invention relates to a door latch system, more particularly to a door latch system which includes: a stopping lever unit rotatably installed in the main locking member; a stopping threshold formed in the sub-locking member wherein a stopping protrusion is being caught; and a locking plate slidingly installed in a housing for rotating the stopping lever unit, wherein a lever guide portion is formed in the locking plate, and a guide bar is formed in the stopping lever unit, so that the rotation of the stopping lever unit is accomplished as the guide bar is guided by the lever guide portion, and the stopping lever unit can be coupled to or separated from the stopping threshold in accordance with sliding of the locking plate.

32 Claims, 51 Drawing Sheets

(51) Int. Cl.

| | |
|---|---|
| ***E05B 85/00*** | (2014.01) |
| ***E05B 79/20*** | (2014.01) |
| ***E05B 81/34*** | (2014.01) |
| ***E05B 85/24*** | (2014.01) |
| ***E05B 81/90*** | (2014.01) |
| ***E05B 81/18*** | (2014.01) |
| ***E05B 81/16*** | (2014.01) |
| ***E05B 83/36*** | (2014.01) |

(52) U.S. Cl.
CPC ..... *E05B 81/18* (2013.01); *E05B 81/34* (2013.01); *E05B 81/90* (2013.01); *E05B 83/36* (2013.01); *E05B 85/243* (2013.01); *E05B 81/06* (2013.01); *E05Y 2201/716* (2013.01); *E05Y 2201/722* (2013.01); *E05Y 2900/531* (2013.01); *Y10T 292/1082* (2015.04)

(58) Field of Classification Search
CPC ..... E05B 81/18; E05B 81/34; E05B 81/90; E05B 85/243
See application file for complete search history.

(56) References Cited

U.S. PATENT DOCUMENTS 3,040,555 A * 6/1962 Wartian ..... E05C 3/24 70/97
3,521,921 A * 7/1970 Miyazaki ..... E05B 47/0047 292/201
3,528,694 A * 9/1970 Harley ..... B63C 9/24 292/216
3,566,703 A * 3/1971 Van Noord ..... B62D 1/181 74/50
4,703,960 A * 11/1987 Lense ..... E05B 47/0012 292/192
5,007,261 A * 4/1991 Quantz ..... E05B 81/14 292/201
5,193,861 A * 3/1993 Juga ..... E05C 3/34 292/207
6,106,032 A * 8/2000 Och ..... E05B 51/02 292/195
6,139,073 A * 10/2000 Heffner ..... E05B 81/14 292/201
6,155,616 A * 12/2000 Akright ..... E05B 5/00 292/198
7,347,460 B2 * 3/2008 Ala ..... A47L 15/4259 292/216
7,770,944 B2 * 8/2010 Yuan ..... E05B 47/0012 292/195
9,534,429 B2 1/2017 Spurr et al.
9,587,837 B2 * 3/2017 Colucci ..... E05B 15/0046
10,590,681 B2 * 3/2020 Jeong ..... E05B 77/26
2010/0308624 A1 12/2010 Juga et al.
2015/0097379 A1 4/2015 Spurr et al.
2017/0321456 A1 11/2017 Jeong

FOREIGN PATENT DOCUMENTS

CN 107109870 A 8/2017
FR 1550016 A * 12/1968 ..... E05B 47/0047
JP 2003-314137 A 11/2003
KR 10-0535053 12/2005
KR 10-1371255 3/2014
KR 10-1434980 8/2014
KR 10-2015-0050268 5/2015
KR 20150050269 A 5/2015
KR 10-2016-0082671 7/2016

* cited by examiner

[Fig. 1]
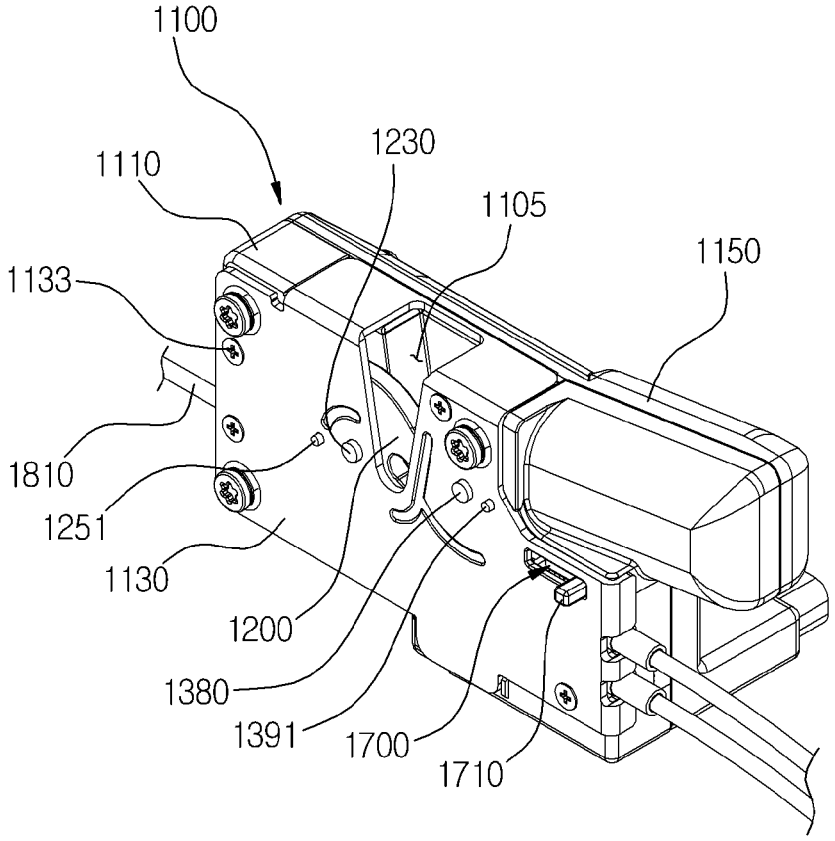

[Fig. 2]
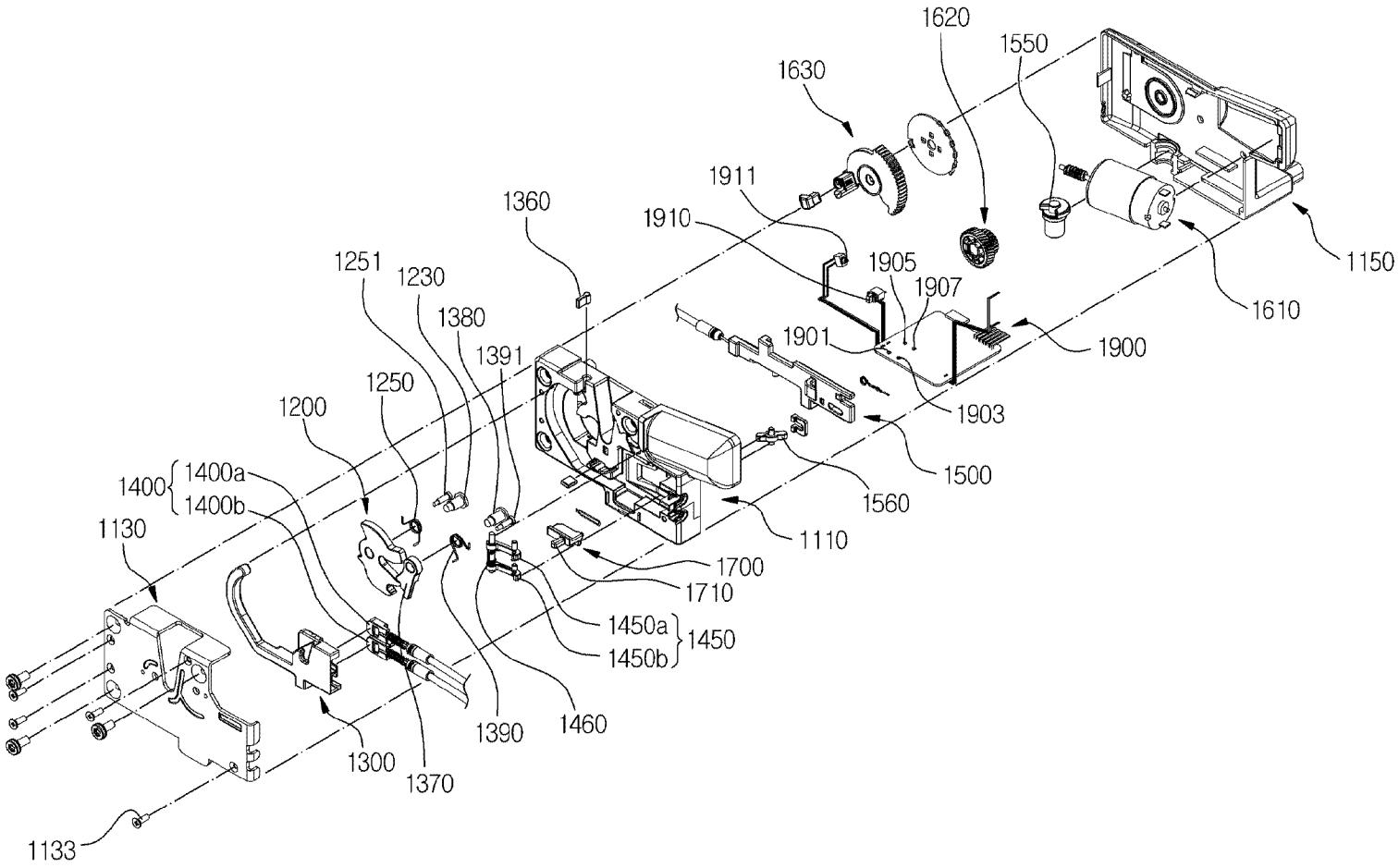

[Fig. 3]
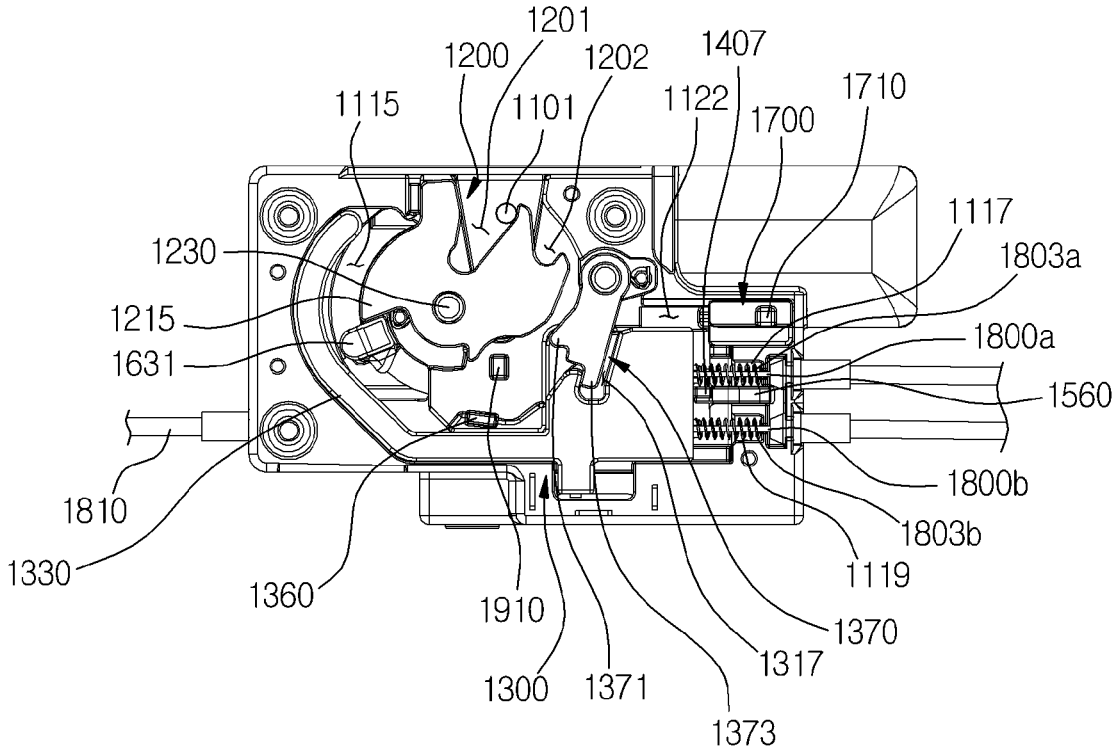
[Fig. 4]
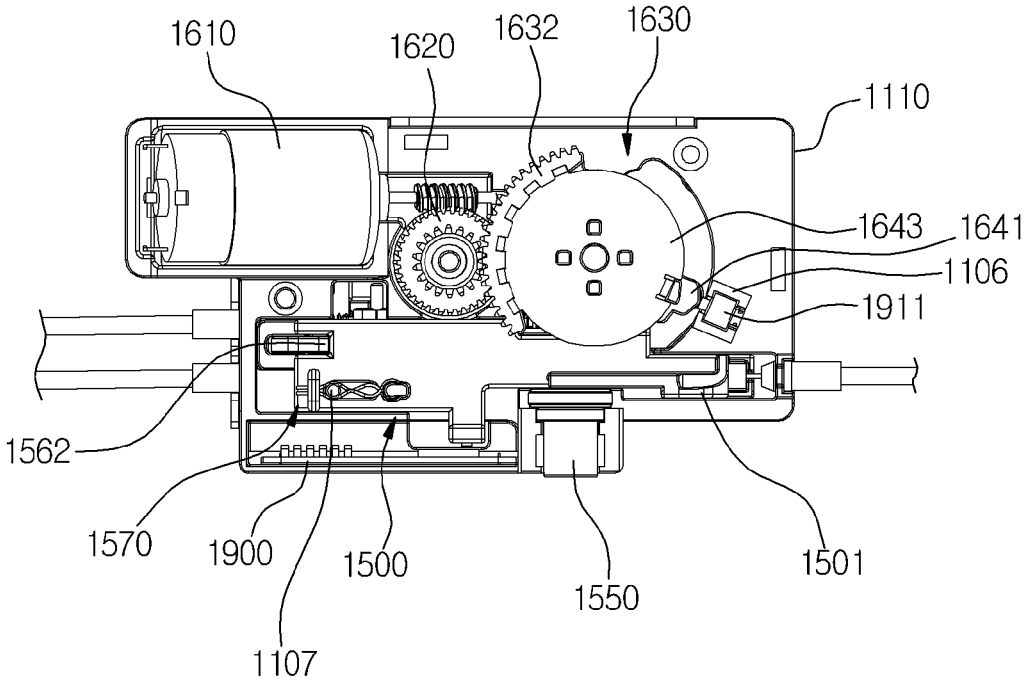

[Fig. 5]
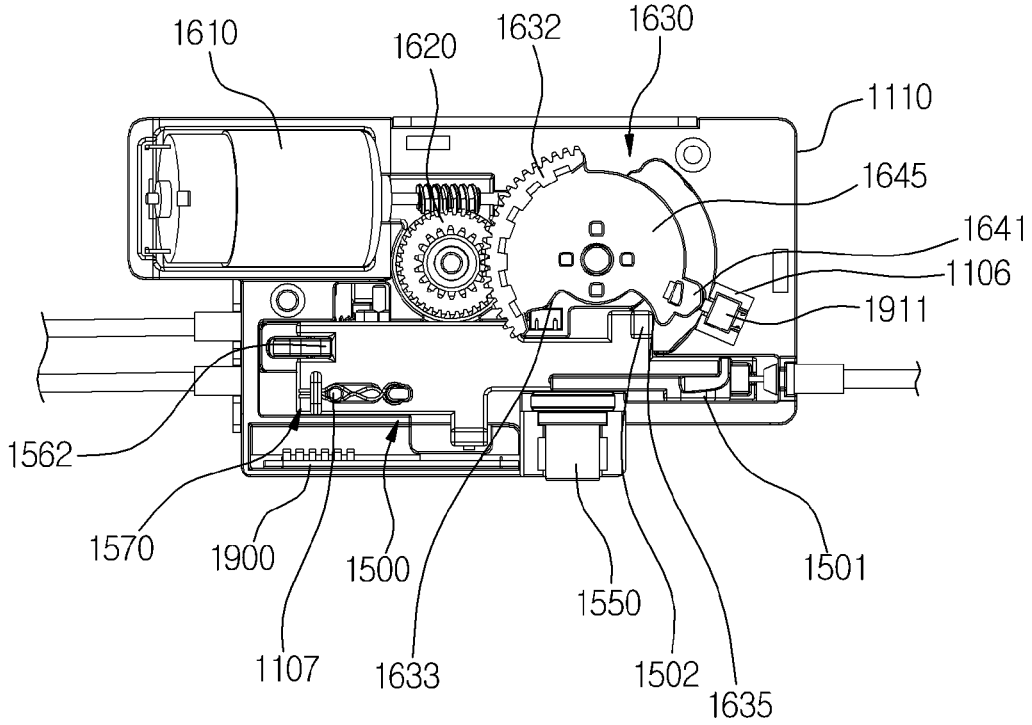

[Fig. 6]
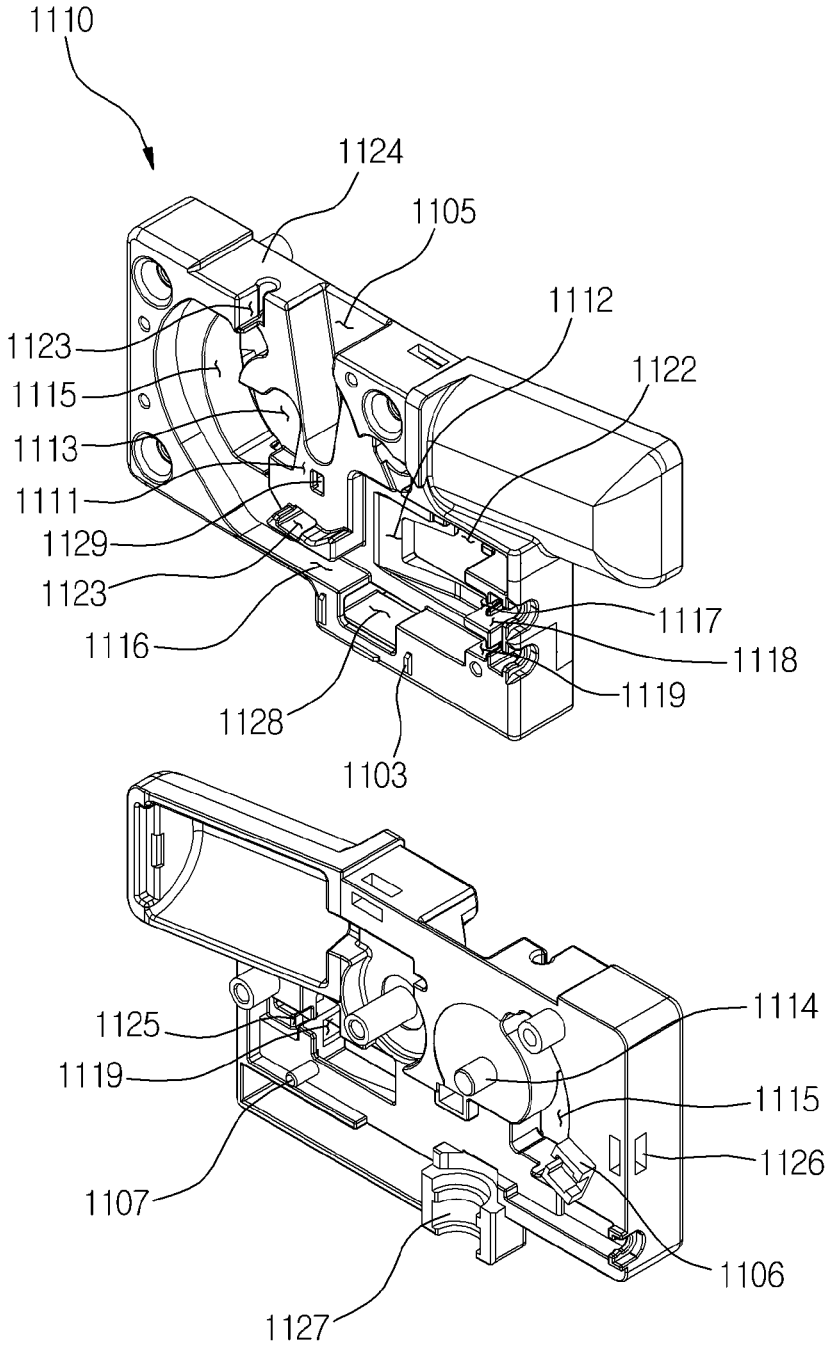

[Fig. 7]
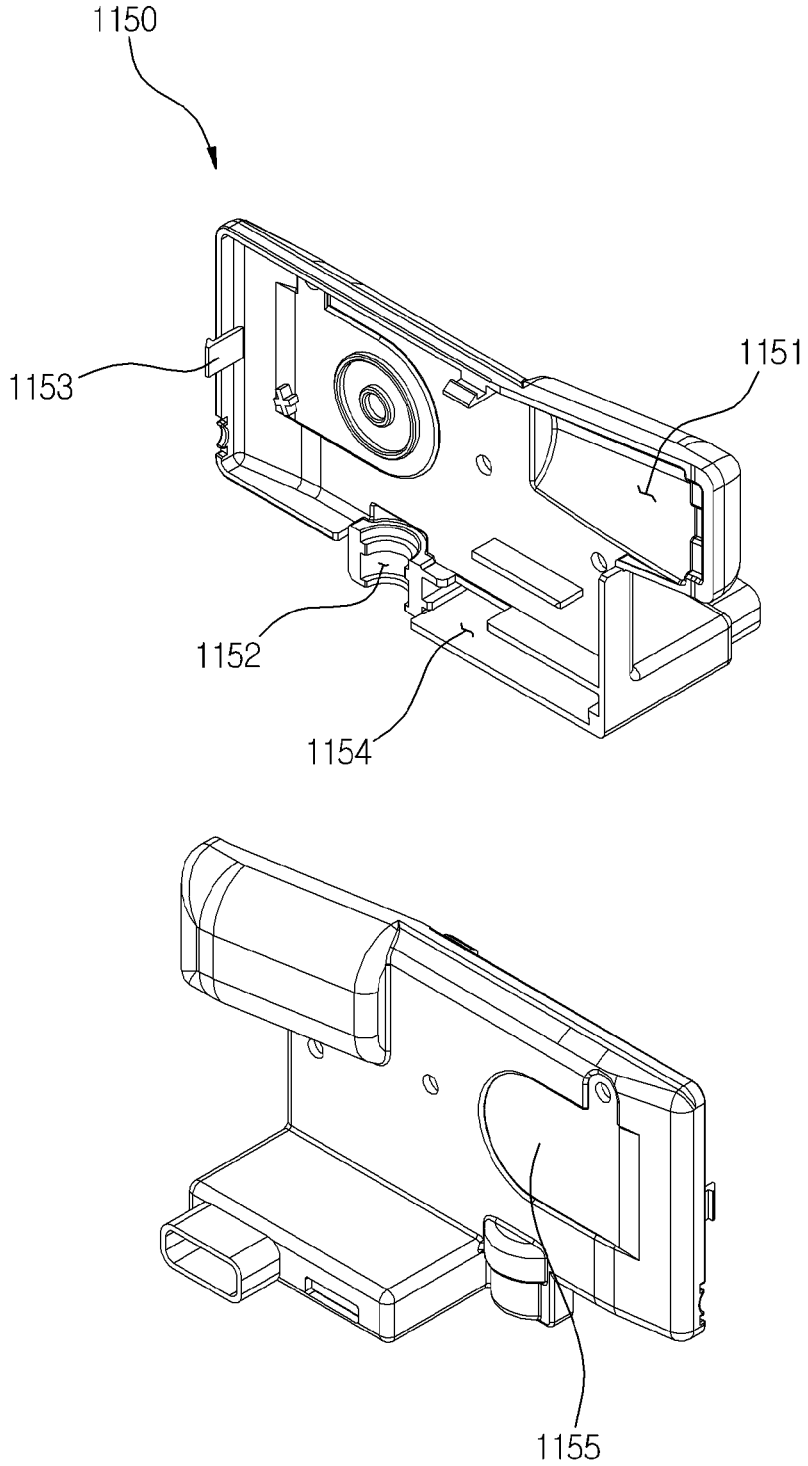

[Fig. 8]
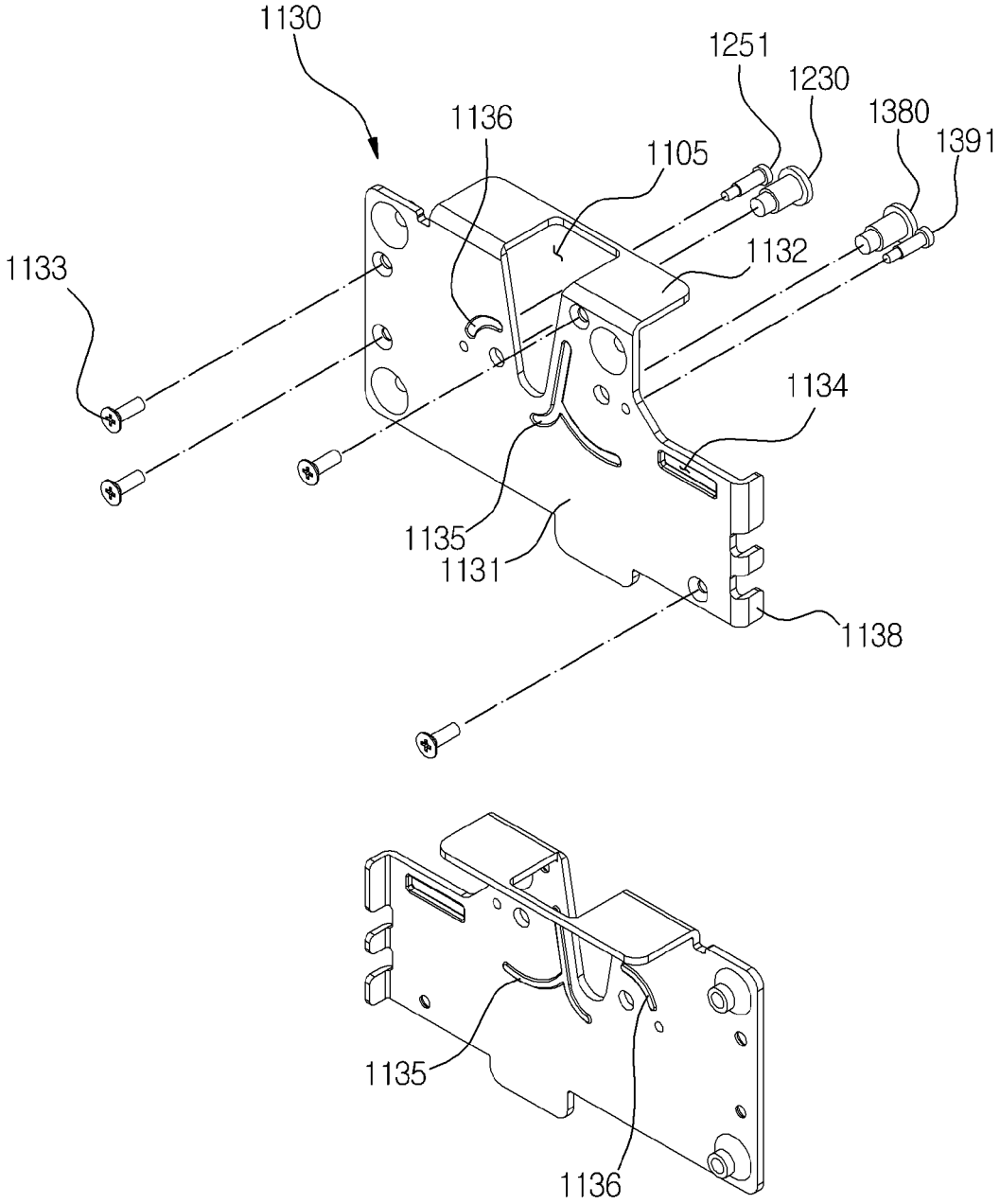

[Fig. 9]
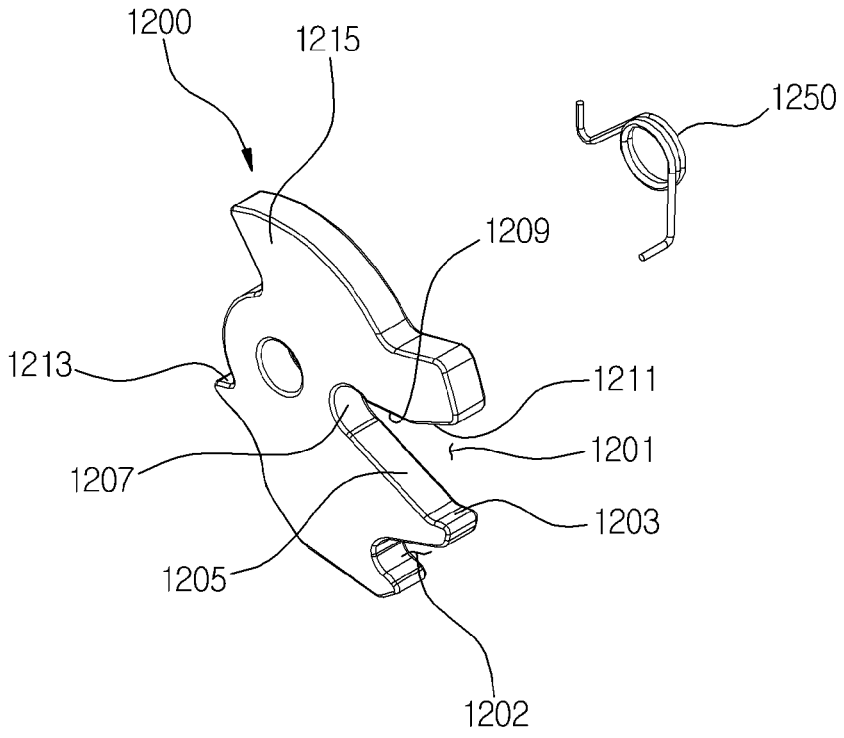

[Fig. 10]
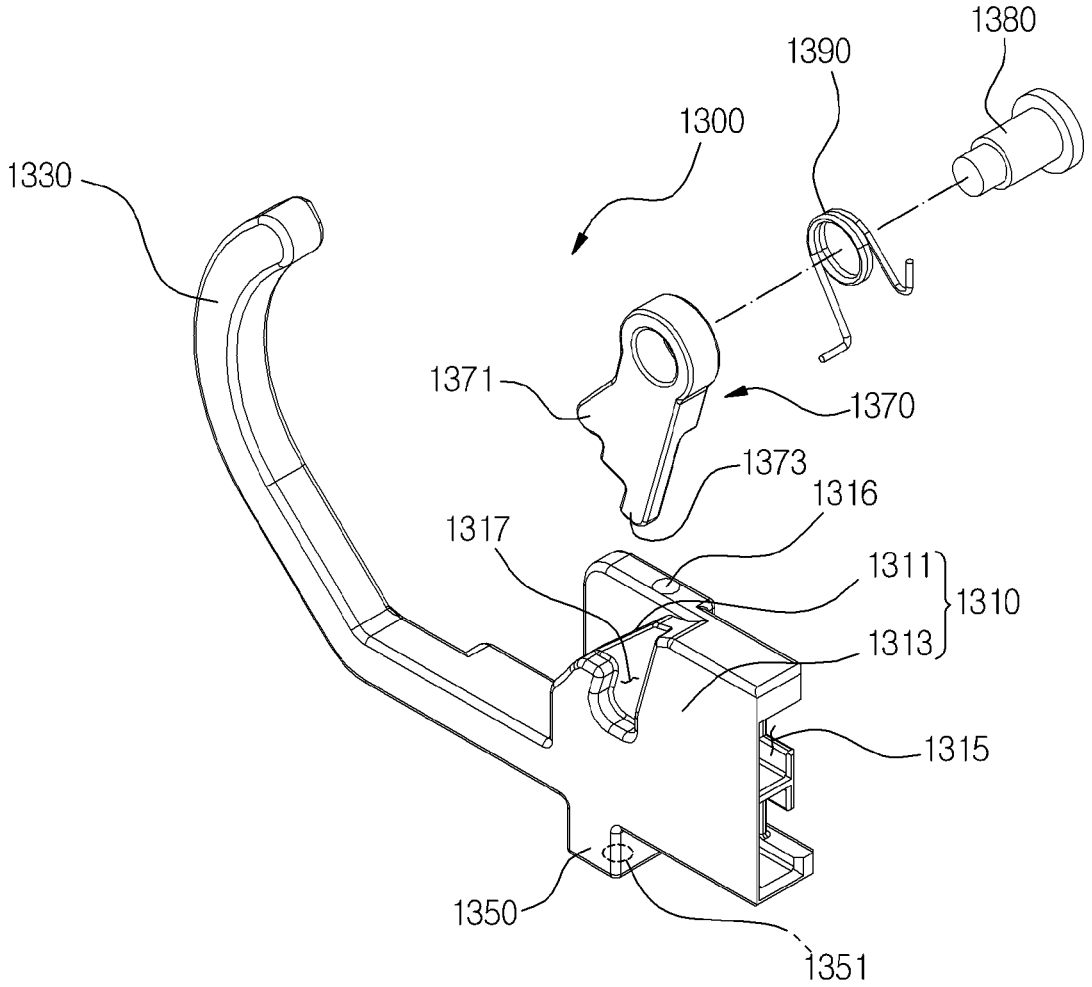
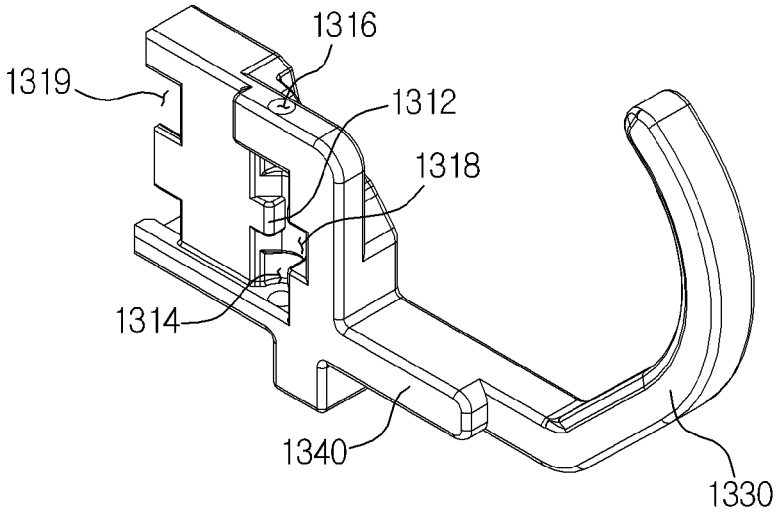

[Fig. 11]
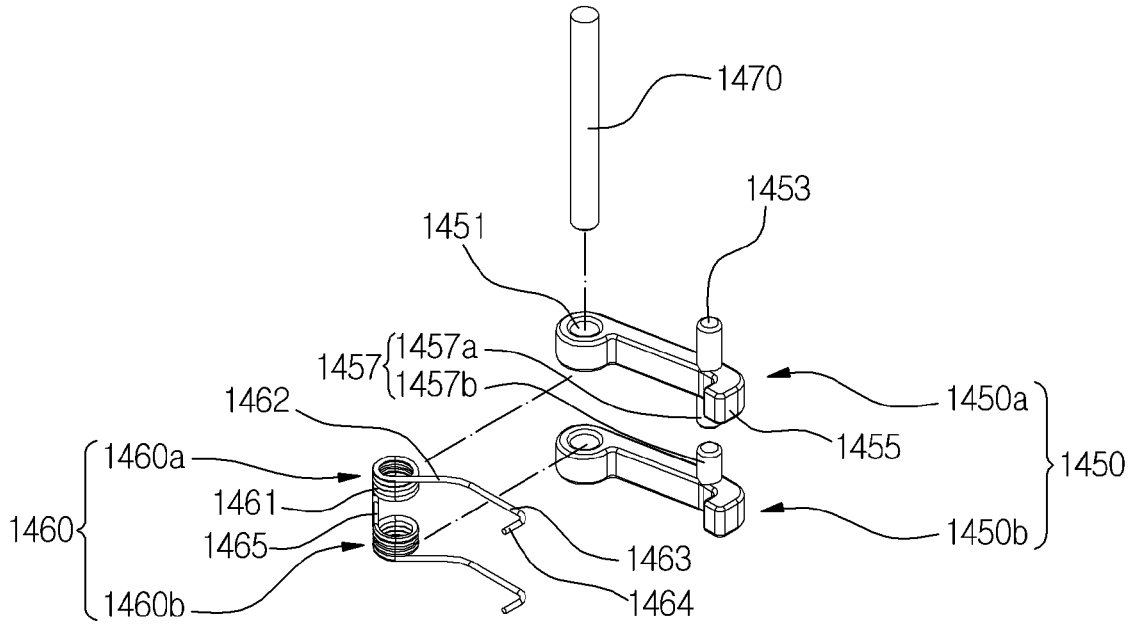

[Fig. 12]
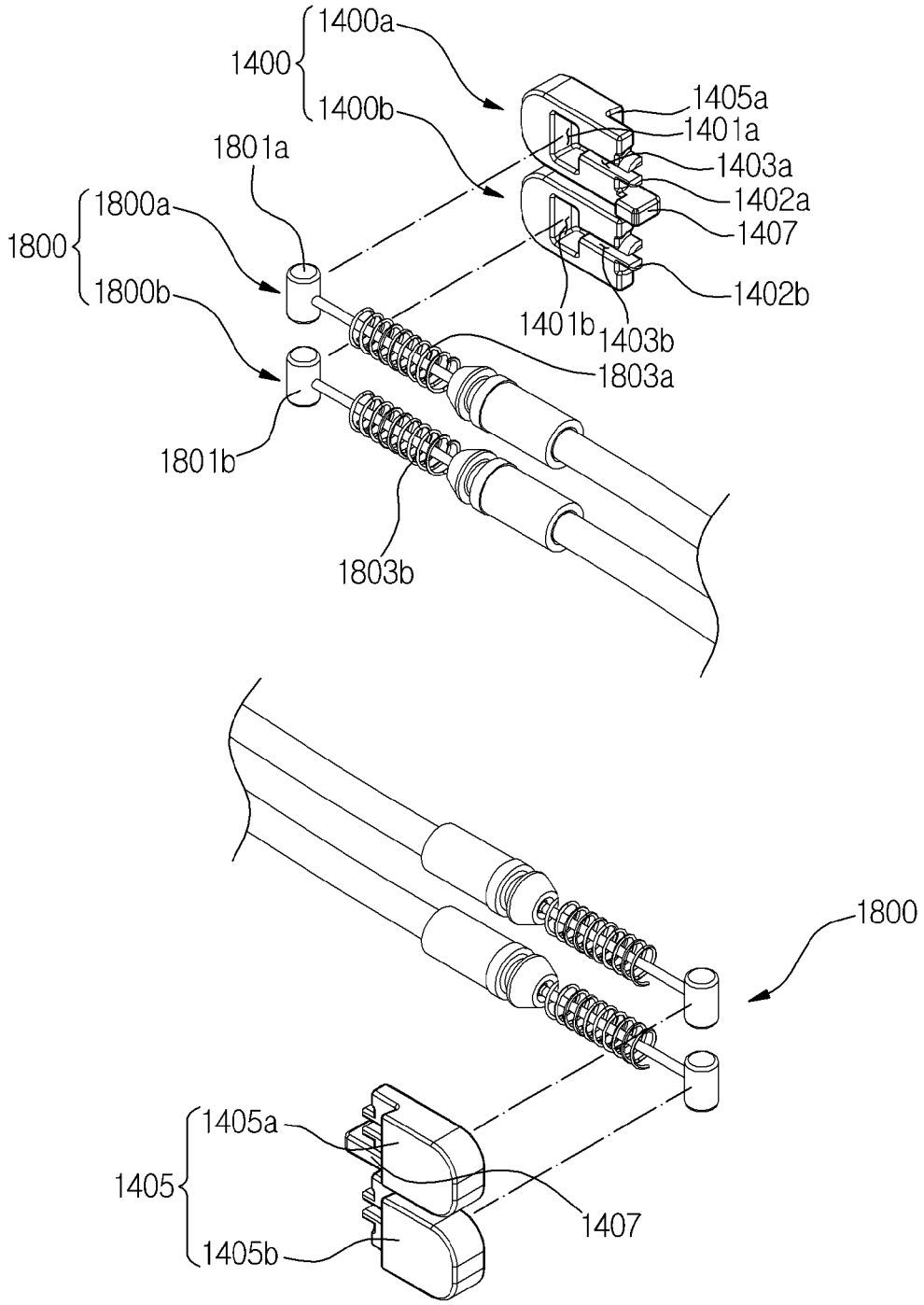

[Fig. 13]
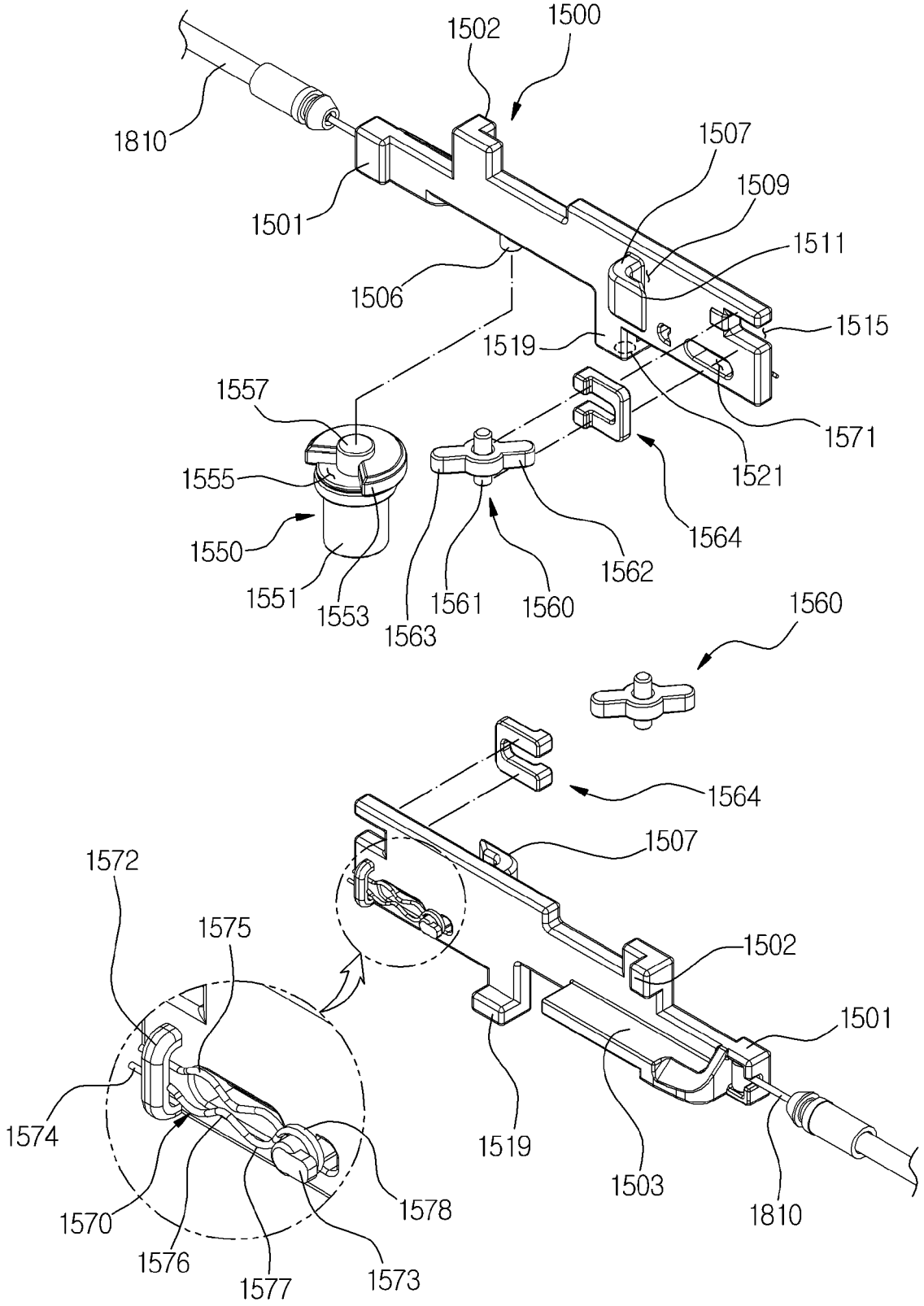

[Fig. 14]
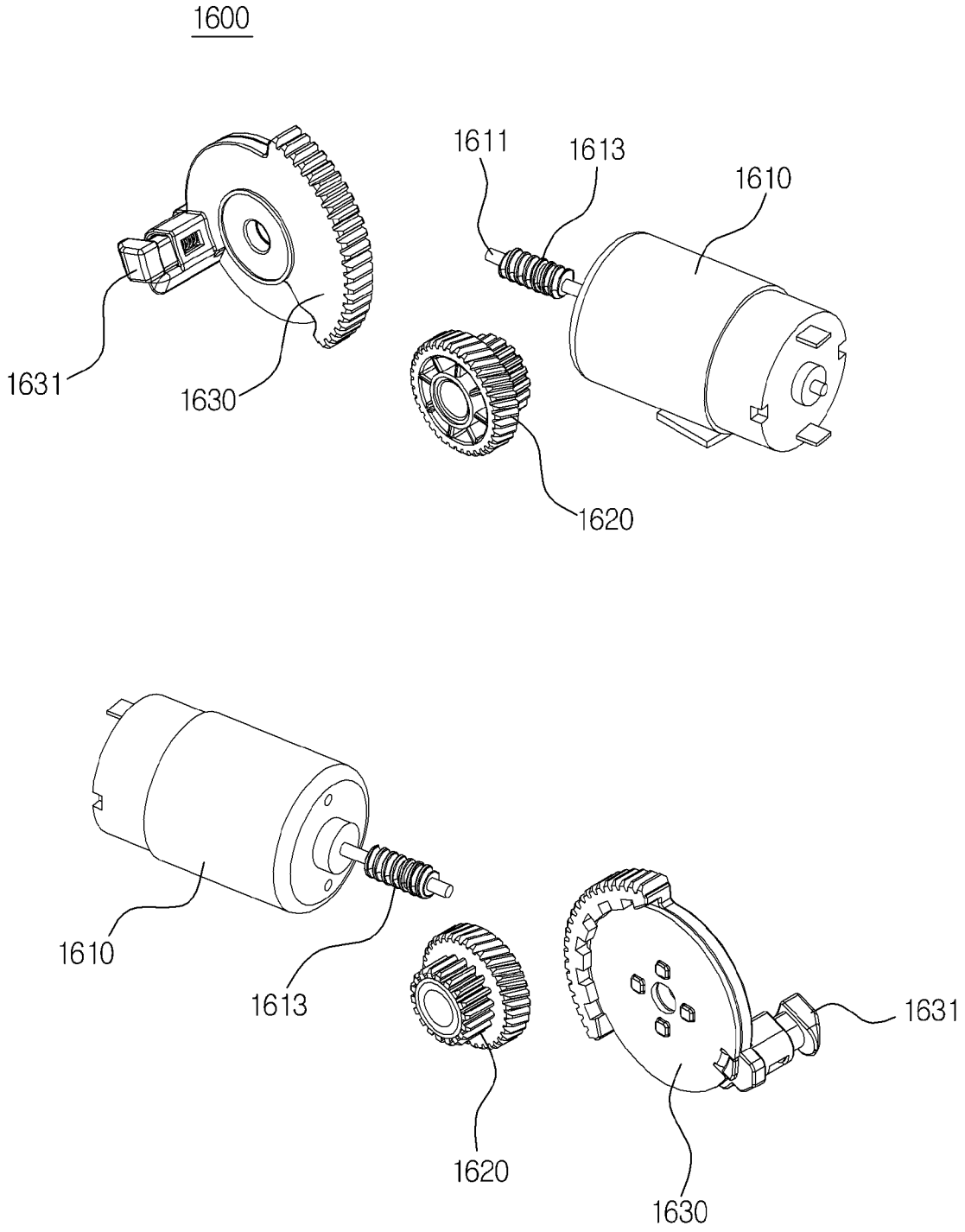

[Fig. 15]
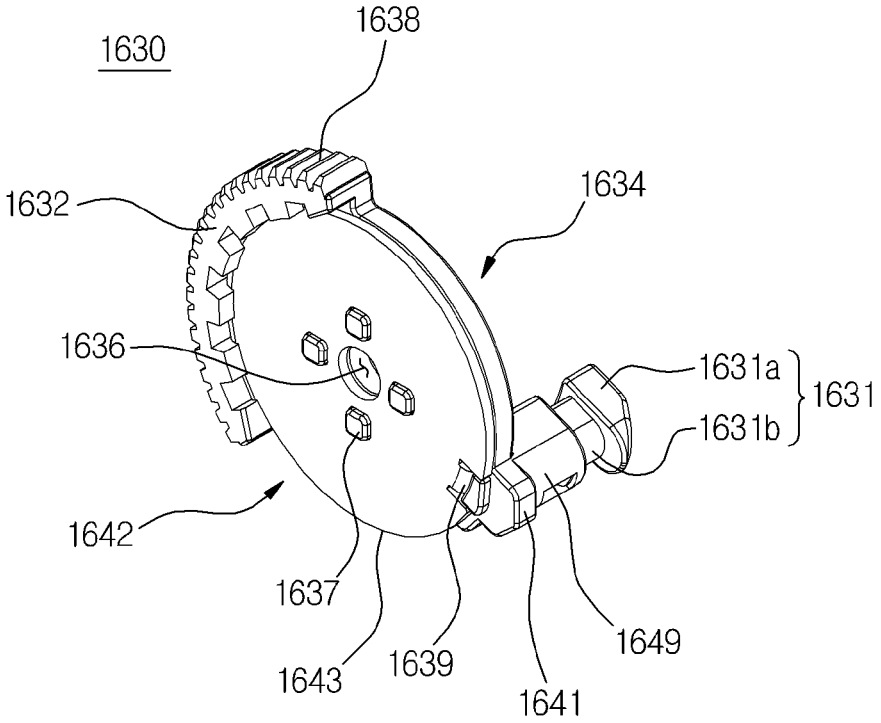
[Fig. 16]
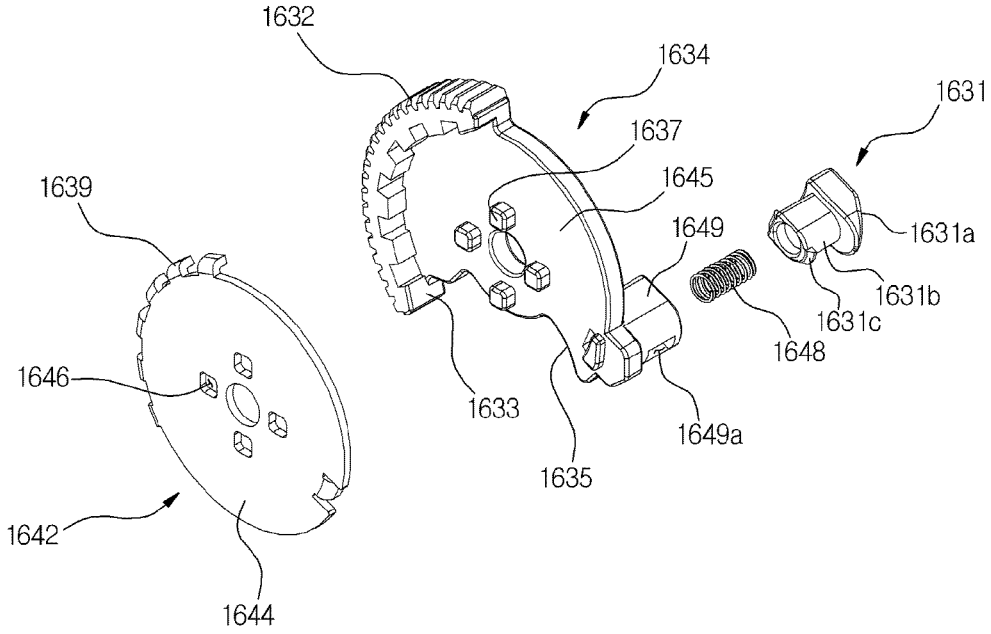

[Fig. 17]
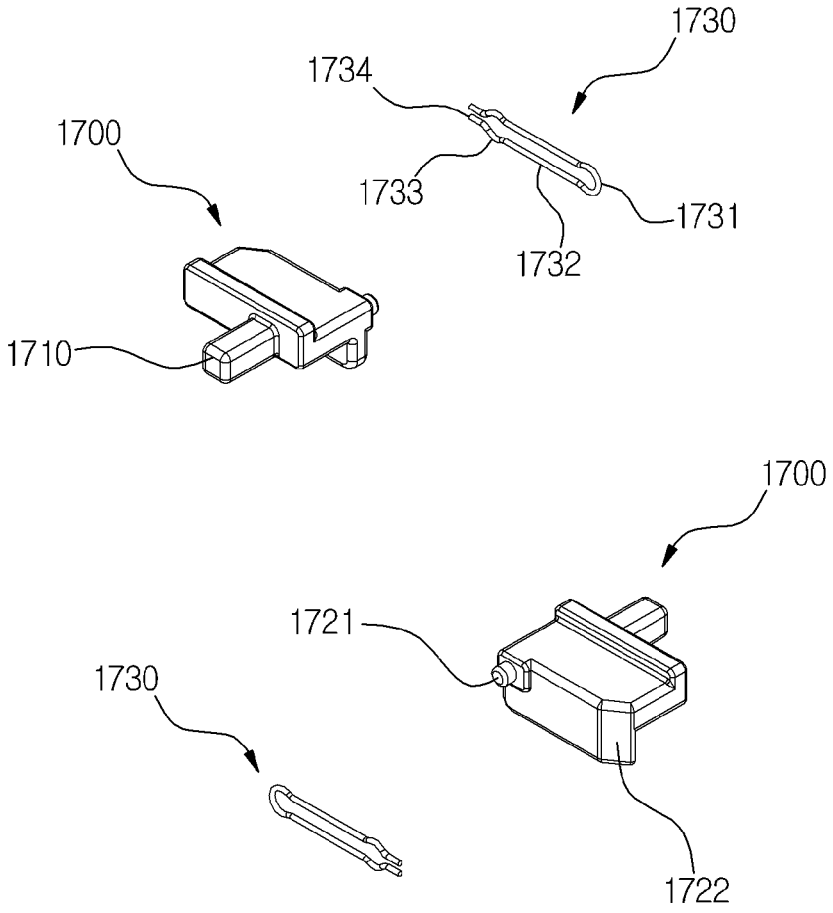
[Fig. 18]
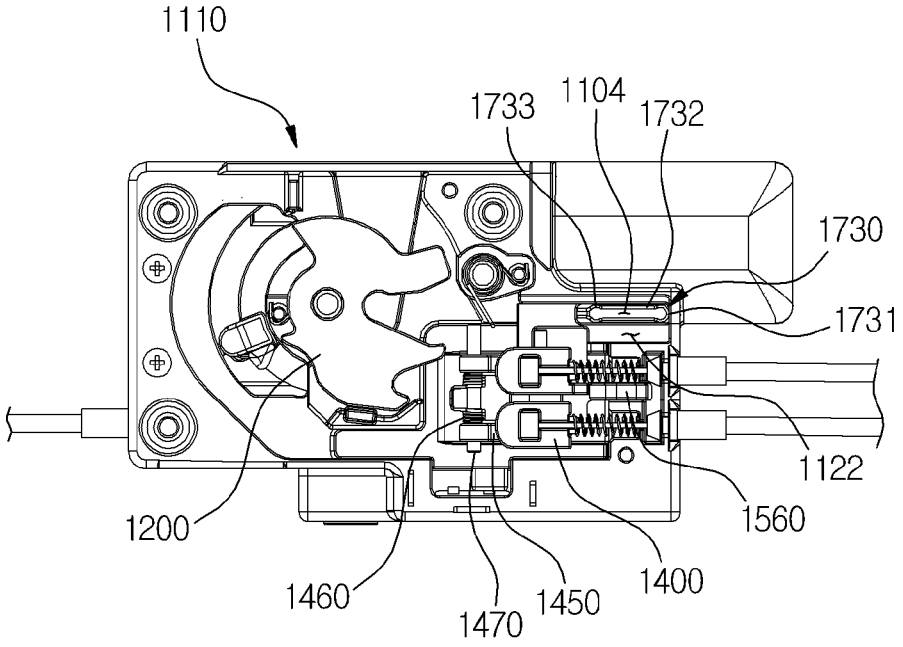

[Fig. 19]
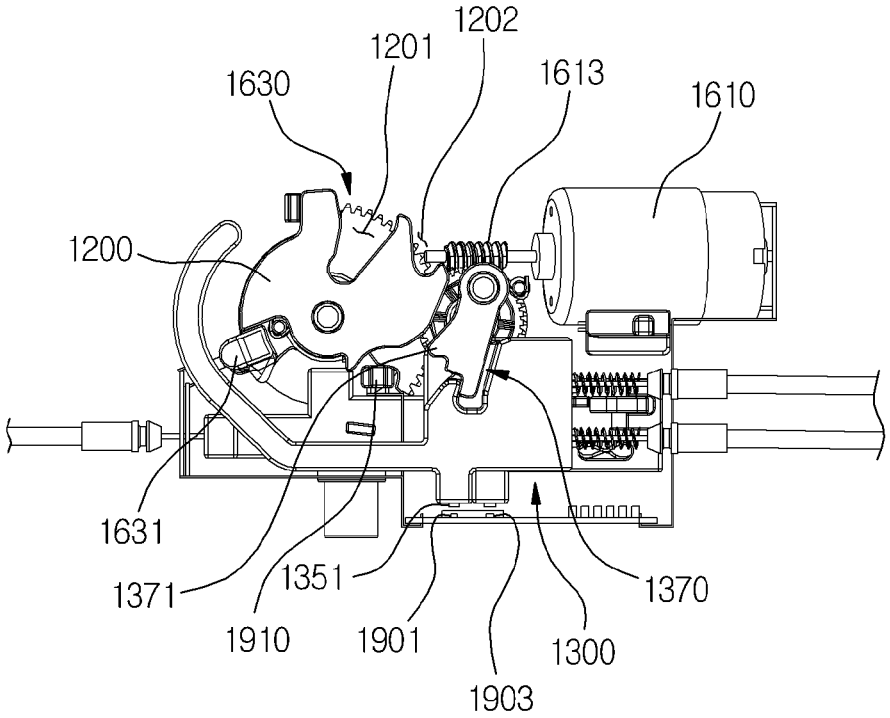
[Fig. 20]
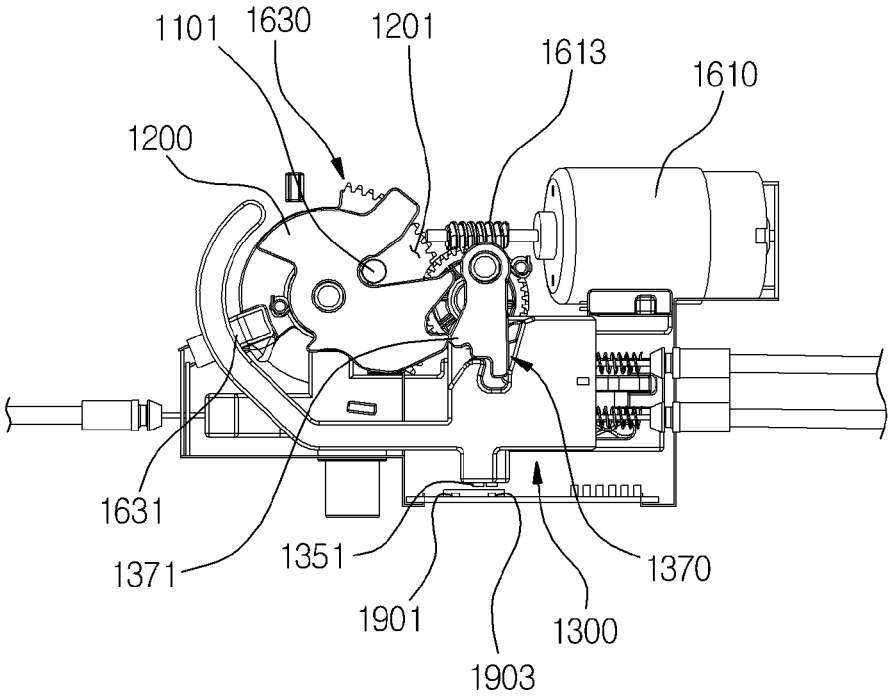

[Fig. 21]
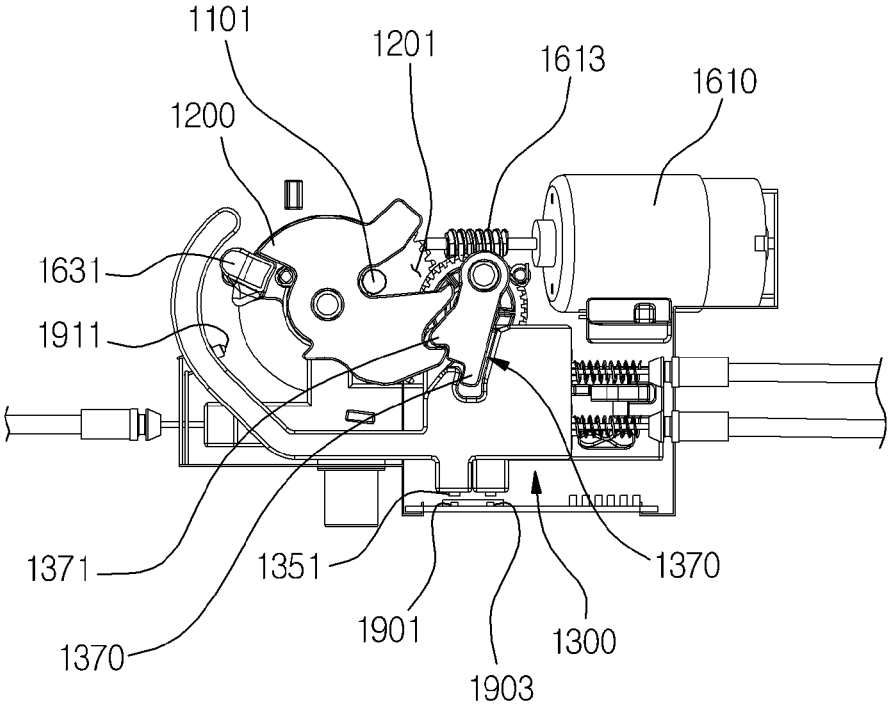
[Fig. 22]
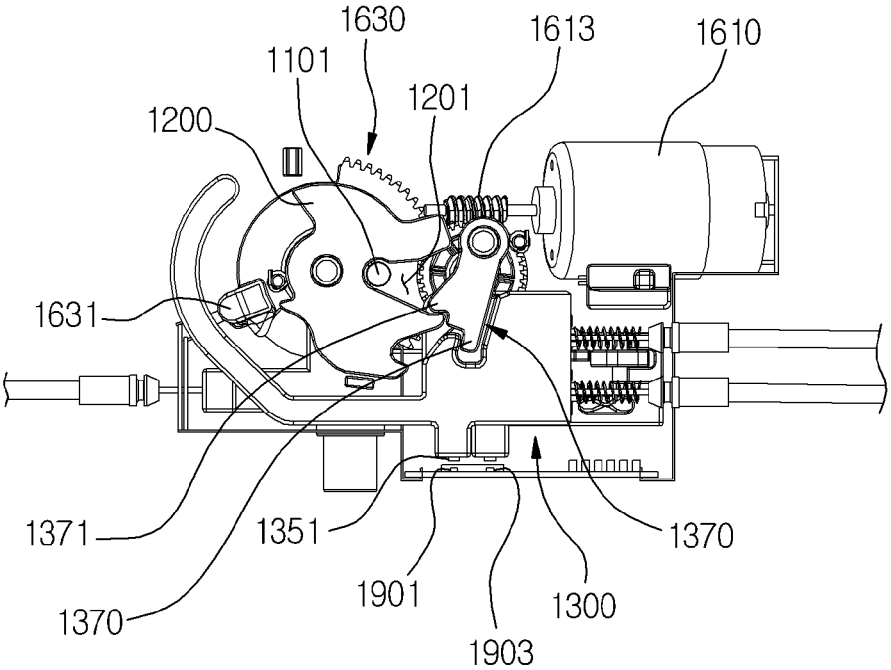

[Fig. 23]
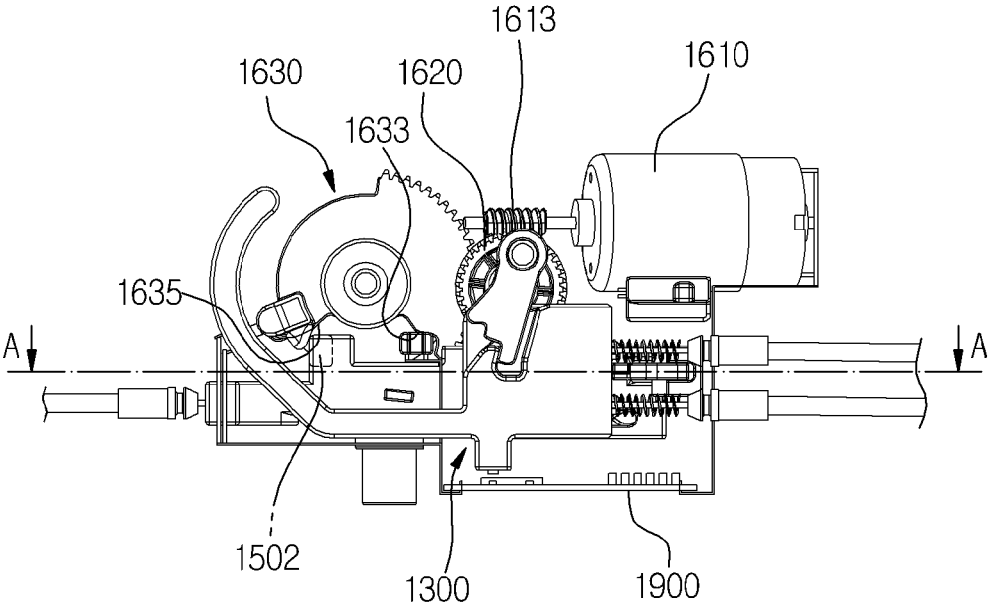
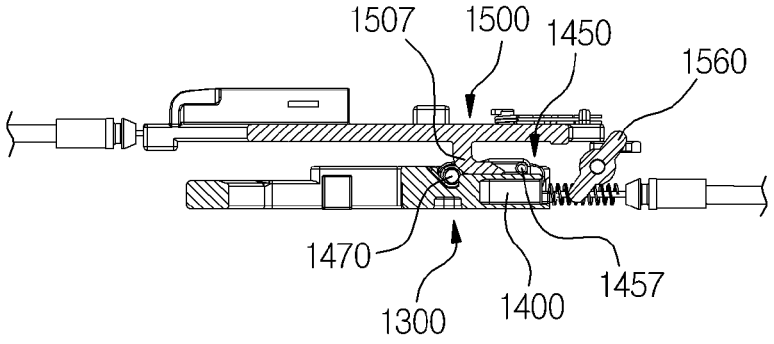

[Fig. 24]
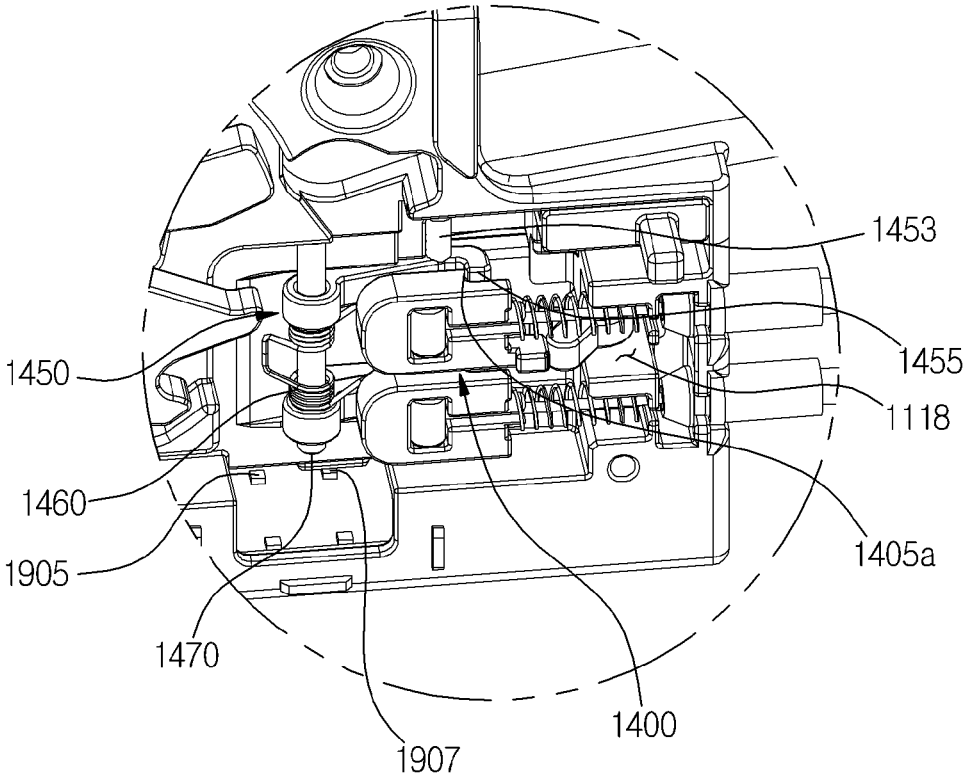

[Fig. 25]
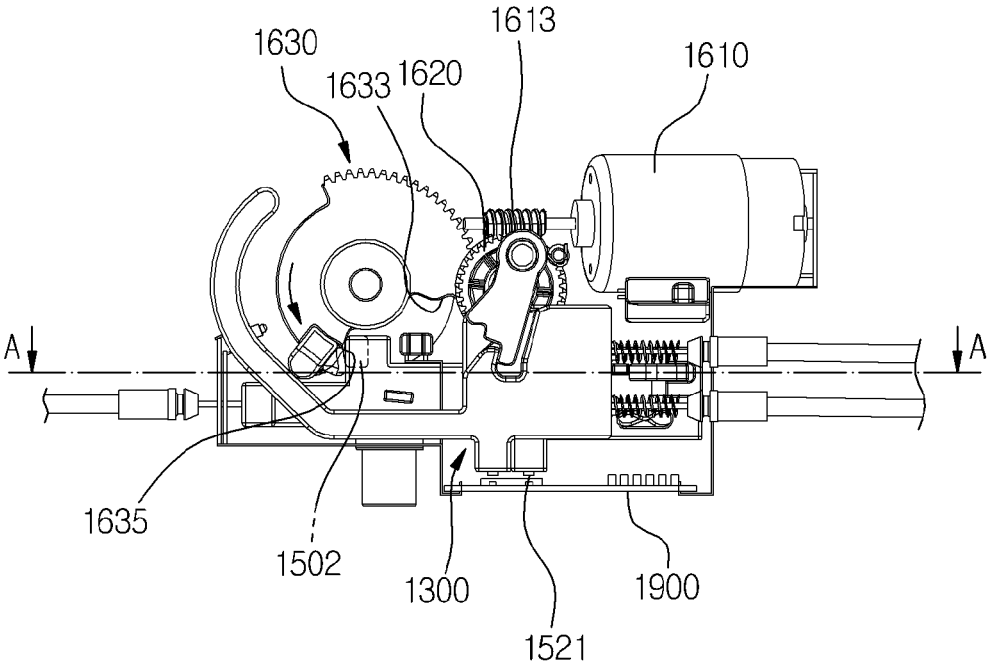
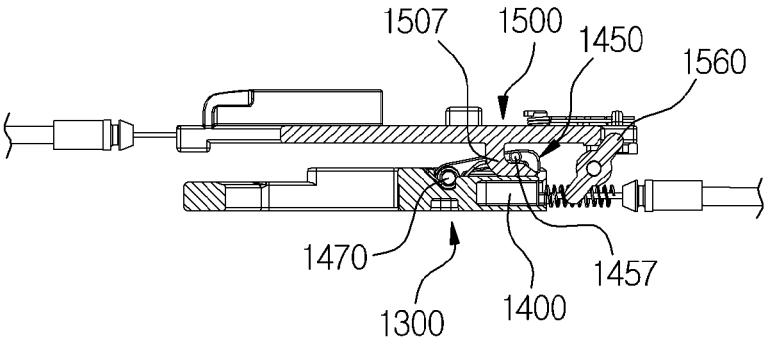

[Fig. 26]
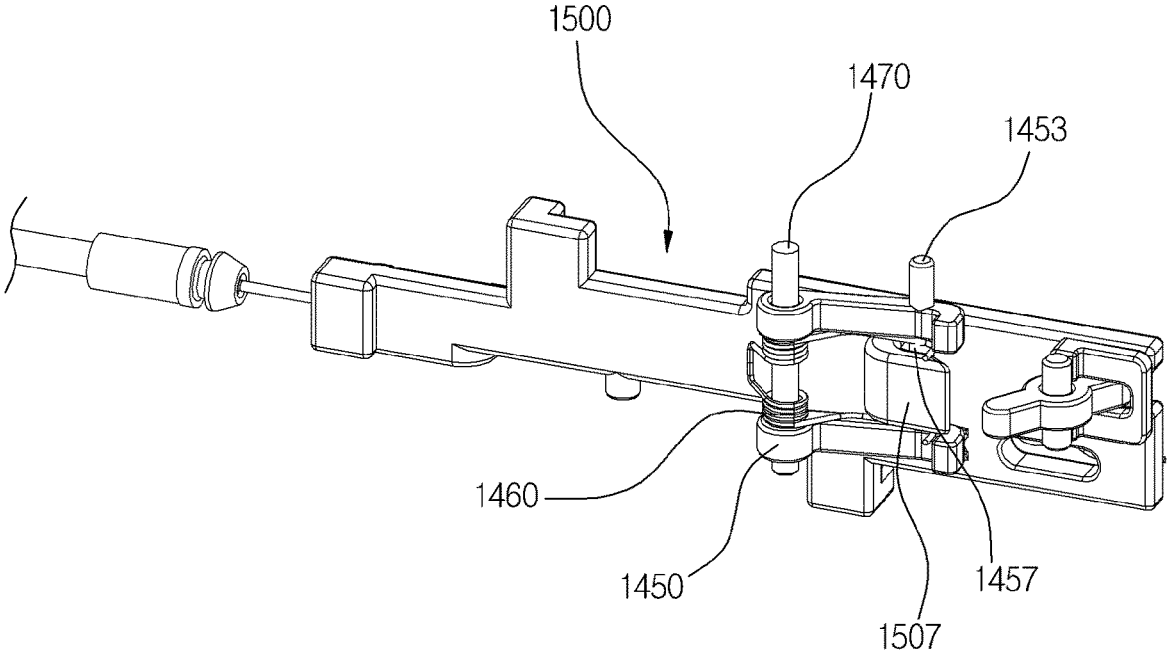

[Fig. 27]
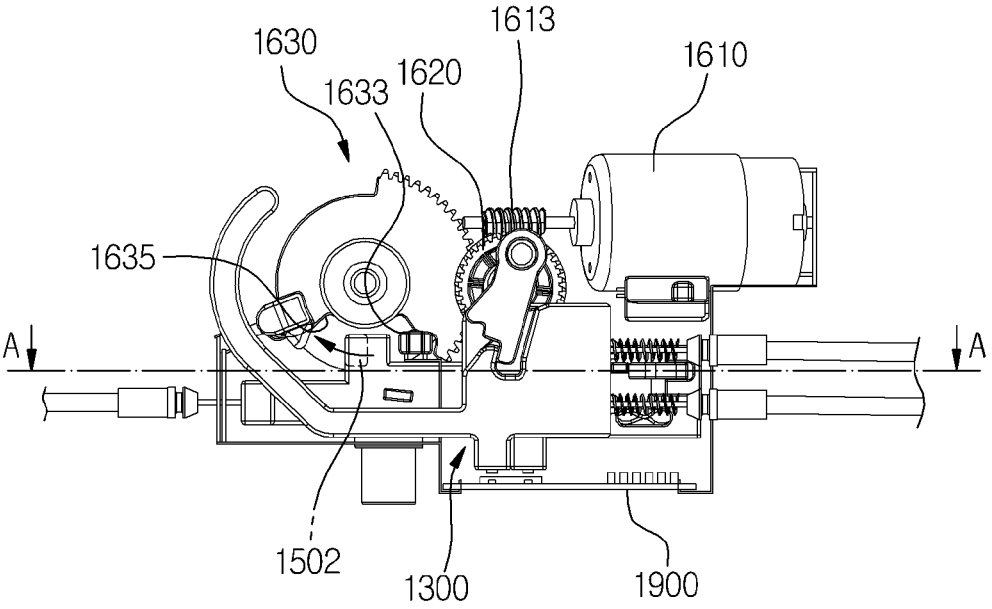
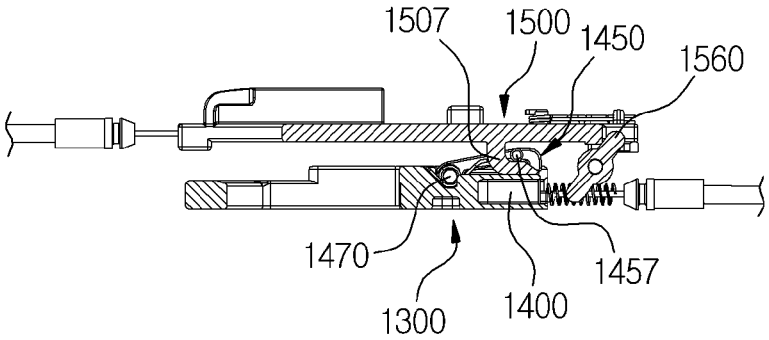

[Fig. 28]
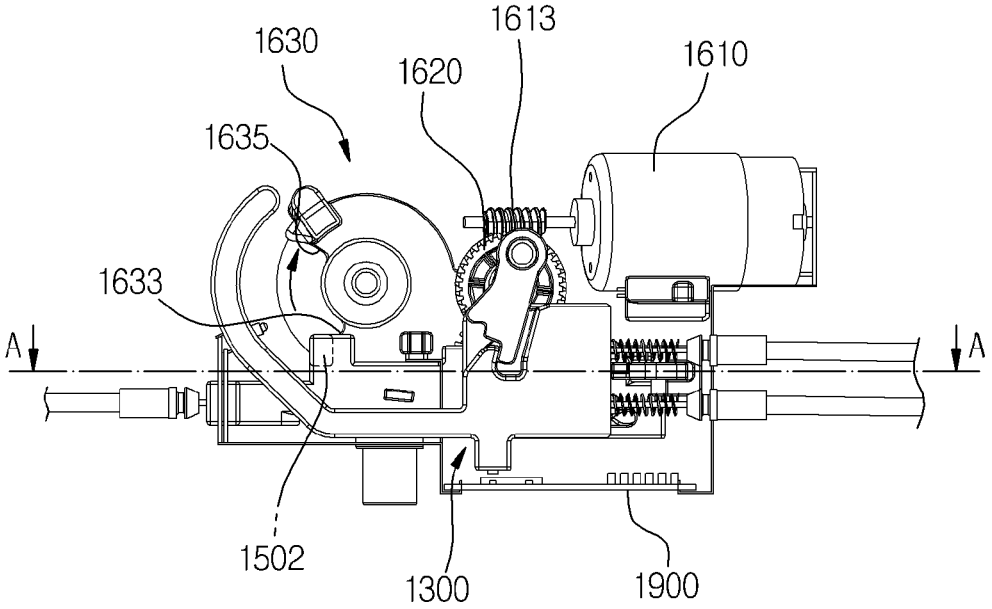
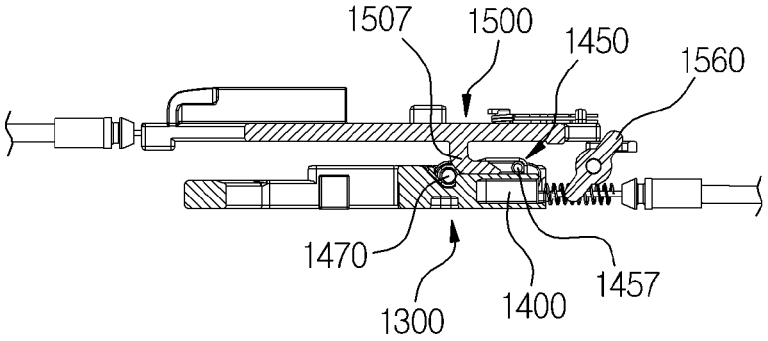

[Fig. 29]
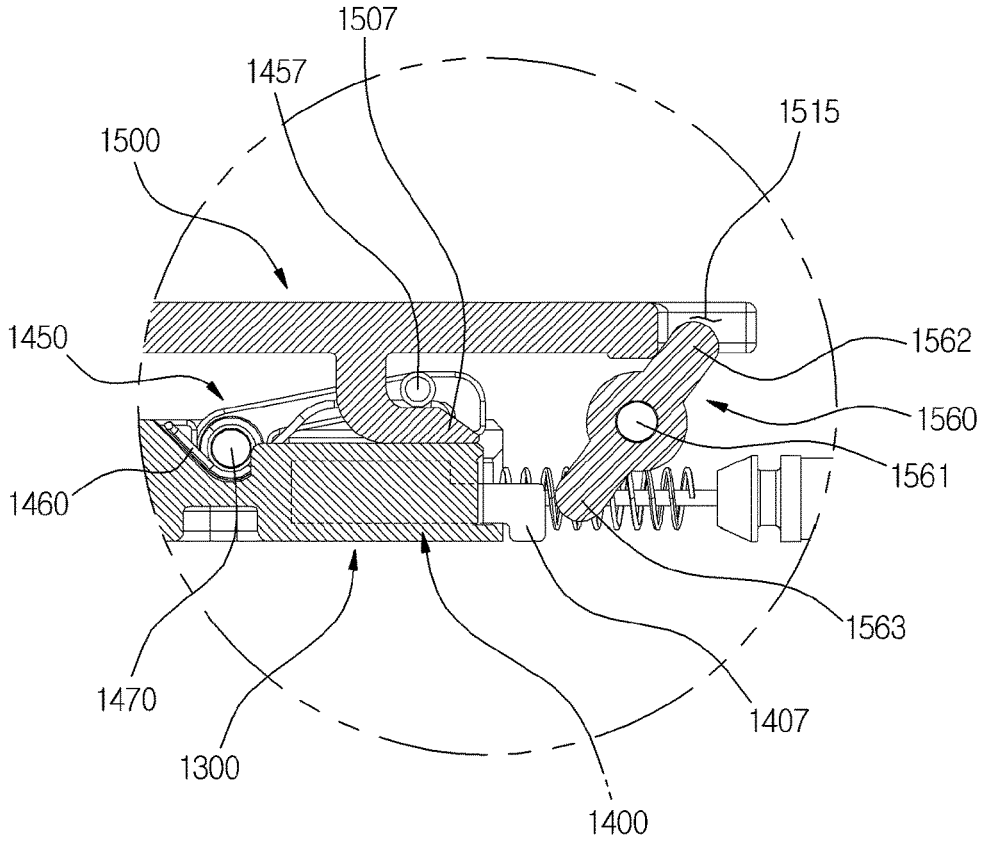
[Fig. 30]
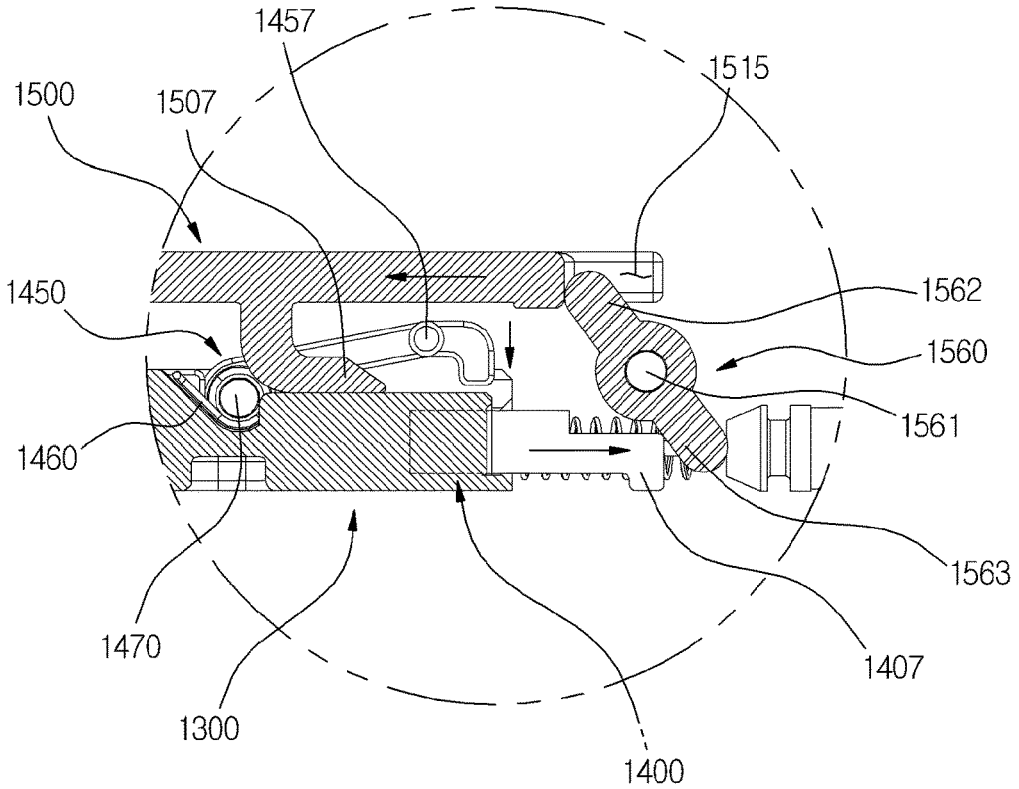

[Fig. 31]
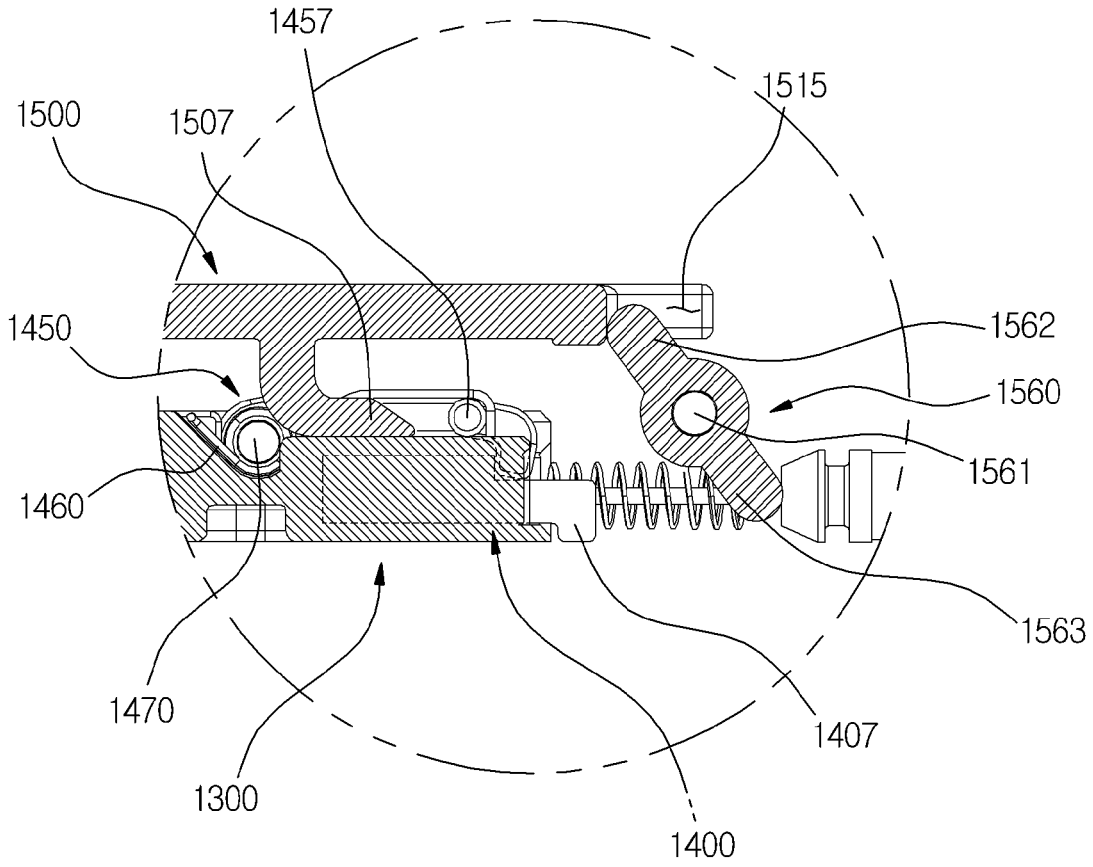

[Fig. 32]
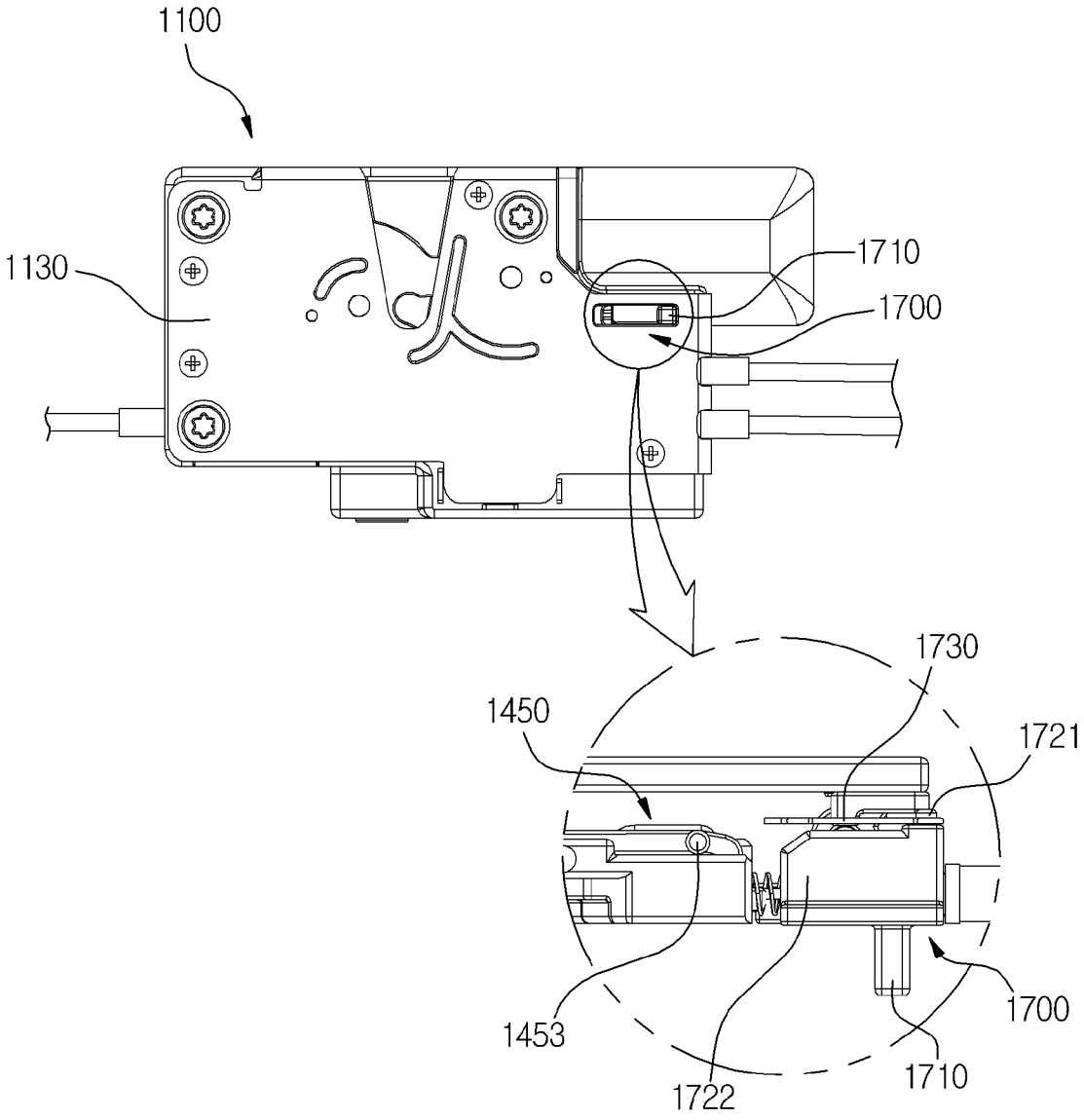

[Fig. 33]
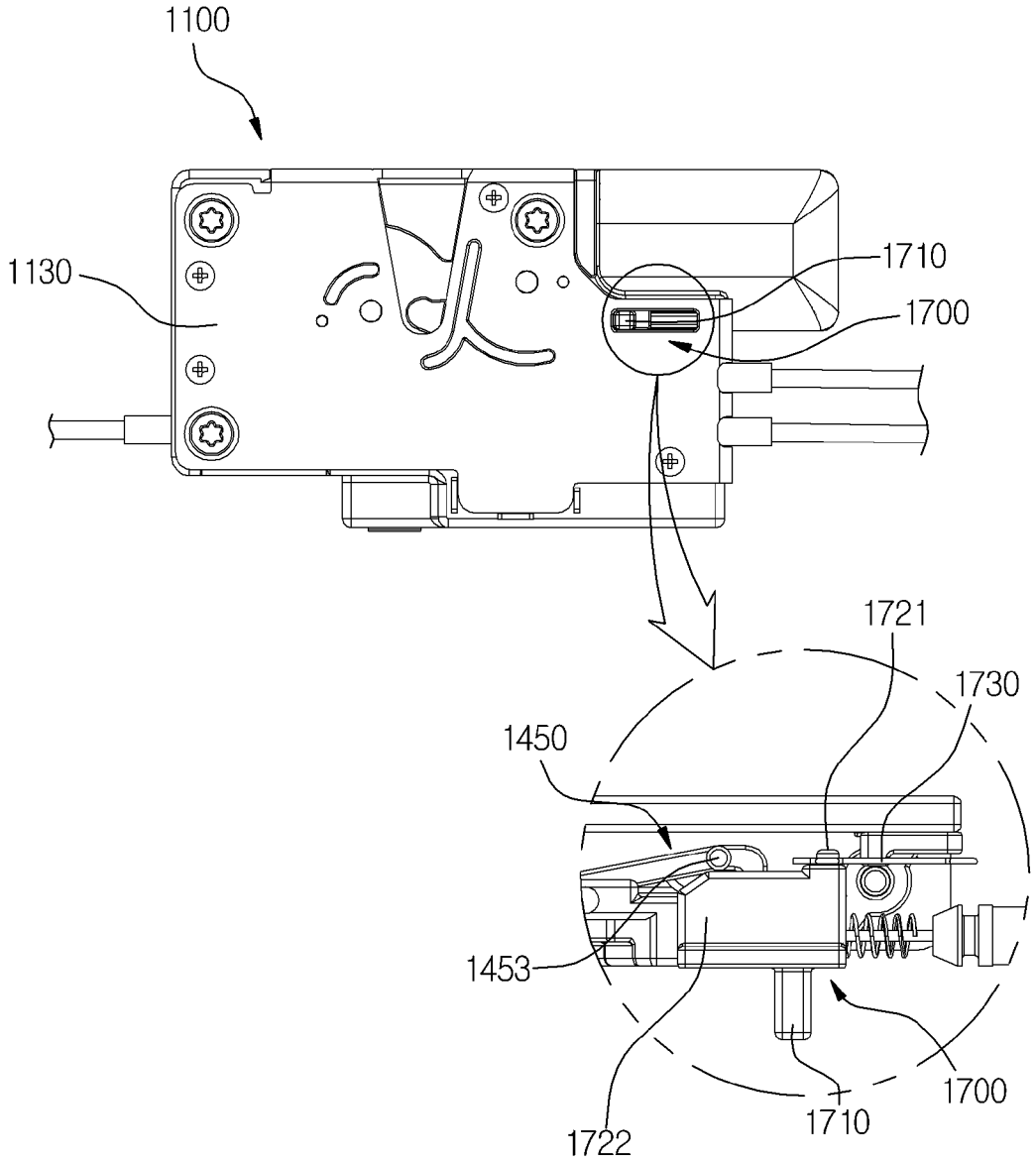

[Fig. 34]
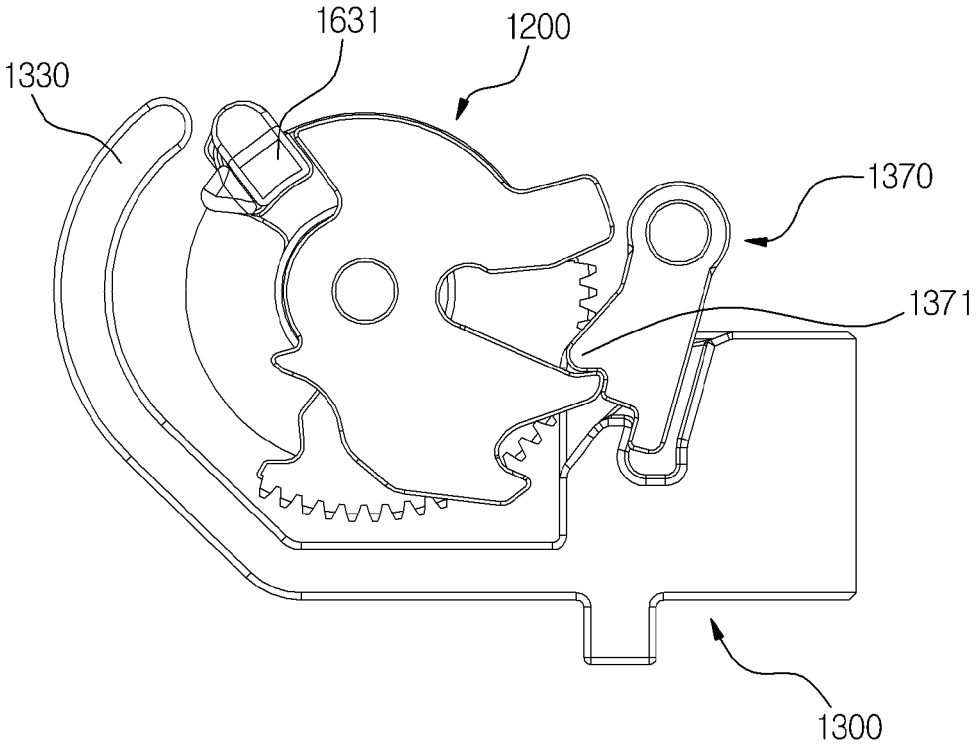
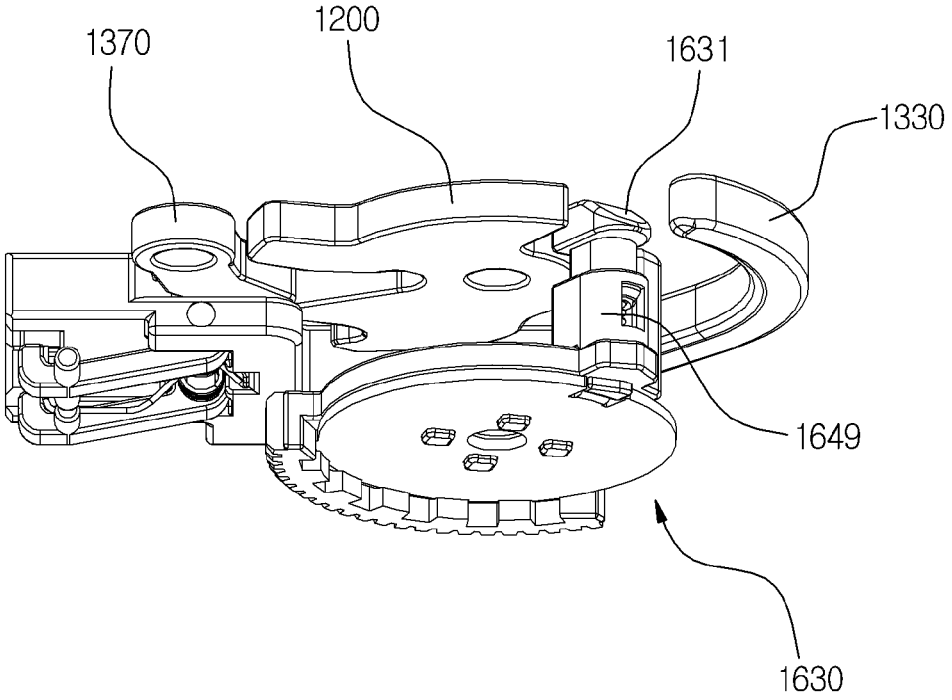

[Fig. 35]
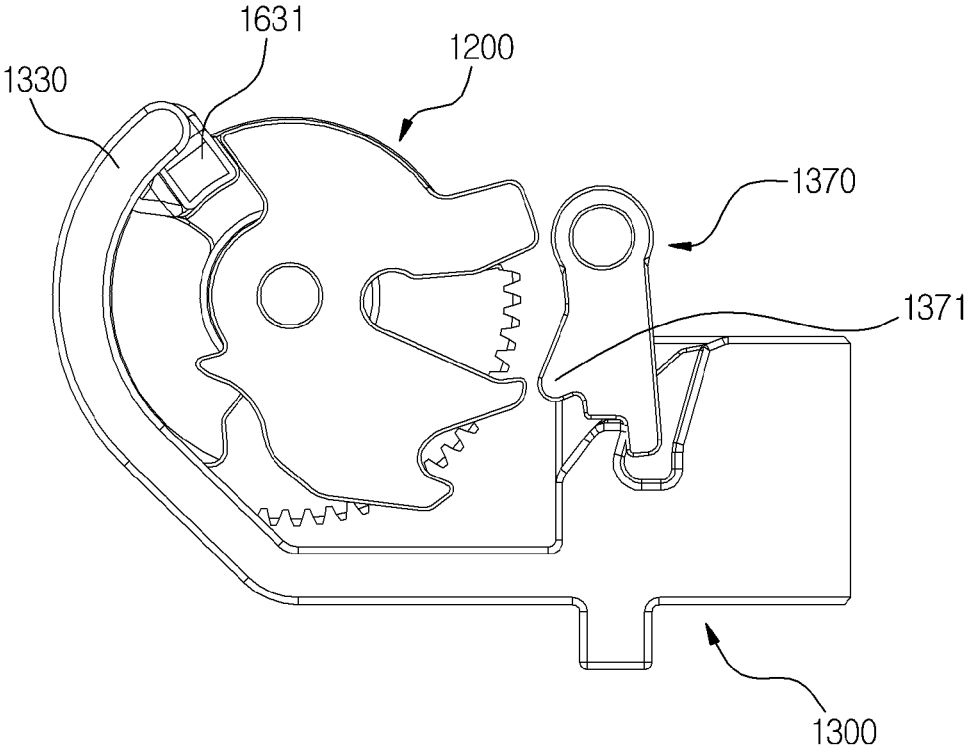
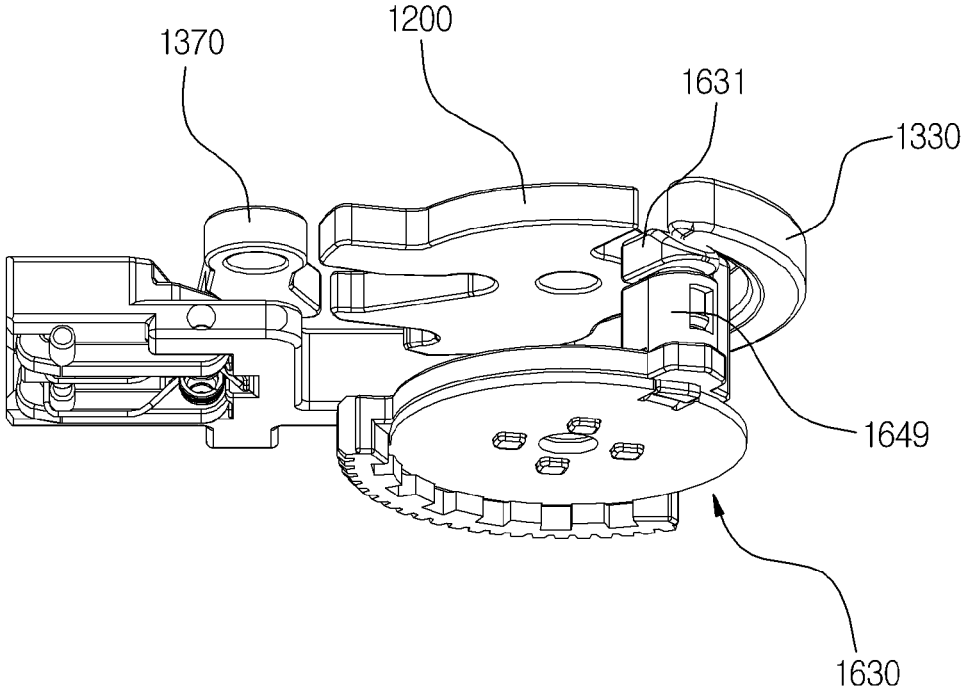

[Fig. 36]
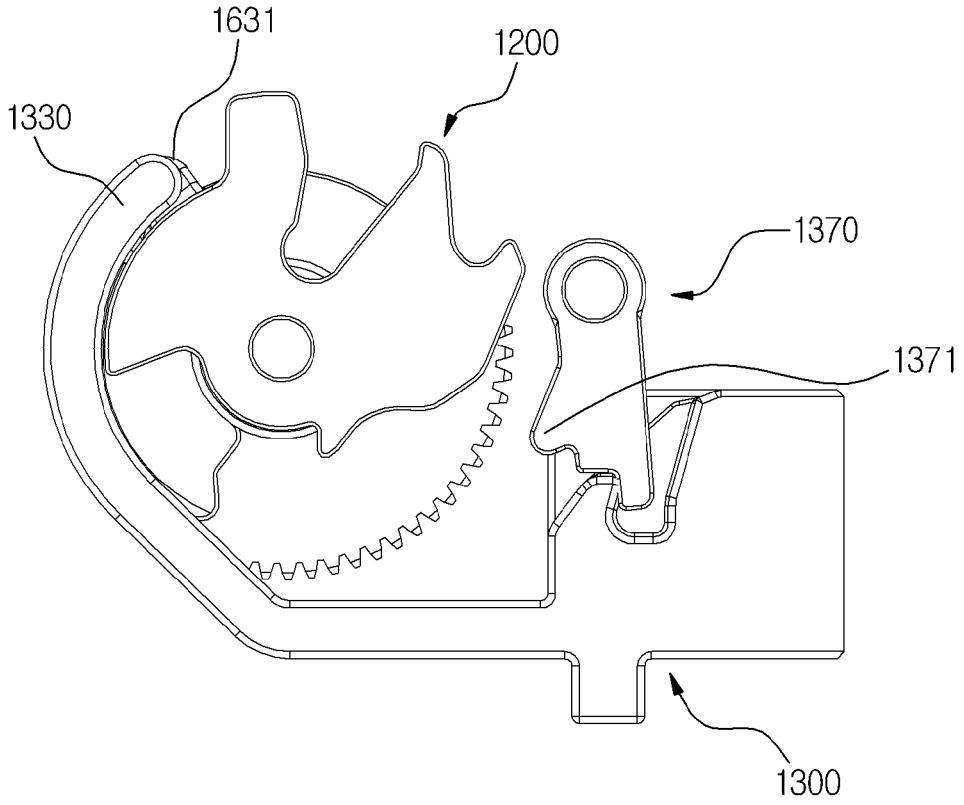
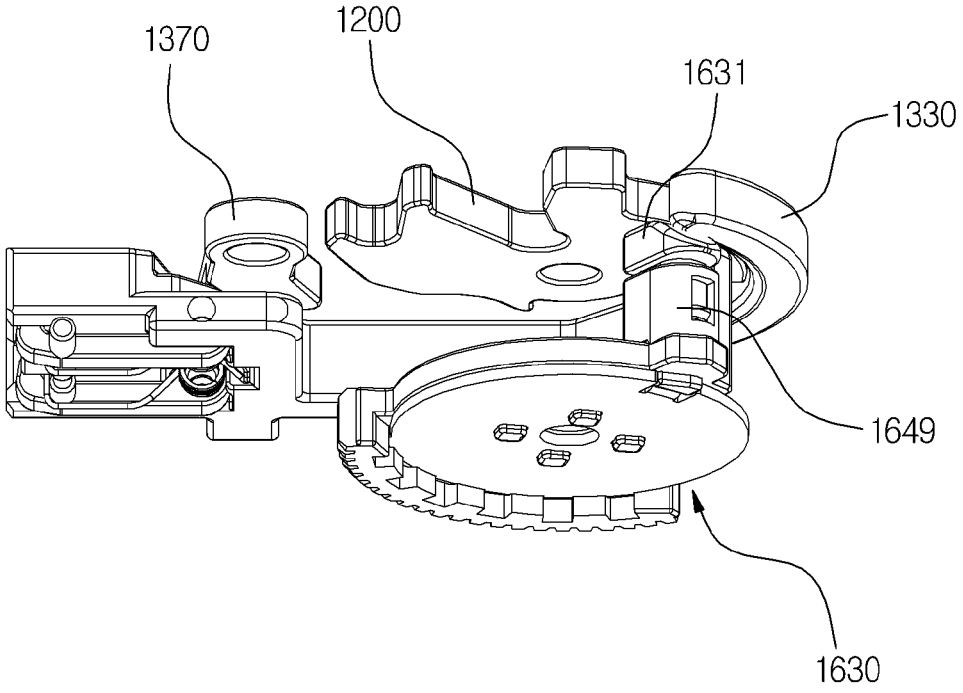

[Fig. 37]
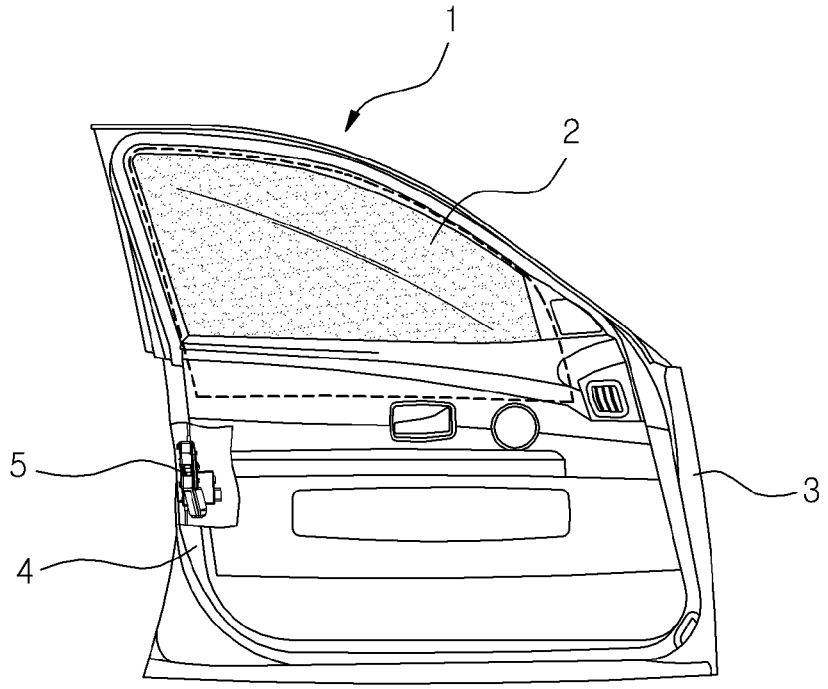
(a)
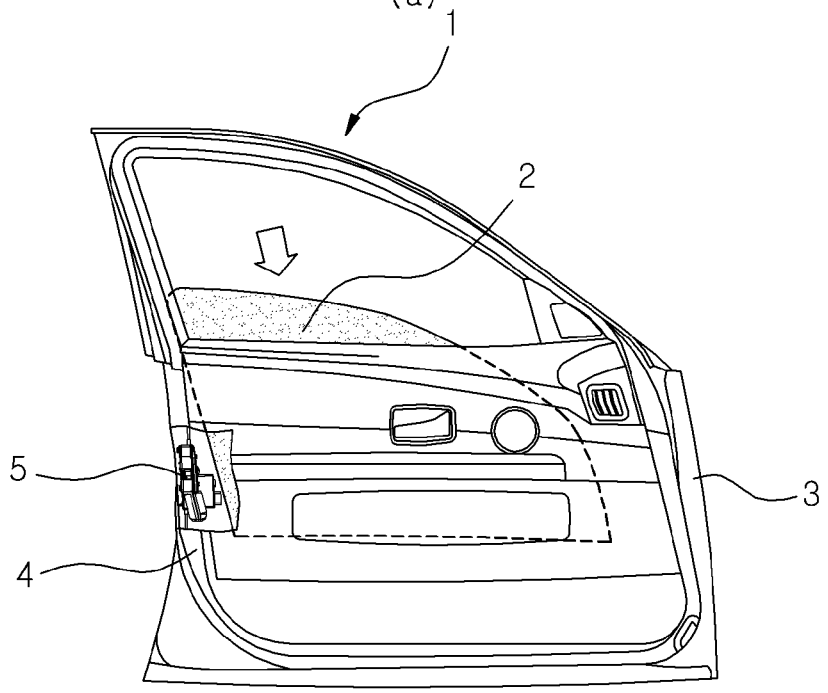
(b)

[Fig. 38]
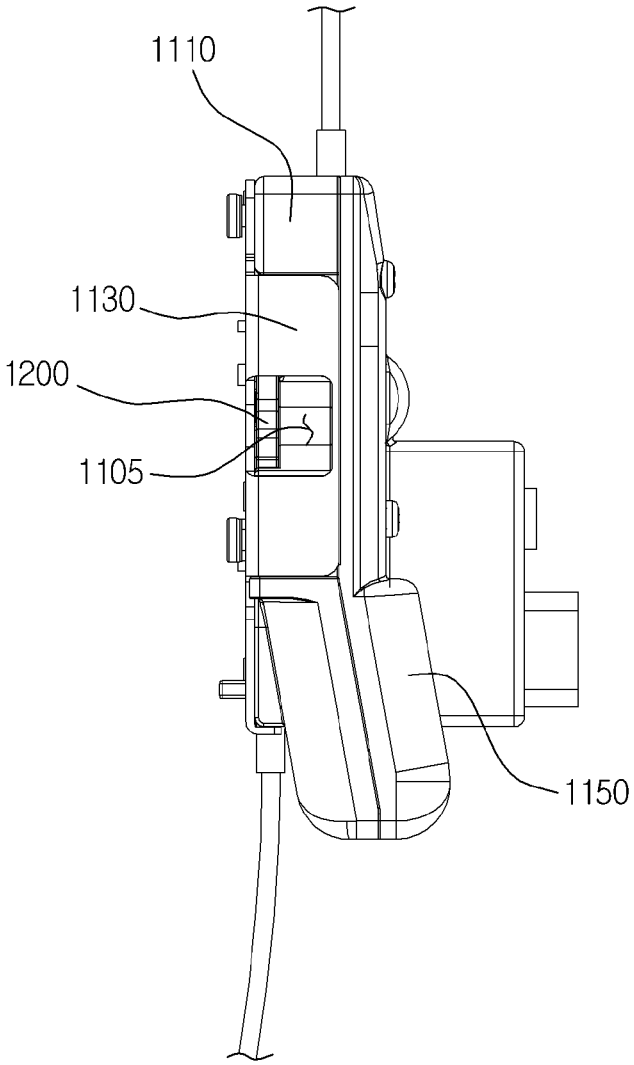

[Fig. 39]
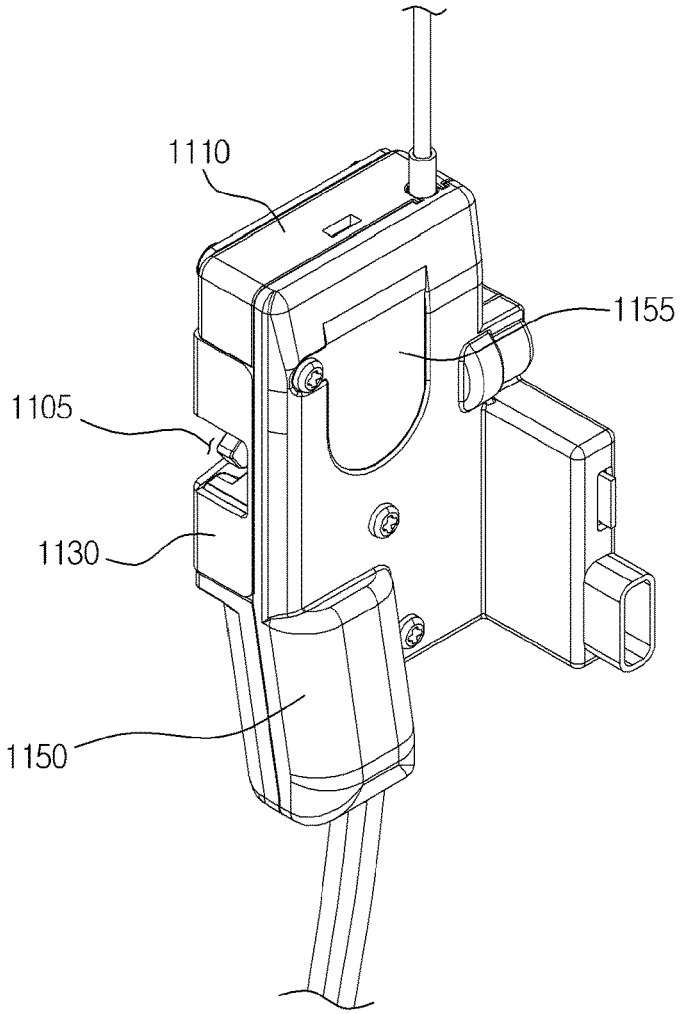
[Fig. 40]
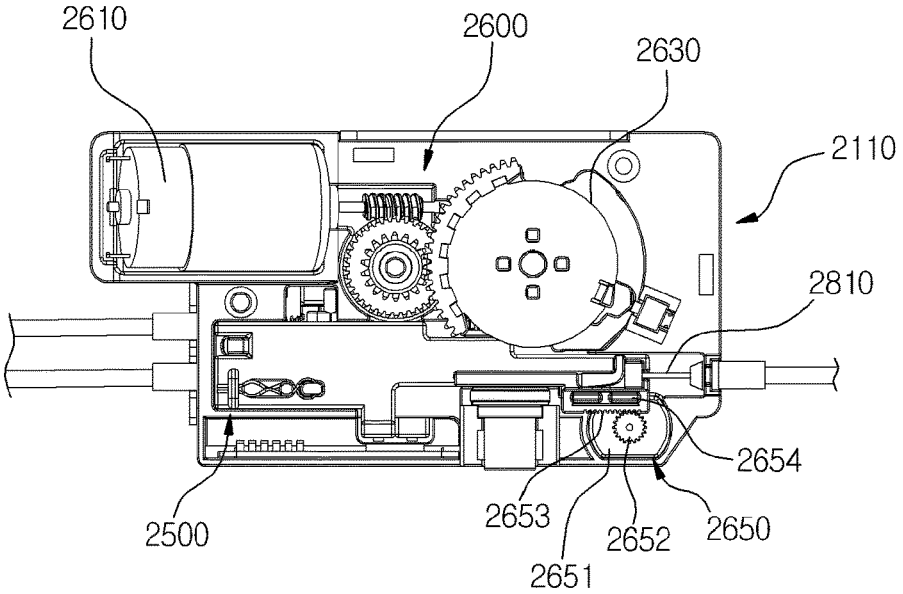

[Fig. 41]
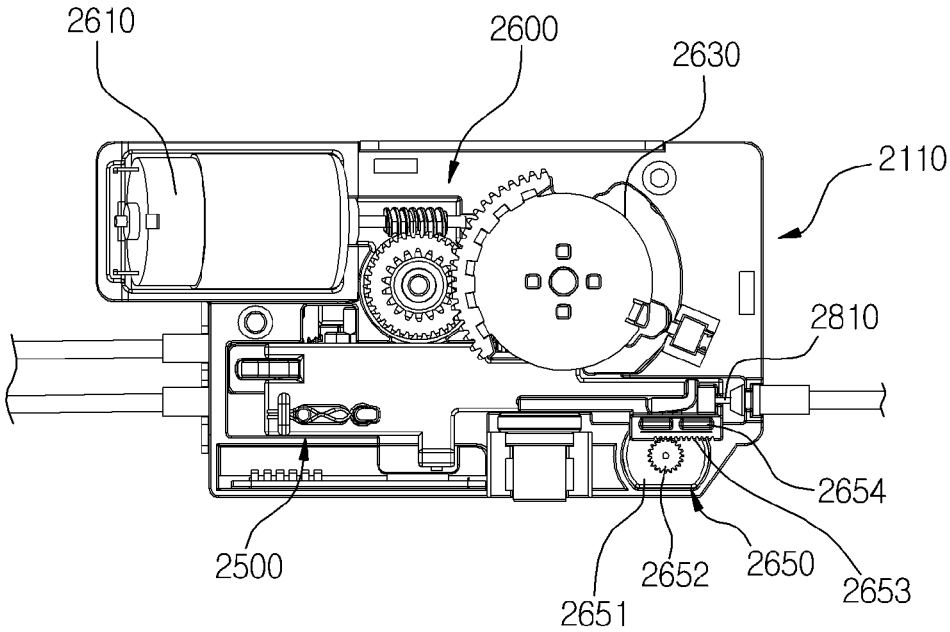
[Fig. 42]
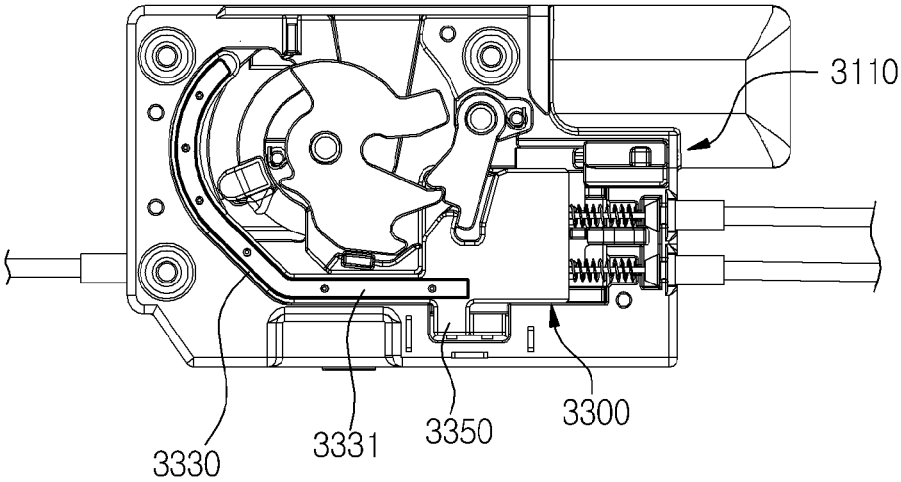

[Fig. 43]
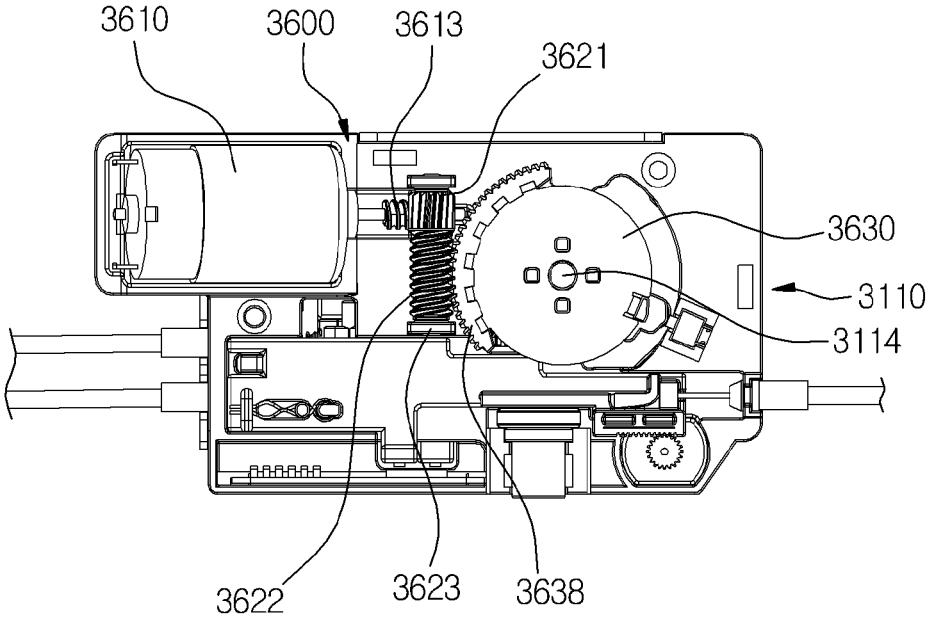
[Fig. 44]
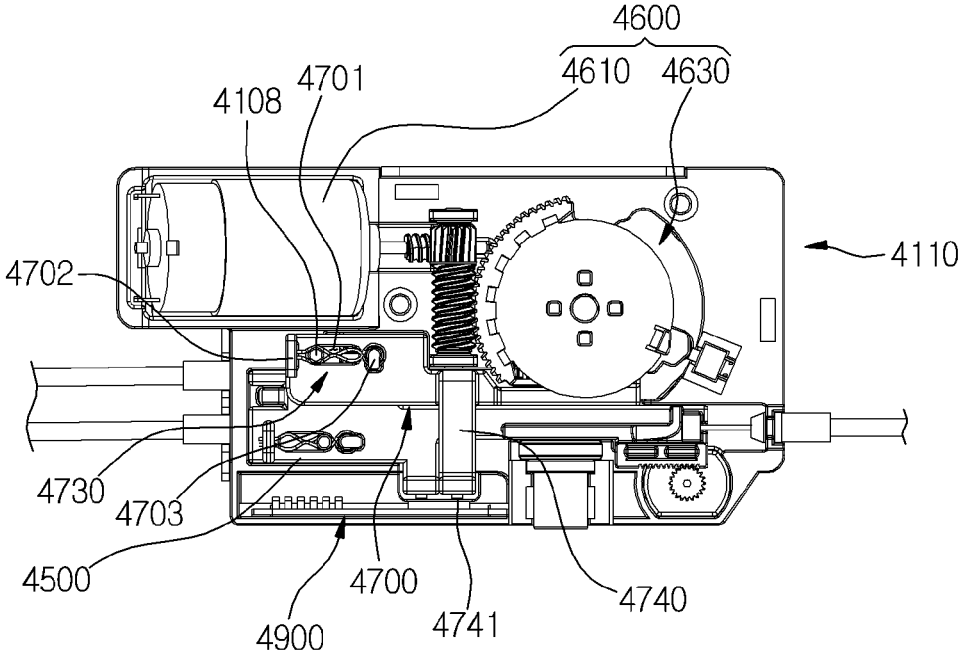

[Fig. 45]
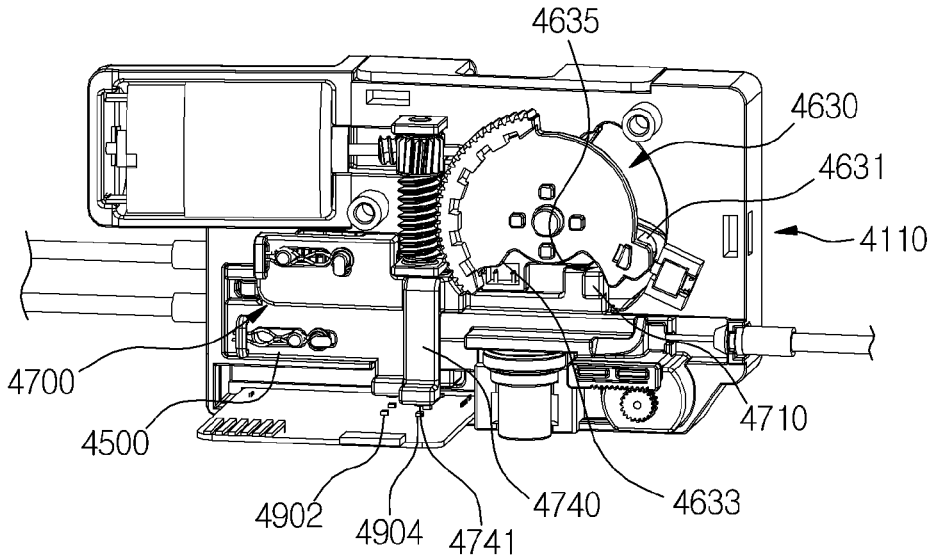
[Fig. 46]
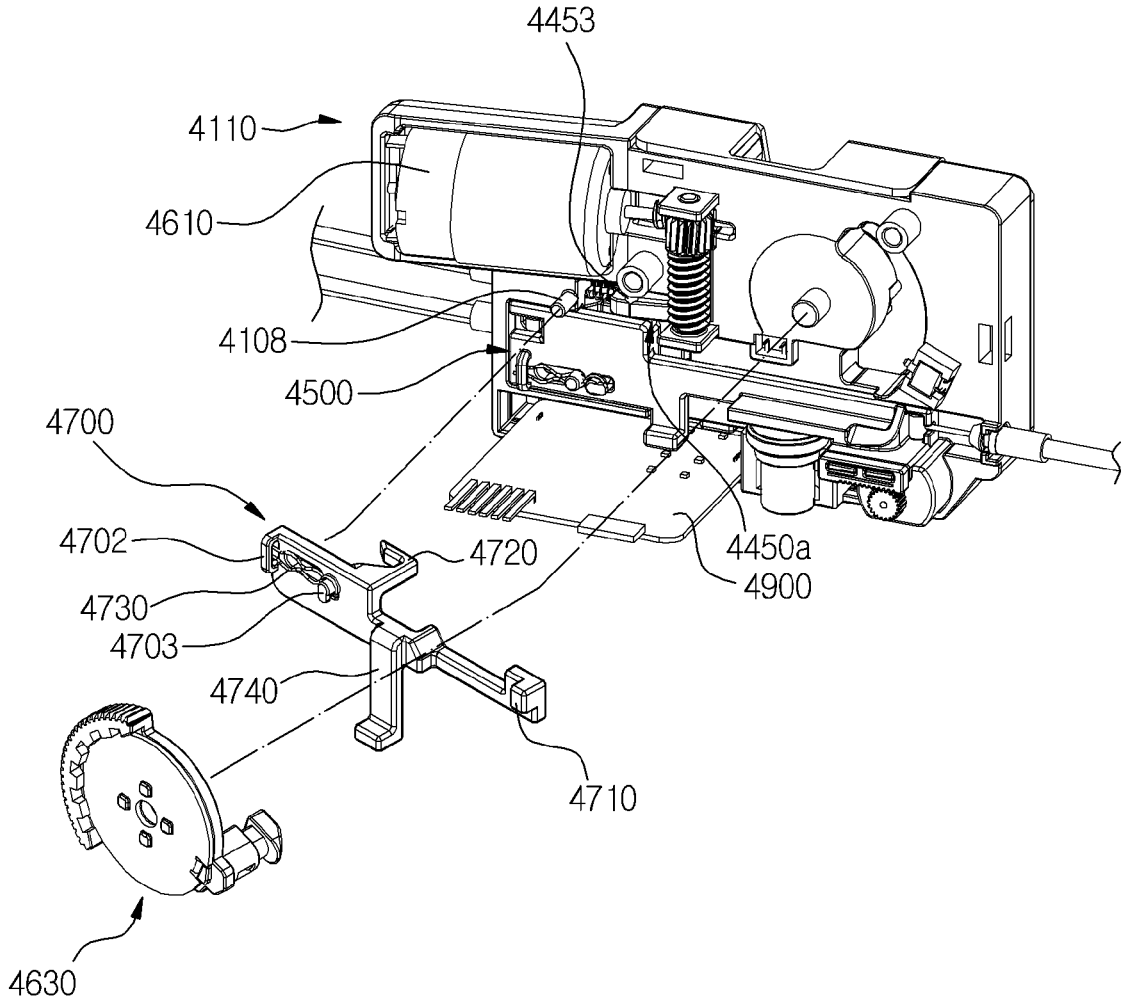

[Fig. 47]
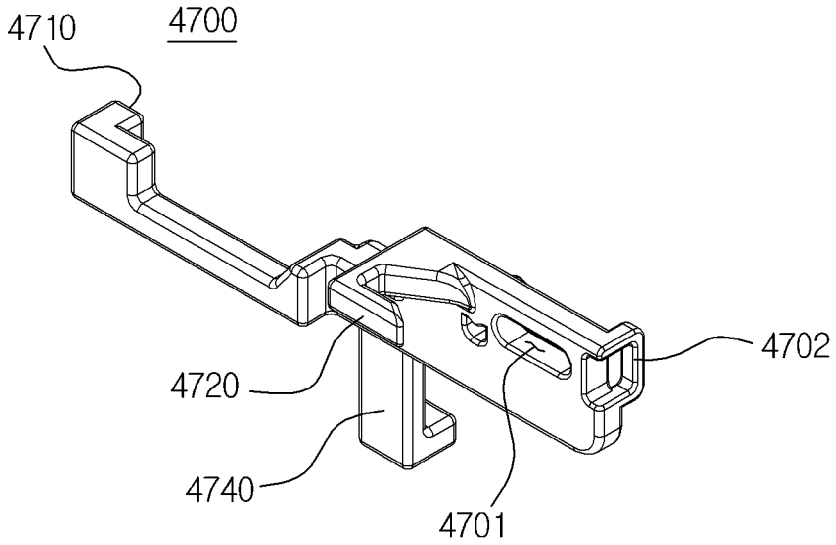

[Fig. 48]
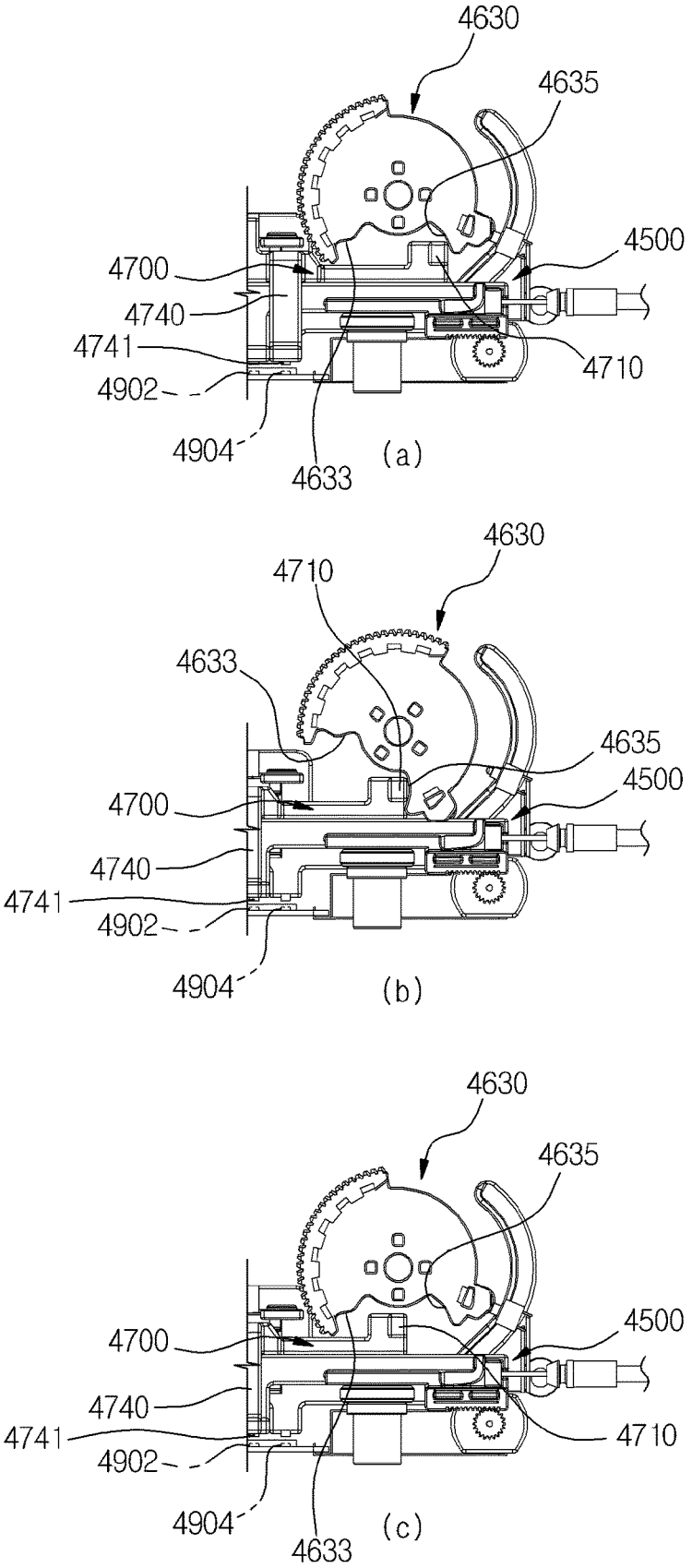

[Fig. 49]
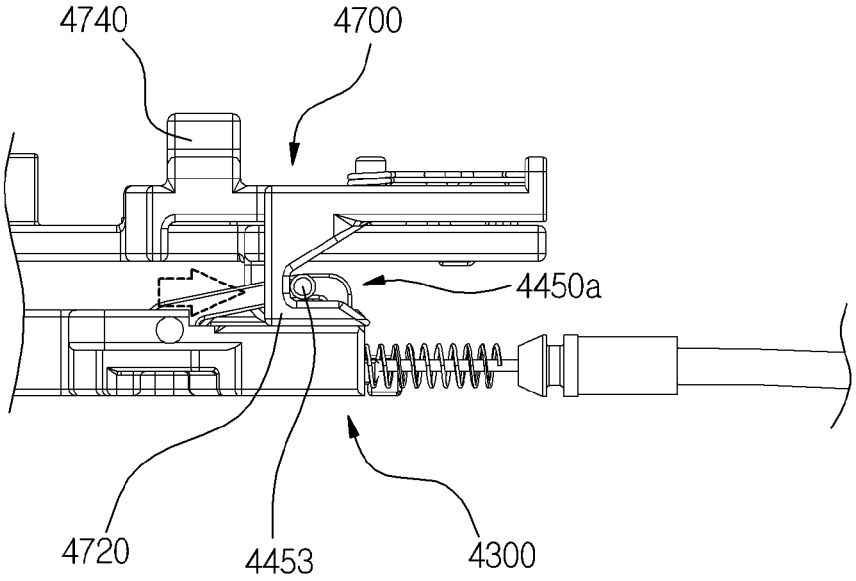

[Fig. 50]
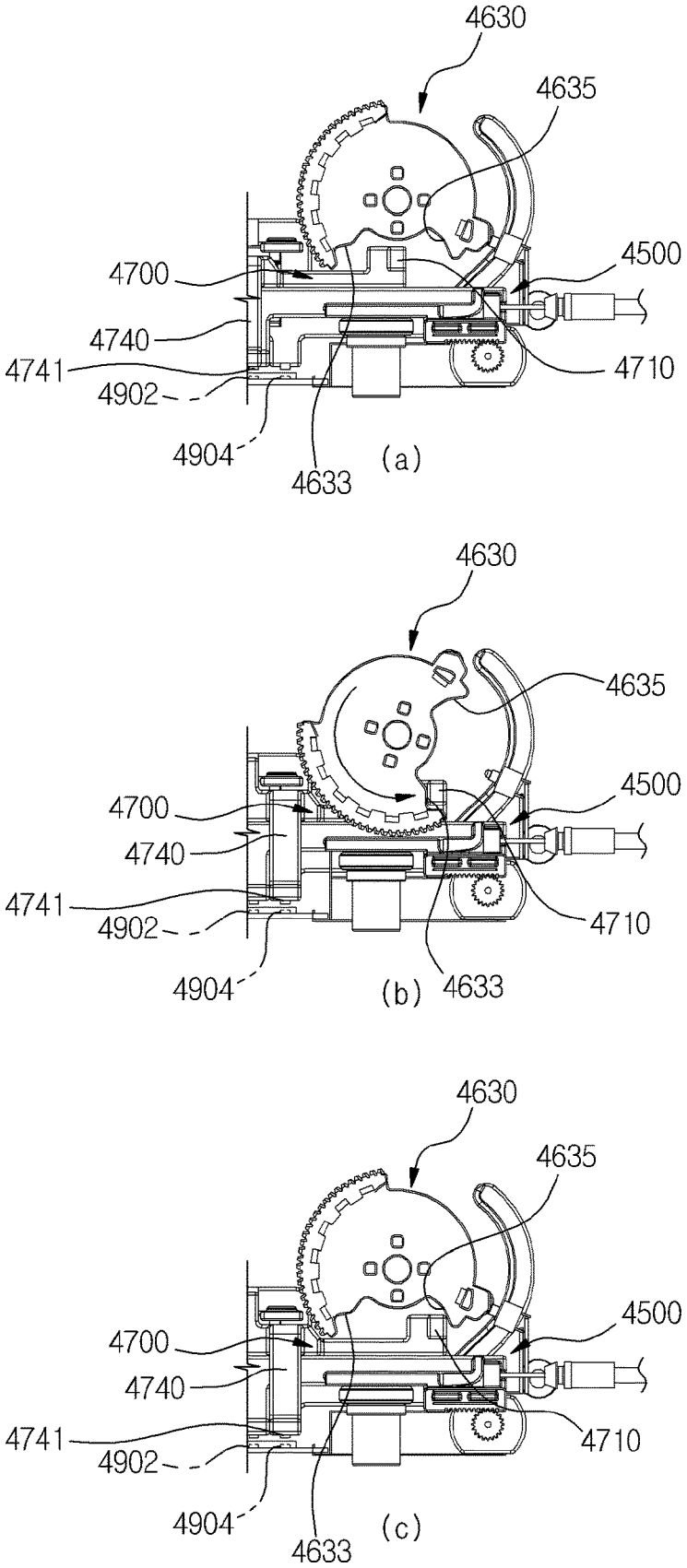

[Fig. 51]
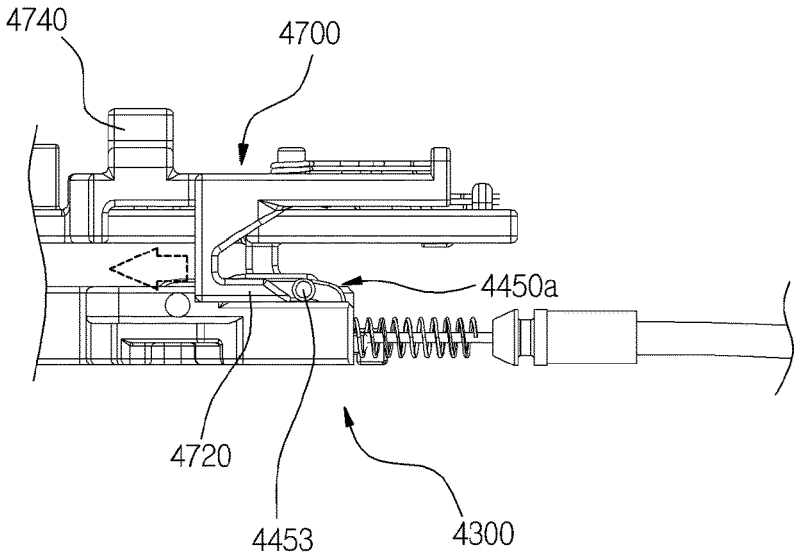
[Fig. 52]
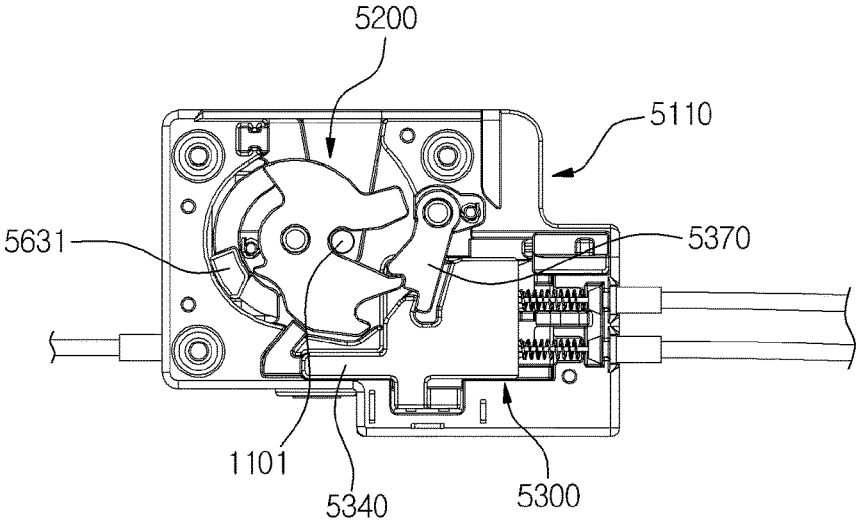
[Fig. 53]
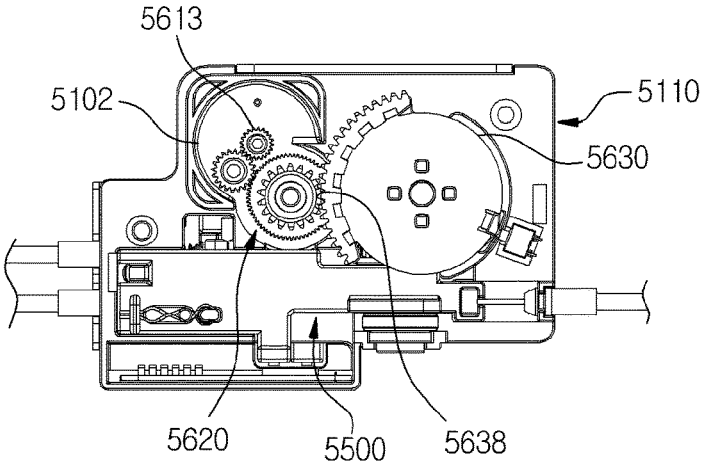

[Fig. 54]
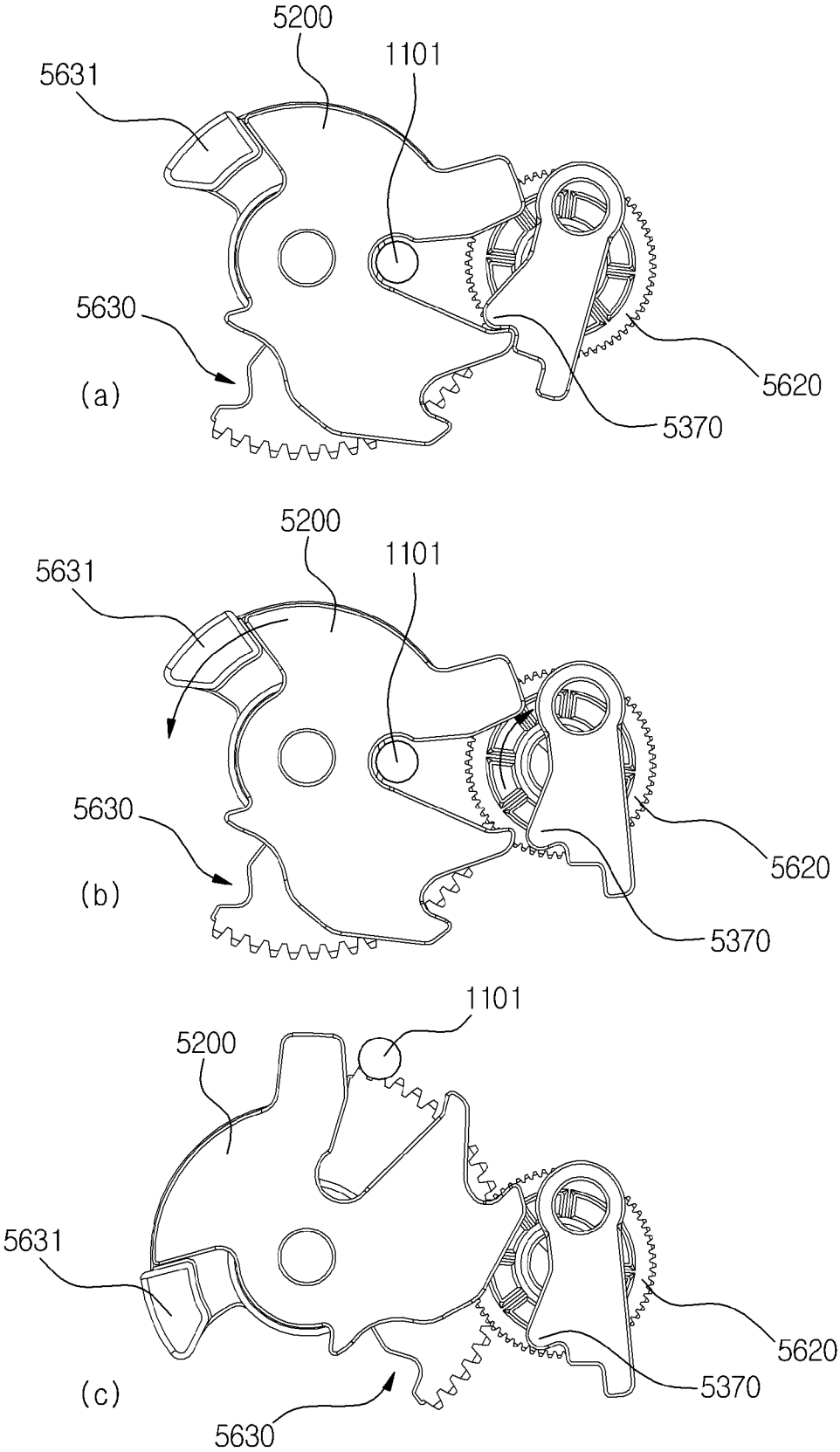

[Fig. 55]
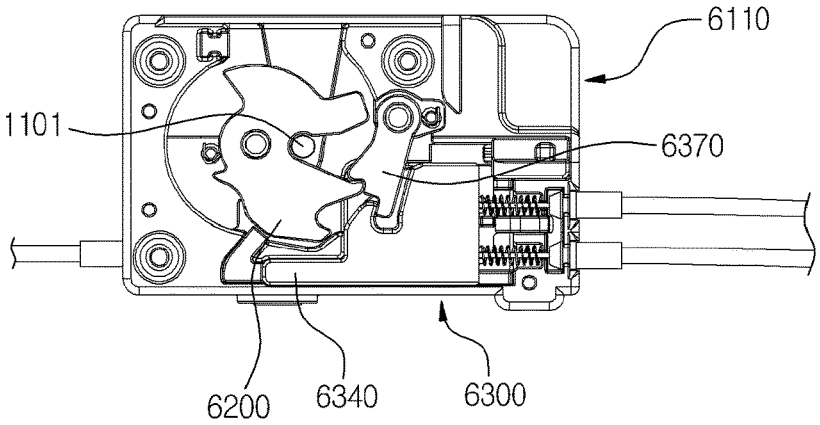
[Fig. 56]
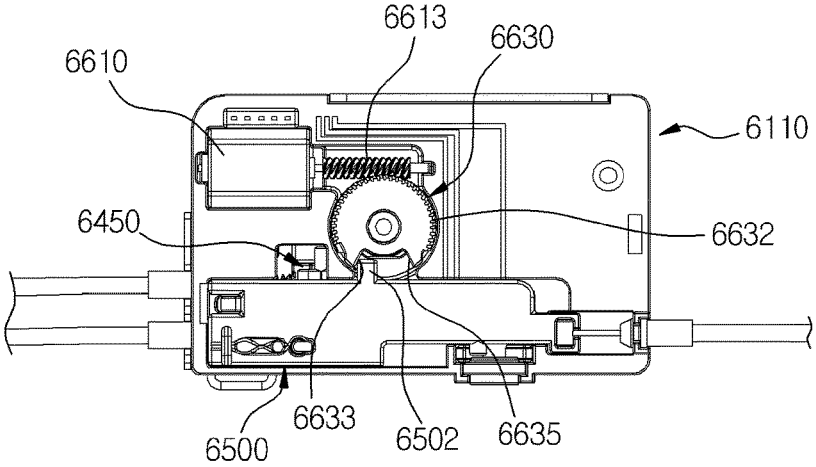
[Fig. 57]
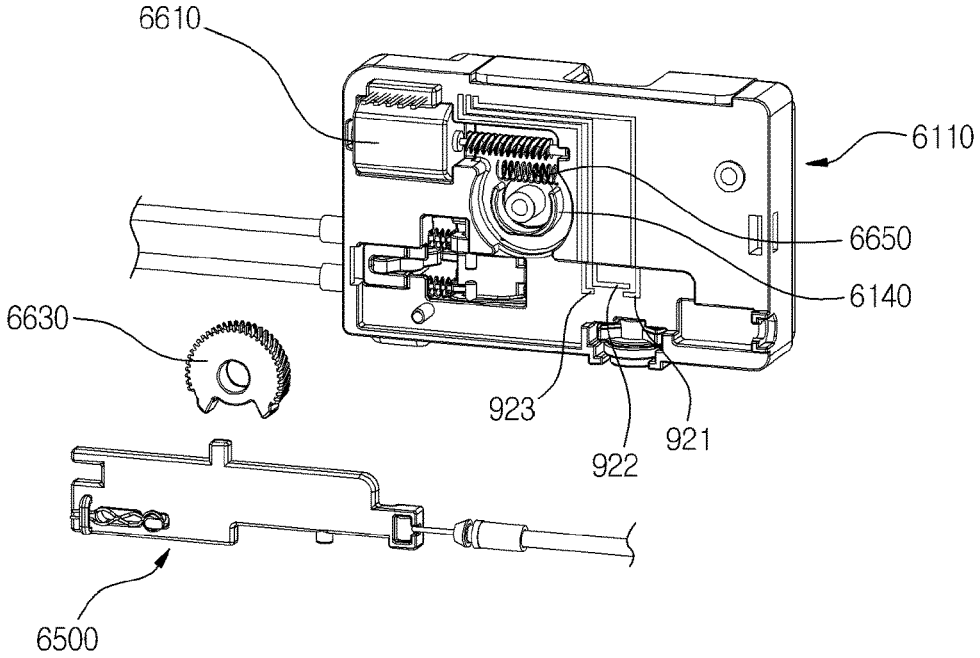

[Fig. 58]
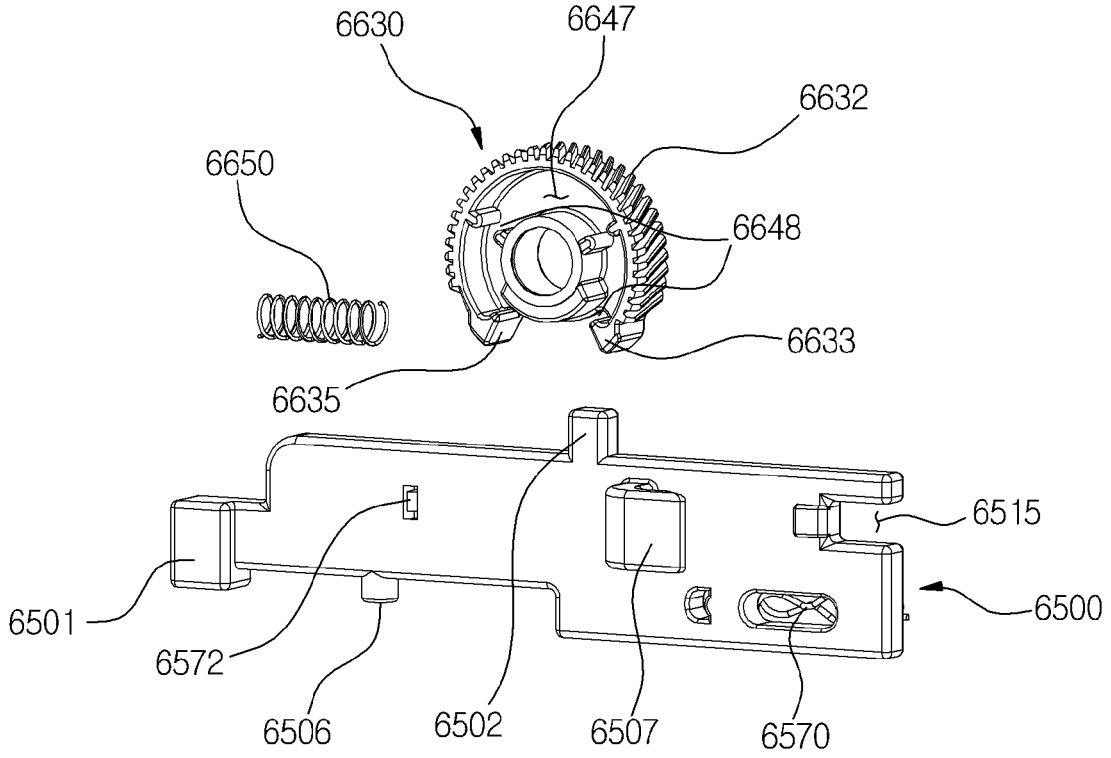

[Fig. 59]
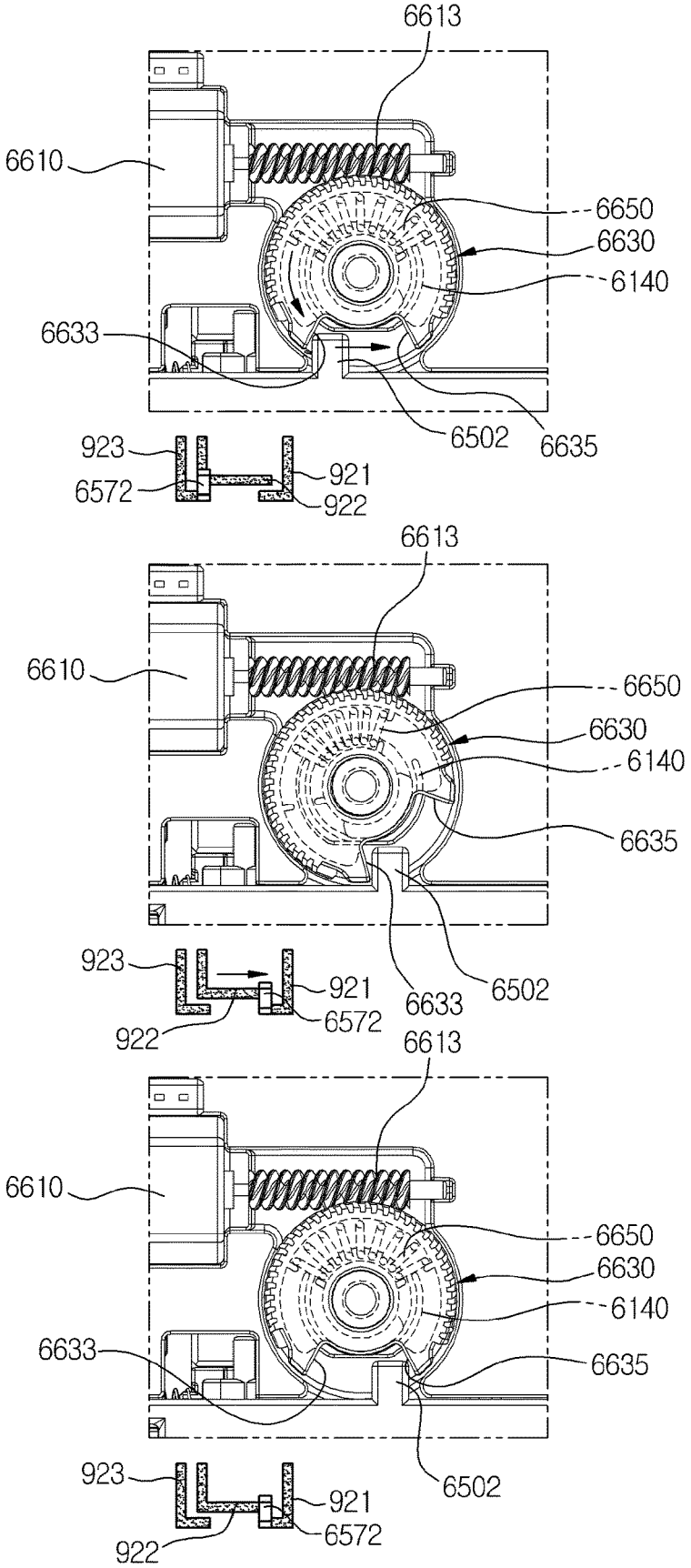

[Fig. 60]
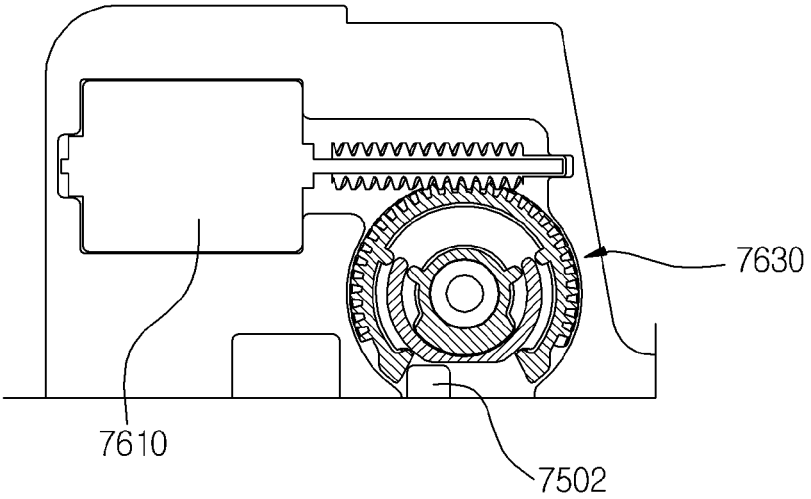
[Fig. 61]
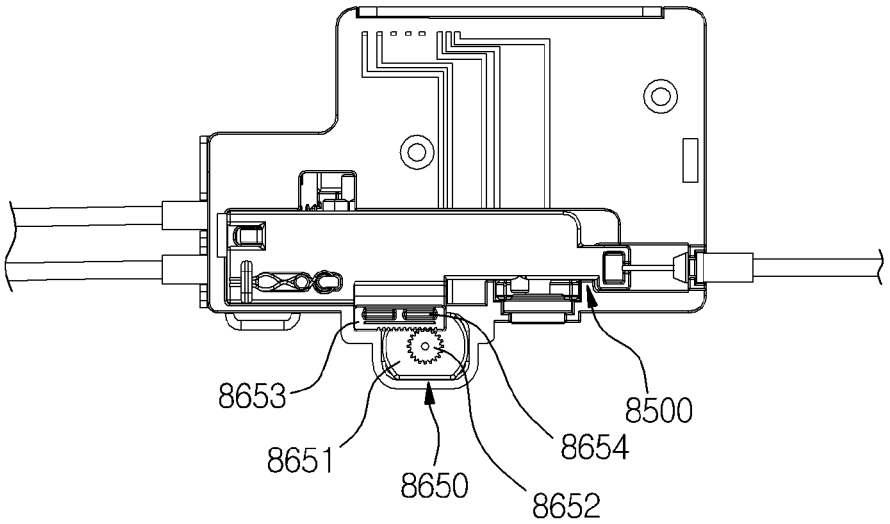
[Fig. 62]
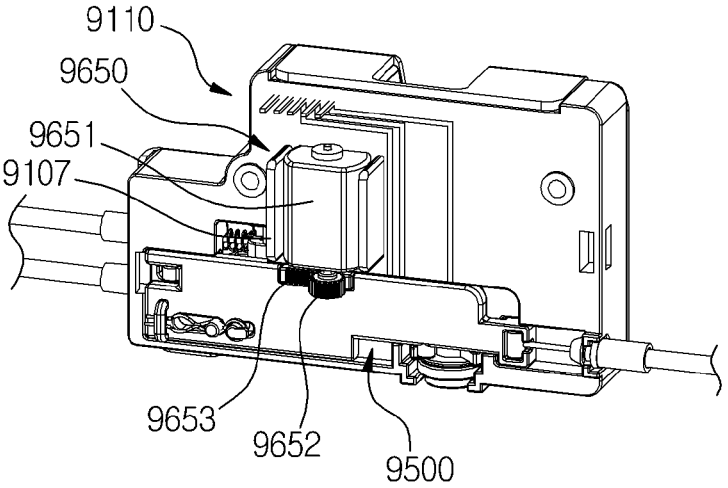

[Fig. 63]
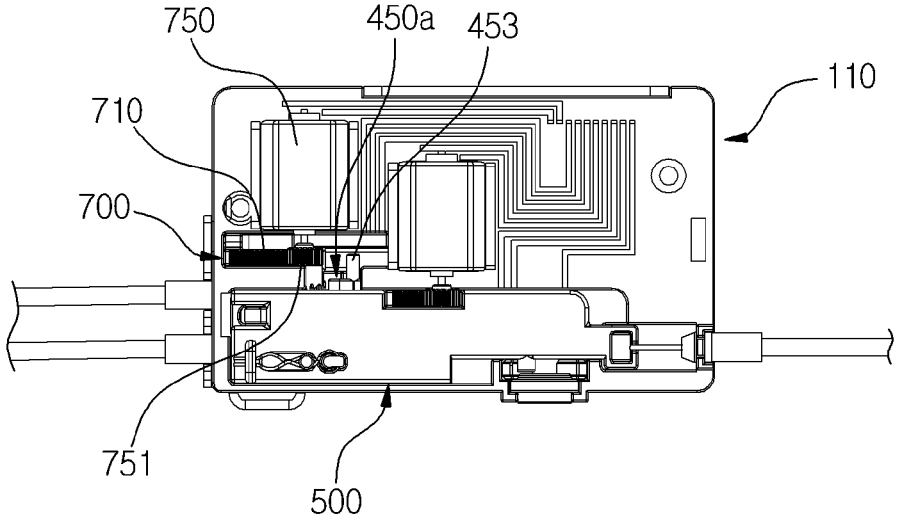
[Fig. 64]
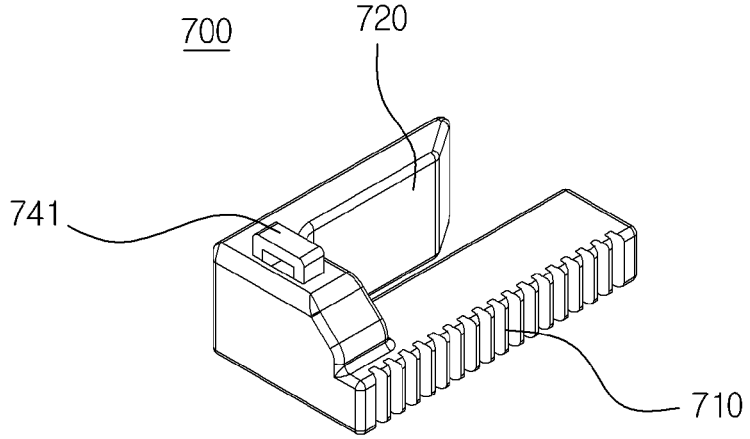
[Fig. 65]
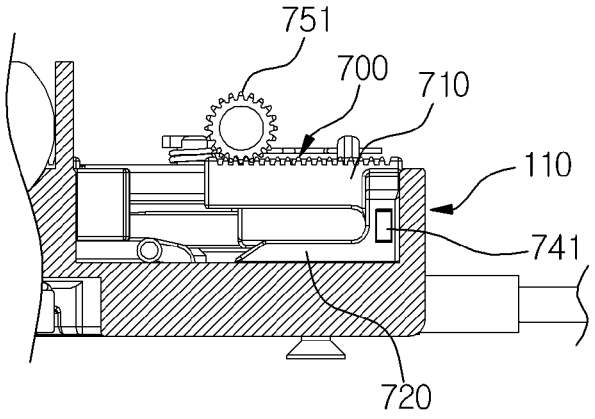

[Fig. 66]
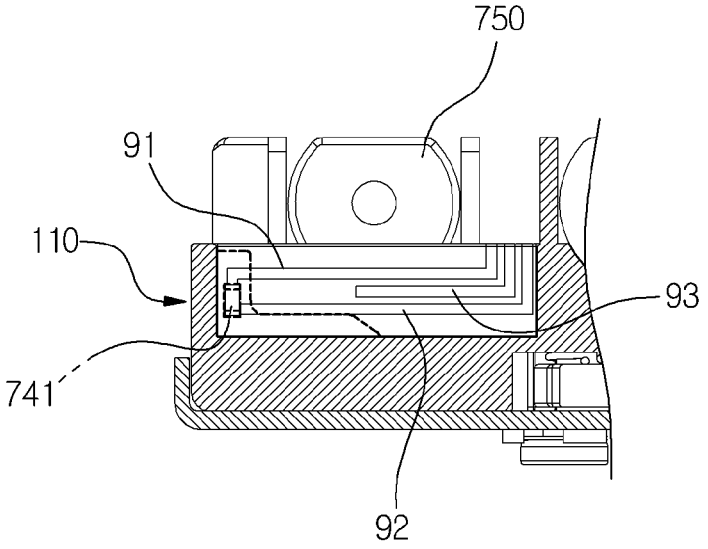
[Fig. 67]
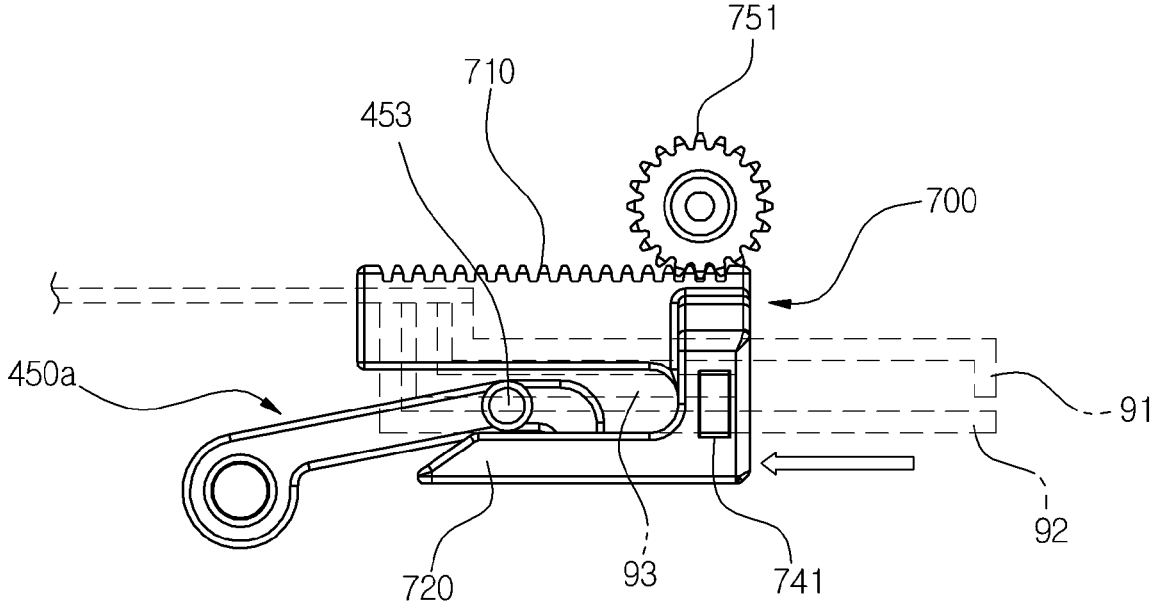

[Fig. 68]
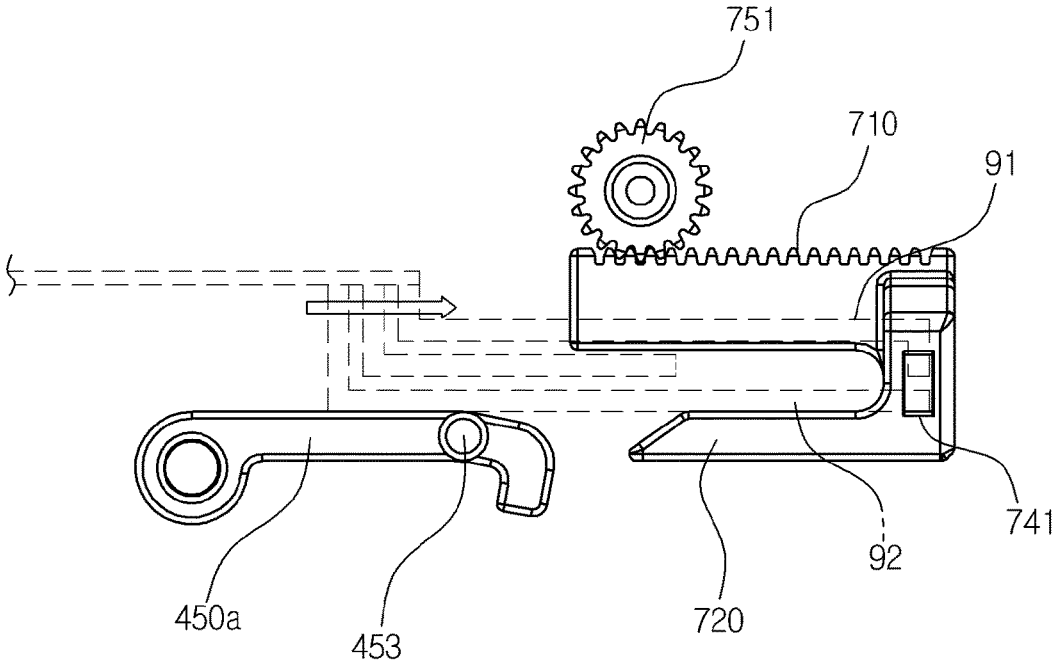
[Fig. 69]
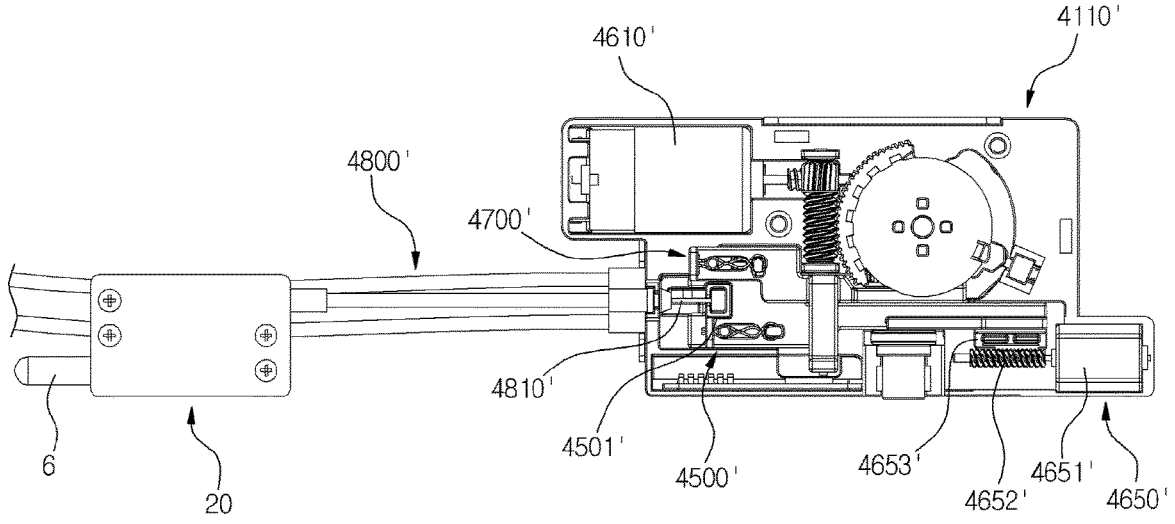

[Fig. 70]
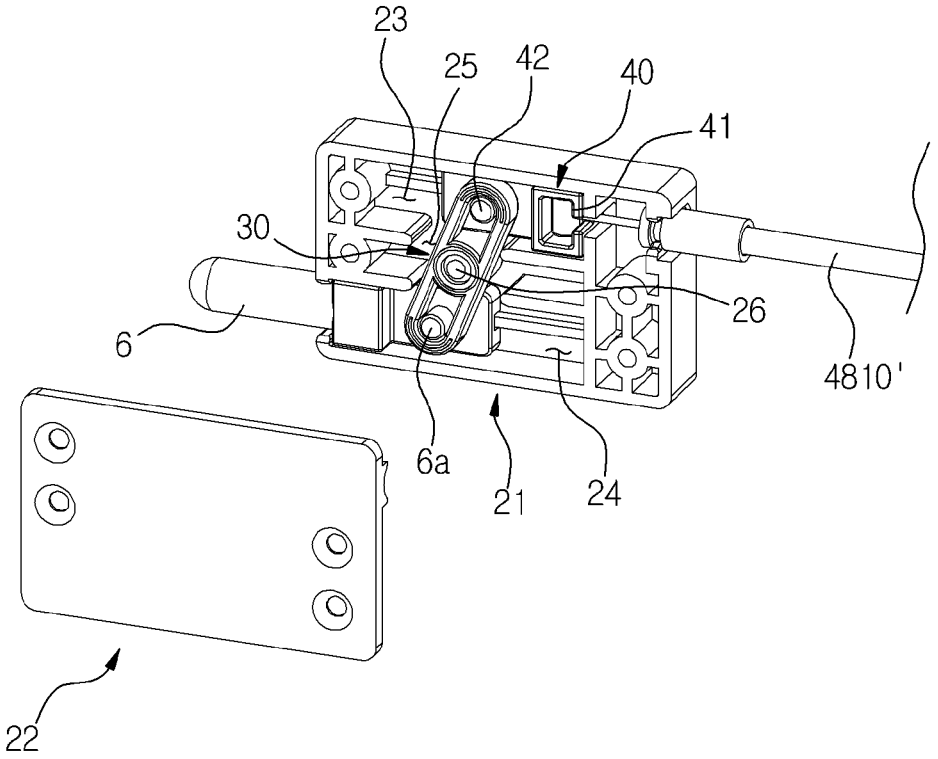
[Fig. 71]
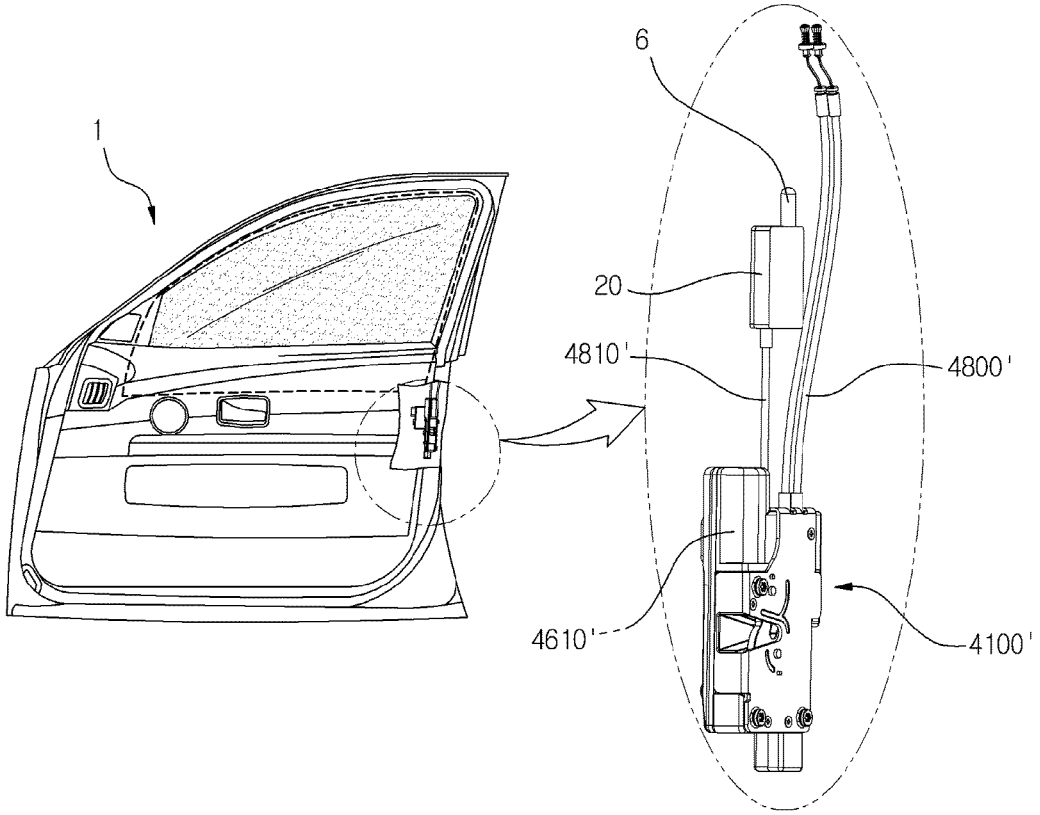

[Fig. 72]
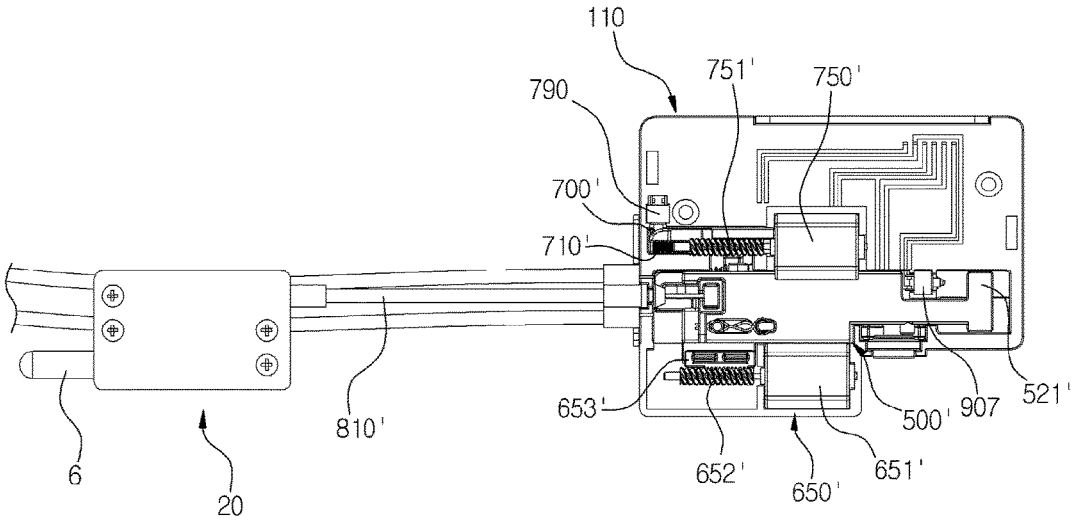
[Fig. 73]
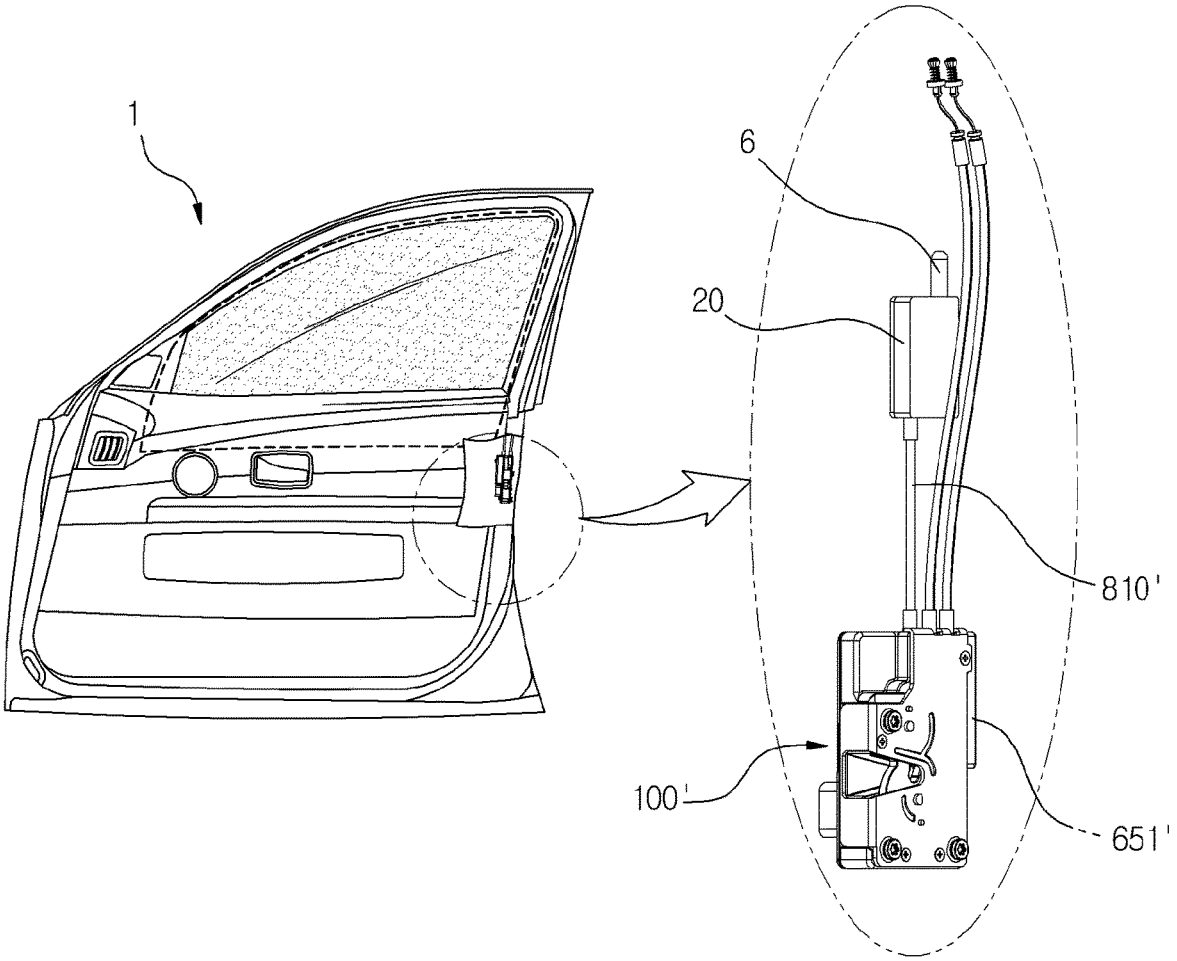

DOOR LATCH SYSTEM

TECHNICAL FIELD

The present invention relates to a door latch system, more particularly, relates to a door latch system which includes:

a stopping lever unit rotatably installed in any one of a main locking member and a sub-locking member;

a stopping threshold formed in the other one of the main locking member and the sub-locking member wherein a stopping protrusion is being stopped; and a locking plate slidingly installed in a housing for rotating the stopping lever unit, wherein a lever guide portion is formed in the locking plate, and a guide bar is formed in the stopping lever unit, so that the rotation of the stopping lever unit is accomplished as the guide bar is guided by the lever guide portion, and when the stopping lever unit is caught by the stopping threshold due to the sliding of the locking plate, the main locking member and the sub-locking member are sliding together, and when the stopping lever unit is separated from the stopping threshold due to the sliding of the locking plate, only the sub-locking member is slided.

BACKGROUND ART

Generally, a door latch system is used for opening and closing the automobile's door or locking or lock-releasing thereof, as suggested in Korea Patent No. 0535053.

However, such door latch system of the prior art has a problem wherein an unnecessary force is applied to the various components such as a latch connected to the door lever and the like when the door lever is pulled while the door is being locked, therefore, damages in the various components of the door latch system may easily occur, consequently, there is a problem of an excessive maintenance cost.

Moreover, the structure of such door latch system of the prior art is complicated.

LEADING TECHNICAL LITERATURE

Patent Literature

[Patent Literature 1] Korea Patent No. 0535053

[Patent Literature 2] Korea Patent Publication No. 2015-0069453

DISCLOSURE OF INVENTION

Technical Problem

An objective of the present invention devised for solving the above mentioned problems, is to provide a door latch system wherein the structure for connecting the main locking member and the sub-locking member becomes simple, and also the durability of the device is enhanced.

Solution to Problem

To achieve above described objective, the door latch system of the present invention is characterized in that and includes: a housing; a latch rotatably installed in the housing; a main locking member slidingly installed in the housing for locking the latch; a sub-locking member slidingly installed in the housing and disposed in one side of the main locking member; a stopping lever unit rotatably installed in any one of the main locking member and the sub-locking member wherein a stopping protrusion is formed; a stopping threshold formed in any one of the main locking member and the sub-locking member wherein the stopping protrusion is caught by; and a locking plate slidingly installed in the housing to rotate the stopping lever unit, wherein a lever guide portion is formed in the locking plate, and a guide bar is formed in the stopping lever unit, so that the rotation of the stopping lever unit is accomplished as the guide bar is guided by the lever guide portion, and when the stopping lever unit is caught by the stopping threshold due to the sliding of the locking plate, the main locking member and the sub-locking member are sliding together, and when the stopping lever unit is separated from the stopping threshold due to the sliding of the locking plate, only the sub-locking member is slided.

The stopping lever shaft of the stopping lever unit is formed along the up-down direction, and the lever guide portion is protrudedly formed towards the stopping lever unit; and in the lever guide portion, an inclined surface may be formed on the surface being contacted with the guide bar.

A driving unit for rotating the latch is further included; a stopping portion for rotating the latch is formed in the driving unit; the stopping portion is installed in the driving unit slidably along the front and rear side direction; a stopping portion pressing arm for pressing the stopping portion is formed in the main locking member; a stopping portion return spring which returns the stopping portion to the original position is further provided in the driving unit; the stopping portion is protrudedly formed towards the outside further from the latch; and a stopping portion reinforcing member made of a metallic material may be inserted in the stopping portion pressing arm.

A manual locking member is rotatably installed in the housing; a first stopping portion caught by the sub-locking member, and a second stopping portion caught by the locking plate, are formed in the manual locking member; and the first stopping portion and the second stopping portion may be disposed spaced apart along the circumferential direction.

A rotating member being rotated by the latch and sliding the main locking member is further included; at least a portion of the rotating member is disposed in front of the main locking member; the sub-locking member is disposed in rear side of the main locking member; and a sub-locking member insertion slot wherein the sub-locking member is inserted may be formed in rear side of the main locking member.

A locking driving unit for sliding the locking plate is further included; the locking driving unit includes a motor; and the locking driving unit and the locking plate may be connected through a rack and a pinion.

The locking driving unit includes a motor, and the motor and the locking plate may be connected through a worm and a worm gear.

The motor is disposed in the lower side of the locking plate, and the shaft of the motor may be disposed along the front and rear side direction.

The motor is disposed in the upper side of the locking plate, and the shaft of the motor may be disposed along the up-down direction.

The locking driving unit includes a motor and a main gear being rotated by the motor; the motor and the main gear are connected through the worm and the worm gear engaging with the worm; the motor is disposed in the upper side of the locking plate; and the shaft of the motor may be disposed along the left-to-right direction.

A driving unit for rotating the latch is further included; the driving unit includes a motor and a main gear rotated by the motor; the motor and the main gear are connected through a spur gear; the main gear is rotated centered around the shaft disposed along the front and rear side direction; and the shaft of the motor may be disposed along the front and rear side direction.

A driving unit for rotating the latch is further included; the driving unit includes a motor and a main gear rotated by the motor; and the motor and the main gear may be connected through a first worm, a first worm gear gearing with the first worm, a second worm installed in the first worm gear, and a second worm gear gearing with the second worm.

The main gear is rotated around the center of the shaft disposed along the front and rear side direction, and the shaft of the motor may be disposed along the left-to-right direction.

The main gear is rotated around the center of the shaft disposed along the front and rear side direction, and the shaft of the motor may also be disposed along the front and rear side direction.

A driving unit for rotating the latch or sliding the locking plate is further included; the locking driving unit includes a motor and a main gear rotated by the motor; and the motor and the main gear may be connected through a worm, a worm gear gearing with the worm, and a middle spur gear installed in the worm gear.

A driving unit for rotating the latch and a child locking member movably installed in the housing are further included, and the driving unit may move the child locking member.

The driving unit includes a main gear, wherein a stopping portion for rotating the latch is formed in the main gear, and a first stopping portion and a second stopping portion for sliding the child locking member may be formed in the main gear.

A protrusion guide portion is formed in the child locking member, and a child lock protrusion is formed in the stopping lever unit, so that the rotation of the stopping lever unit can be accomplished as the protrusion guide portion guides the child lock protrusion.

A child locking member which is movably installed in the housing, and a child locking driving unit for moving the child locking member are further included, wherein a protrusion guide portion is formed in the child locking member, and a child lock protrusion is formed in the stopping lever unit, so that the rotation of the stopping lever unit can be accomplished as the protrusion guide portion guides the child lock protrusion.

A child locking member movably installed in the housing, and a child locking driving unit for moving the child locking member are further included, wherein the child locking member and the child locking driving unit may be connected through a child rack and a child pinion.

A child locking member movably installed in the housing, and a child locking driving unit for moving the child locking member are further included, wherein the child locking member and the child locking driving unit may be connected through a child worm and a child worm gear.

A lock-releasing cable is installed in the locking plate; a direction switch unit is installed between the lock-releasing cable and a knob; the direction switch unit includes a direction switch housing and a switching lever which is rotatably installed in the direction switch housing; the knob is rotatably connected to the one side of the switching lever; the lock-releasing cable is rotatably connected to the other side of the switching lever; and the rotating shaft of the switching lever may be disposed between the one side and the other side of the switching lever.

A first guide slot for guiding the knob and a second guiding slot for guiding the lock-releasing cable are formed in the direction switch housing; and a slotted hole, wherein the switching lever is movable so as to communicate with the first and the second guide slots, may be formed in the direction switch housing.

Advantageous Effects of Invention

As described above, according to a door latch system of the present invention, there are advantageous effects as follows.

By including a stopping lever unit rotatably installed in any one of the main locking member and the sub-locking member; a stopping threshold formed in the other one of the main locking member and the sub-locking member wherein a stopping protrusion is being caught; and a locking plate slidingly installed in a housing for rotating the stopping lever unit, wherein a lever guide portion is formed in the locking plate, and a guide bar is formed in the stopping lever unit, so that the rotation of the stopping lever unit is accomplished as the guide bar is guided by the lever guide portion. And when the stopping lever unit is caught by the stopping threshold due to the sliding of the locking plate, the main locking member and the sub-locking member are sliding together, and when the stopping lever unit is separated from the stopping threshold due to the sliding of the locking plate, only the sub-locking member is slided, so that the structure for connecting the main locking member and the sub-locking member becomes simple, and the durability of the device is enhanced as well.

The stopping lever shaft of the stopping lever unit is formed along the up-down direction, and the lever guide portion is protrudedly formed towards the stopping lever unit; and in the lever guide portion, an inclined surface is formed on the surface being contacted with the guide bar, so that the structure becomes simple, and the durability is enhanced as well.

A driving unit for rotating the latch is further included; a stopping portion for rotating the latch is formed in the driving unit; the stopping portion is installed in the driving unit slidably along the front and rear side direction; in the main locking member, a stopping portion pressing arm for pressing the stopping portion; in the driving unit, a stopping portion return spring which returns the stopping portion to the original position is further provided; the stopping portion is protrudedly formed towards the outside further from the latch, so that the door can be manually opened by pulling the door lever even if the driving unit fails during closing the door using the driving unit or after the door has been closed.

Besides, in the stopping portion pressing arm, a stopping portion reinforcing member made of a metallic material is inserted, thereby increasing the strength of the stopping portion reinforcing member.

A manual locking member is rotatably installed in the housing; a first stopping portion which is caught by the sub-locking member, and a second stopping portion which is caught by the locking plate are formed in the manual locking member; and the first stopping portion and the second stopping portion are disposed spaced apart along the circumferential direction; and thus the structure becomes simple, and the locking of the door is released when a user inside the vehicle pulls the door in lever once, and the door is opened when the door in lever is being pulled one more time.

A rotating member being rotated by the latch and sliding the main locking member is further included; at least a portion of the rotating member is disposed in front of the main locking member; the sub-locking member is disposed in rear side of the main locking member; and thus the strength of the door latch system can be enhanced, and the left-to-right width of the door latch system can be further reduced as well, therefore it can be applied to doors of various designs.

A sub-locking member insertion slot wherein the sub-locking member is inserted is formed in rear side of the main locking member, so that the sub-locking member can be guided thereby when moving along the left-to-right direction, and the left-to-right width and the front-to-rear width can be further reduced, and the strength of the main locking member can be maintained as well.

A locking driving unit for sliding the locking plate is further included; and the locking driving unit and the locking plate are connected through rack and pinion or worm and worm gear (rack) having the shape of a straight line; and thus the safety is enhanced since the locking plate can be moved using lock-releasing cable and the like even when the locking driving unit fails. Meanwhile, when the shaft of the motor is disposed with right angle to the shaft of the main gear and being connected through a worm gear, the reverse rotation of the worm gear becomes difficult with an external force when the motor fails.

The motor is disposed in the lower side of the locking plate, and the shaft of the motor is disposed along the front and rear side direction, and thus the interference between the door and other members can be minimized.

The motor is disposed in the upper side of the locking plate, and the shaft of the motor may be disposed along the up-down direction, and thus the front-to-rear width of the door latch system can be minimized.

The locking driving unit includes a motor and a main gear being rotated by the motor; the motor and the main gear are connected through the worm and the worm gear engaging with the worm; the motor is disposed in the upper side of the locking plate; and the shaft of the motor may be disposed along the left-to-right direction, and thus the door latch system can be maintained in a compact form, and the structure thereof can be simplified as well.

A driving unit for rotating the latch is further included; the driving unit includes a motor; the latch is rotated by the motor; the motor and the main gear is connected through a plurality of spur gears; and thus the safety is enhanced since the latch can be rotated towards the door open direction by the striker when a user opens the door while the door lever is being pulled even if the driving unit fails.

The main gear is rotated around the center of the shaft disposed along the front and rear direction, and the shaft of the motor is disposed along the front and rear direction, and thus the structure can be simplified, and the spur gear can be rotated smoothly in the reverse direction when the motor fails.

A driving unit for rotating the latch is further included; the driving unit includes a motor and a main gear rotated by the motor; and the motor and the main gear are connected through a first worm, a first worm gear gearing with the first worm, a second worm gearing installed in the first worm gear, and a second worm gear gearing with the second worm, and thus the speed of the motor is greatly reduced so that the closing operation of the door through the motor is smoothly performed and the driving torque is secured as well. In addition, since the speed is reduced when closing the door, the door can be manually opened when a body or clothes are squeezed by the door.

The main gear is rotated around the center of the shaft disposed along the front and rear direction, and the shaft of the motor is disposed along the left-to-right direction; or, the main gear is rotated around the center of the shaft disposed along the front and rear direction, and the shaft of the motor is also disposed along the front and rear direction, and thus the structure of the device becomes simplified.

A driving unit for rotating the latch and a child locking member movably installed in the housing are further included; the driving unit moves the child locking member; and thus the child locking member can be moved through such as a button connected to the driving unit, and the device can be maintained in a simple form as well.

A lock-releasing cable is installed in the locking plate; a direction switch unit is installed between the lock-releasing cable and a knob; and when the door latch system is installed in the door, the PCB and the motor can be disposed in the upper side, so that the wetting of the PCB and the motor can be avoided even if water is flowed in through the striker insertion slot.

A direction switch unit includes a direction switch housing, and a switching lever which is rotatably installed in the direction switch housing; the knob is rotatably connected to the one side of the switching lever; the lock-releasing cable is rotatably connected to the other side of the switching lever; and the rotating shaft of the switching lever is disposed between the one side and the other side of the switching lever, and thus the configuration of the direction switch unit can be simplified, and the direction switch unit can be maintained in a compact form so that it can be easily installed in the door.

A first guide slot for guiding the knob and a second guiding slot for guiding the lock-releasing cable are formed in the direction switch housing, and a slotted hole wherein the switching lever can be moved so as to communicate with the first and the second guide slots is formed in the direction switch housing, and thus the pressing direction of the knob is smoothly switched, and the direction switch unit can be maintained in a more compact form.

BRIEF DESCRIPTION OF DRAWINGS

FIG. 1 is a perspective view of a door latch system according to the first exemplary embodiment of the present invention.

FIG. 2 is an exploded perspective view of a door latch system according to the first exemplary embodiment of the present invention.

FIG. 3 is a front view illustrating the state wherein the second housing is removed from the door latch system according to the first exemplary embodiment of the present invention.

FIG. 4 is a rear view illustrating the state wherein the third housing is removed from the door latch system according to the first exemplary embodiment of the present invention.

FIG. 5 is a rear view illustrating the state wherein the third housing is removed from the door latch system according to the first exemplary embodiment of the present invention (metal portion of the main gear is removed).

FIG. 6 is a front perspective view (shown above) and a rear perspective view (shown below) of the first housing of the door latch system according to the first exemplary embodiment of the present invention.

FIG. 7 is a front perspective view (shown above) and a rear perspective view (shown below) of the third housing of the door latch system according to the first exemplary embodiment of the present invention.

FIG. 8 is a front perspective view (shown above) and a rear perspective view (shown below) of the second housing of the door latch system according to the first exemplary embodiment of the present invention.

FIG. 9 is a perspective view of the latch of the door latch system according to the first exemplary embodiment of the present invention.

FIG. 10 is a front perspective view (shown above) and a rear perspective view (shown below) of the main locking member of the door latch system according to the first exemplary embodiment of the present invention.

FIG. 11 is a perspective view of the stopping lever unit of the door latch system according to the first exemplary embodiment of the present invention.

FIG. 12 is a front perspective view (shown above) and a rear perspective view (shown below) of the sub-locking member of the door latch system according to the first exemplary embodiment of the present invention.

FIG. 13 is a front perspective view (shown above) and a rear perspective view (shown below) of the locking plate of the door latch system according to the first exemplary embodiment of the present invention.

FIG. 14 is a front perspective view (shown above) and a rear perspective view (shown below) of the driving unit of the door latch system according to the first exemplary embodiment of the present invention.

FIG. 15 is a rear perspective view of the main gear of the door latch system according to the first exemplary embodiment of the present invention.

FIG. 16 is an exploded perspective view of the main gear of the door latch system according to the first exemplary embodiment of the present invention.

FIG. 17 is a front perspective view (shown above) and a rear perspective view (shown below) of the child locking member of the door latch system according to the first exemplary embodiment of the present invention.

FIG. 18 is a front view illustrating the state wherein the second housing, the main locking member, and the child locking member are removed from the door latch system according to the first exemplary embodiment of the present invention.

FIG. 19 is a front view (housing is not shown) illustrating the first step of the door closing operation of the door latch system according to the first exemplary embodiment of the present invention.

FIG. 20 is a front view (housing is not shown) illustrating the second step of the door closing operation of the door latch system according to the first exemplary embodiment of the present invention.

FIG. 21 is a front view (housing is not shown) illustrating the third step of the door closing operation of the door latch system according to the first exemplary embodiment of the present invention.

FIG. 22 is a front view (housing is not shown) illustrating the fourth step of the door closing operation of the door latch system according to the first exemplary embodiment of the present invention.

FIG. 23 is a front view (shown above) and a cross-sectional view along the line A-A (shown below) (housing and latch are not shown) illustrating the first step of the door locking operation of the door latch system according to the first exemplary embodiment of the present invention.

FIG. 24 is a partial perspective view (main locking member is not shown) illustrating the state wherein the stopping lever unit is caught by the sub-locking member during the door locking operation of the door latch system according to the first exemplary embodiment of the present invention.

FIG. 25 is a front view (shown above) and a cross-sectional view along the line A-A (shown below) (housing and latch are not shown) illustrating the second step of the door locking operation of the door latch system according to the first exemplary embodiment of the present invention.

FIG. 26 is a partial perspective view illustrating the state wherein the stopping lever unit has been moved towards the rear side direction by the lever guide portion during the door locking operation of the door latch system according to the first exemplary embodiment of the present invention.

FIG. 27 is a front view (shown above) and a cross-sectional view along the line A-A (shown below) (housing and latch are not shown) illustrating the third step of the door locking operation of the door latch system according to the first exemplary embodiment of the present invention.

FIG. 28 is a front view (shown above) and a cross-sectional view along the line A-A (shown below) (housing and latch are not shown) illustrating the door lock-releasing operation of the door latch system according to the first exemplary embodiment of the present invention.

FIG. 29 is a partial cross-sectional view illustrating the first step of the door lock-releasing operation using the door in lever of the door latch system according to the first exemplary embodiment of the present invention.

FIG. 30 is a partial cross-sectional view illustrating the second step of the door lock-releasing operation using the door in lever of the door latch system according to the first exemplary embodiment of the present invention.

FIG. 31 is a partial cross-sectional view illustrating the third step of the door lock-releasing operation using the door in lever of the door latch system according to the first exemplary embodiment of the present invention.

FIG. 32 is a front view and a partial plan view illustrating the first step of the internal door locking operation using the child locking member of the door latch system according to the first exemplary embodiment of the present invention.

FIG. 33 is a front view and a partial plan view illustrating the second step of the internal door locking operation using the child locking member of the door latch system according to the first exemplary embodiment of the present invention.

FIG. 34 is a partial front view (shown above) and a partial rear view (shown below) illustrating the first step of door opening operation when the motor of the door latch system according to the first exemplary embodiment of the present invention fails.

FIG. 35 is a partial front view (shown above) and a partial rear view (shown below) illustrating the second step of door opening operation when the motor of the door latch system according to the first exemplary embodiment of the present invention fails.

FIG. 36 is a partial front view (shown above) and a partial rear view (shown below) illustrating the third step of door opening operation when the motor of the door latch system according to the first exemplary embodiment of the present invention fails.

FIG. 37 is a view illustrating the door latch system according to the first exemplary embodiment of the present invention mounted in a vehicle door.

FIG. 38 is a plan view of the door latch system according to the first exemplary embodiment of the present invention (being mounted in a vehicle).

FIG. 39 is a perspective view of the door latch system according to the first exemplary embodiment of the present invention when viewing from the rear.

FIG. 40 is a rear view illustrating the state wherein the third housing is removed from the door latch system according to the second exemplary embodiment of the present invention (door lock is engaged).

FIG. 41 is a rear view illustrating the state wherein the third housing is removed from the door latch system according to the second exemplary embodiment of the present invention (door lock is released).

FIG. 42 is a front view illustrating the state wherein the second housing is removed from the door latch system according to the third exemplary embodiment of the present invention.

FIG. 43 is a rear view illustrating the state wherein the third housing is removed from the door latch system according to the third exemplary embodiment of the present invention.

FIG. 44 is a rear view illustrating the state wherein the third housing is removed from the door latch system according to the fourth exemplary embodiment of the present invention.

FIG. 45 is a rear perspective view illustrating the state wherein the third housing is removed from the door latch system according to the fourth exemplary embodiment of the present invention (metal portion of the main gear is removed).

FIG. 46 is a rear perspective view illustrating the state wherein the third housing is removed and the main gear and the child locking members are separated from the door latch system according to the fourth exemplary embodiment of the present invention.

FIG. 47 is a perspective view of the child locking member of the door latch system according to the fourth exemplary embodiment of the present invention.

FIG. 48 is a partial rear view illustrating the child locking state of the door latch system according to the fourth exemplary embodiment of the present invention.

FIG. 49 is a partial plan view illustrating the child locking state of the door latch system according to the fourth exemplary embodiment of the present invention.

FIG. 50 is a partial rear view illustrating the released state of child locking of the door latch system according to the fourth exemplary embodiment of the present invention.

FIG. 51 is a partial plan view illustrating the released state of child locking of the door latch system according to the fourth exemplary embodiment of the present invention.

FIG. 52 is a front view illustrating the state wherein the second housing is removed from the door latch system according to the fifth exemplary embodiment of the present invention.

FIG. 53 is a rear view illustrating the state wherein the third housing is removed from the door latch system according to the fifth exemplary embodiment of the present invention (motor is not shown).

FIG. 54 is a partial front view illustrating the process of door opening when the motor fails in the door latch system according to the fifth exemplary embodiment of the present invention.

FIG. 55 is a front view illustrating the state wherein the second housing is removed from the door latch system according to the sixth exemplary embodiment of the present invention.

FIG. 56 is a rear view illustrating the state wherein the third housing is removed from the door latch system according to the sixth exemplary embodiment of the present invention.

FIG. 57 is a rear perspective view illustrating the state wherein the third housing is removed from the door latch system according to the sixth exemplary embodiment of the present invention (locking plate and main gear are separated).

FIG. 58 is a front perspective view of the locking plate and the main gear of the door latch system according to the sixth exemplary embodiment of the present invention.

FIG. 59 is a rear view illustrating the state wherein the door lock is engaged (shown above), the door lock is released (shown in middle), and the main gear is returning after the door lock is released (shown below); and the schematic diagrams of the first, the second, and the third wires of the door latch system according to the sixth exemplary embodiment of the present invention.

FIG. 60 is a partial cross-sectional view of the door latch system according to the seventh exemplary embodiment of the present invention.

FIG. 61 is a rear view illustrating the state wherein the third housing is removed from the door latch system according to the eighth exemplary embodiment of the present invention.

FIG. 62 is a rear perspective view illustrating the state wherein the third housing is removed from the door latch system according to the ninth exemplary embodiment of the present invention.

FIG. 63 is a rear view illustrating the state wherein the third housing is removed from the door latch system according to the tenth exemplary embodiment of the present invention.

FIG. 64 is a rear perspective view of the child locking member of the door latch system according to the tenth exemplary embodiment of the present invention.

FIG. 65 is a partial horizontal cross-sectional view of the door latch system according to the tenth exemplary embodiment of the present invention (when viewing from the top).

FIG. 66 is a partial horizontal cross-sectional view of the door latch system according to the tenth exemplary embodiment of the present invention (when viewing from the bottom).

FIG. 67 is a partial plan view illustrating the engaged state of child locking of the door latch system according to the tenth exemplary embodiment of the present invention.

FIG. 68 is a partial plan view illustrating the released state of child locking of the door latch system according to the tenth exemplary embodiment of the present invention.

FIG. 69 is a rear view illustrating the state wherein the third housing is removed from the door latch system according to the eleventh exemplary embodiment of the present invention.

FIG. 70 is an exploded rear perspective view of the direction switch unit of the door latch system according to the tenth exemplary embodiment of the present invention.

FIG. 71 is a view illustrating the door latch system according to the eleventh exemplary embodiment of the present invention installed in a vehicle door.

FIG. 72 is a rear view illustrating the state wherein the third housing is removed from the door latch system according to the twelfth exemplary embodiment of the present invention.

FIG. 73 is a view illustrating the door latch system according to the twelfth exemplary embodiment of the present invention installed in a vehicle door.

MODE FOR THE INVENTION

Hereinafter, a door latch system according to the first exemplary embodiment of the present invention will be described in detail with reference to the accompanying drawings as follows.

For reference, components of the present invention which are the same as those of the prior art as described above will not be described separately while referring to the prior art described above.

Embodiment 1

As illustrated in FIGS. 1 to 39, the door latch system 5 according to the first exemplary embodiment of the present invention characterized in that and includes: a housing 1100; a latch 2200 rotatably installed in the housing 1100; a main locking member 1300 slidingly installed in the housing 1100 for locking the latch 1200; a sub-locking member 1400 slidingly installed in the housing 1100 and disposed in one side of the main locking member 1300; a stopping lever unit 1450 rotatably installed in any one of the main locking member 1300 and the sub-locking member 1400; a stopping threshold 1405 formed in the other one of the main locking member 1300 and the sub-locking member 1400 wherein a stopping protrusion 1455 is being stopped; and a locking plate 1500 slidingly installed in a housing 1100 for rotating the stopping lever unit 1450, wherein a lever guide portion 1507 is formed in the locking plate 1500, and a guide bar 1457 is formed in the stopping lever unit 1450, so that the rotation of the stopping lever unit 1450 is accomplished as the guide bar 1457 is guided by the lever guide portion 1507, and when the stopping lever unit 1450 is caught by the stopping threshold 1405 due to the sliding of the locking plate 1500, the main locking member 1300 and the sub-locking member 1400 are sliding together, and when the stopping lever unit 1450 is separated from the stopping threshold 1405 due to the sliding of the locking plate 1500, only the sub-locking member 1400 is slided.

As illustrated in FIG. 1, in the housing 1100, the front means the direction towards the second housing 1130, and the rear side means direction towards the third housing 1150. In addition, the left side and the right side described hereinafter mean the left side and the right side viewing from the front. The left side and the right side, used when describing the members formed in the rear side surface, also mean the left side and the right side viewing from the front of the members.

As illustrated in FIG. 2, the housing 1100 includes: a first housing 1110, a second housing 1130 disposed in front of the first housing 1110, and the third housing 1150 disposed in the rear side of the first housing 1110.

As illustrated in FIG. 6, a striker insertion slot 1105 is formed in the upper and the front of the housing 1100 for inserting the striker 1101 connected to the vehicle body.

Therefore, the striker insertion slot 1105 is formed in the first housing 1110 and the second housing 1130.

As illustrated in FIG. 6, the first housing 1110 is formed in the shape of a block, wherein a latch receiving slot 1111 for receiving the latch 1200, which will be described hereinafter, and a locking member receiving slot 1112 for receiving the main locking member 1300 and the sub-locking member 1400, which will be described later, are formed in the front.

The first housing 1110 is made of plastic material and can be formed by injection molding. The second housing 1130 may be made of a high strength material such as a steel plate.

The front and the upper portion of the latch receiving slot 1111 are formed to be open and communicate with the striker insertion slot 1105.

Further, a spring insertion slot 1113 is formed in the front of the first housing 1110.

The spring insertion slot 1113 is disposed in the rear side of the latch receiving slot 1111 and communicates with the latch receiving slot 1111. The first return spring 1250, which will be described later, is inserted in the spring insertion slot 1113, and thus the other end of the first return spring 1250 can be rotated with the latch 1200.

A sixth sensor insertion hole 1129 is formed in the first housing 1110 penetrating through the front and rear side direction wherein the sixth sensor 1910, which will be described later, is inserted so as to communicate with the latch receiving slot 1111. The sixth sensor insertion hole 1129 is disposed in the lower portion of the striker insertion slot 1105.

A stopping threshold guiding slot 1115 is formed in the left side of the first housing 1110 penetrating through the front and rear side direction so as to communicate with the spring insertion slot 1113 and the latch receiving slot 1111.

The stopping threshold guiding slot 1115 is formed in the shape of an arc.

The locking member receiving slot 1112 is formed along the left-to-right direction so as to communicate with the latch receiving slot 1111.

The locking member receiving slot 1112 is formed deeper towards the rear side direction than the latch receiving slot 1111.

The locking member reception slot 4112 is formed along the left-to-right direction so that the main locking member 4300 and the sub-locking member 1400 can be slided along the left and right direction.

In the first housing 1110, the rear side of the locking member receiving slot 1112 for receiving the sub-locking member 1400 is formed to be open so that the lever guide portion 1507, which will be described later, is inserted therein.

A load guide slot 1116 is formed along the left-to-right direction in front of the first housing 1110 so as to communicate with the locking member receiving slot 1112.

The load guide slot 1116 is disposed in the lower portion of the latch receiving slot 1111.

A first sensing member insertion slot 1128 is formed along the left-to-right direction in front of the first housing 1110 so as to communicate with the locking member receiving slot 1112 and the load guide slot 1116.

The first sensing member insertion slot 1128 is disposed in the lower left portion of the locking member receiving slot 1112.

The first sensing member insertion slot 1128 formed such that the lower and the rear sides thereof are open.

A first spring receiving slot 1117 and a second spring receiving slot 1119 are formed in the front right side of the first housing 1110. The first spring receiving slot 1117 and the second spring receiving slot 1119 are disposed in the right side of the locking member receiving slot 1112, and communicate with the locking member receiving slot 1112. The withdrawing holes, through which the wires connected with the door in lever and the door out lever are being withdrawn, are communicating with the right side of the first spring receiving slot 1117 and the second spring receiving slot 1119.

As illustrated in FIG. 24, a manual locking member insertion hole 1118 wherein the manual locking member 1560 is inserted is penetratingly formed along the front and rear direction between the first spring receiving slot 1117 and the second spring receiving slot 1119. The manual locking member insertion hole 1118 is communicating with the locking member receiving slot 1112.

A child locking member receiving slot 1122, wherein the child locking member 1700, which will be described later, is received, is formed in the front side of the first housing 1110 so as to communicate with the locking member receiving slot 1112.

The child locking member receiving slot 1122 is disposed in the upper portion of the locking member receiving slot 1112. The child locking member receiving slot 1122 is communicating with the locking member receiving slot 1112.

The bumper member insertion slots 1123, wherein the bumper members 1360 are inserted respectively, are formed in the lower and the upper portions of the first housing 1110 so as to communicate with the latch receiving slot 1111.

The height of the bumper member insertion slot 1123 disposed in the lower portion is formed to be lower than that of the bumper member 1360.

The upper side and the front side of the bumper member insertion slot 1123 disposed in the upper portion are open, and the right side portion is communicating with the latch receiving slot 1111.

The diameter of the rear side of the bumper member insertion slot 1123 disposed in the lower portion is formed to be larger than that of the front side thereof. The bumper member 1360 disposed in the upper side is formed to have a shape corresponding to the shape of the bumper member insertion slot 1123 disposed in the upper portion. Thus, when the bumper member 1360 is inserted from the above into the bumper member insertion slot disposed in the upper side, it will not be separated along the front and rear direction after the insertion thereof. In addition, after the completion of the assembly, the top of the bumper member insertion slot 1123 disposed in the upper side is closed by the second housing 1130 which will be described later. In this way, the assembling becomes easy since the bumper member insertion slot 1123 disposed in the upper portion is formed.

The bumper member 1360 disposed in the lower portion supports the latch 1200 so as to prevent the occurrence of any gap when the latch 1200 is in a locking state by the main locking member 1300, and the bumper member 1360 disposed in the upper portion supports the latch 1200 so that the latch 1200 is being rotated within a predetermined angle when the latch 1200 is rotating counterclockwise due to the restoring force of the first return spring 1250 after the locking with the main locking member 1300 is released, and thus they prevent gap, noise and vibration from occurring.

In the front surface of the first housing 1110, a plurality of supporting protrusions 1103 which supports the horizontal portion or the vertical portion of the lower portion of the second housing 1130 is formed in length. Due to these supporting protrusions 1103, the pre-assembly of the first housing 1110 and the second housing 1130 is facilitated. Therefore, the assembling process becomes easy.

A concave portion 1124 is formed in the upper side surface of the first housing 1110.

A manual locking member receiving slot 1125 is formed in the lower right side of the back side surface of the first housing 1110. The manual locking member receiving slot 1125 is communicating with the manual locking member insertion hole 1118.

A manual locking member shaft 1561, which will be described later, is inserted into the manual locking member receiving slot 1125.

A locking hook stopping portion 1126 for coupling with the third housing 1150 is formed in rear side of the upper surface and the side surface of the first housing 1110.

A first key connect mounting portion 1127 is formed in the lower center portion of the first housing 1110 in a way that the upper side, the lower side, and the rear side thereof are open.

In the lower left side of the back surface of the first housing, a main gear shaft 1114 being inserted into the insertion hole 1636 of the main gear 1630, which will be described later, is protrudedly formed towards the rear side direction.

In the lower side of the rear side surface of the first housing 1110, a locking plate receiving slot, for receiving the locking plate 1500, which will be described later, is formed in length along the left-to-right direction. The locking plate receiving slot is formed so as to communicate with the stopping portion guide slot 1115. In the rear side surface of the first housing 1110, a sub-gear receiving slot, for receiving the sub-gear 1620, which will be described later, is formed. In the rear side surface of the first housing 1110, a first motor receiving slot for receiving the front side of the motor 1610 is formed in the right side of the sub-gear receiving slot. The first motor receiving slot is formed so as to communicate with the sub-gear receiving slot. In the rear side surface of the first housing 1110, a first PCB insertion slot, wherein the front side of the PCB 1900 which will be described later is inserted, is formed in the lower portion of the locking plate receiving slot. The first PCB insertion slot is formed so as to communicate with the first sensing member insertion slot 1128.

Meanwhile, a fifth sensor receiving slot 1106, wherein the fifth sensor 1911 is being received, is formed in the rear side surface of the first housing 1110. Thus, damages in the fifth sensor 1911 can be prevented during assembly.

The fifth sensor receiving slot 1106 is disposed in the outer side of the stopping portion guide slot 1115.

Further, in the first housing 1110, wires for connecting the PCB 1900 and the sensors (fifth sensor 1911 and sixth sensor 1910) or the driving unit (motor 1610), are insertingly installed. In this way, the lengths of the wires can be reduced.

The wires are installed in a way that the portions being connected to the driving unit and the PCB 1900 are formed protruded outside of the first housing 1110. Thus, the sensors, the driving unit, or the PCB 1900 can be connected to the wires only if the sensor or the driving unit is inserted into the corresponding receiving slot formed in the first housing 1110. Thus, assembling becomes more simplified.

As illustrated in FIG. 8, the second housing 1130 comprises a vertical member 1131 having the shape of a vertical plate, and a horizontal member 1132 which is backwardly bended from the upper end of the vertical member 1131.

As illustrated in FIG. 1, a shaft insertion hole wherein the latch rotating shaft 1230 provided in the form of rivet is inserted is penetratingly formed in the vertical member 1131 along the front and rear direction.

In the vertical member 1131, a first protruded portion 1135 and the second protruded portion 1136, being recessed (from the front side) towards the rear side direction, are formed in the peripheral area of the shaft insertion hole. The first protruded portion 1135 and the second protruded portion 1136 are more backwardly protruded than the other portions of the rear side surface of the vertical member 1131.

The first protruded portion 1135 is in contact with the front surface of the latch 1200 and the rotating member 1370. Thus, the latch 1200 and the rotating member 1370 are not floating along the front and rear direction and at the same time the friction between the latch 1200 and the rotating member 1370 and the second housing 1130 when assembling thereof. That is, since a backwardly protruded portion is formed in the rear side surface of the second housing 1130, the friction with the rotating member with respect to the second housing 1130 can be minimized. The first protruded portion 1135 is formed to have a inverted "Y" shape. The first protruded portion 1135 is curvedly formed along the direction of rotation of the latch 1200 and the rotating member 1370.

The second protruded portion 1136 is formed in the shape of an arc in the peripheral area of the shaft insertion hole, and contacted to the front surface of the latch 1200.

In addition, a forwardly protruded portion is formed in the front surface of the third housing 1150, the friction with the rotating member (main gear) with respect to the third housing 1150 can be minimized.

In addition, in the vertical member 1131, an operation protrusion slotted hole 1134 for inserting the child locking operation protrusion 1710, which will be described later, is formed penetrating through the front and rear direction. The operation protrusion slotted hole 1134 is formed in length along the left-to-right direction, so that the length thereof is longer than the width of the child locking operation protrusion 1710 along the left-to-right direction.

A plurality of mounting holes are formed in the first housing 1110 and the second housing 1130 for bolt tightening with the door 1. The mounting holes are disposed in the upper and the lower portions of the left side of the first housing 1110 and the second housing 1130, and in the right side of the striker insertion slot 1105 respectively. The door latch system 5 of the exemplary embodiment of the present invention can be easily and durably installed in the door 1 due to such mounting holes.

Further, as illustrated in FIG. 1, in the second housing 1130, a first return spring holding shaft 1251, which are provided in the form of a rivet, rotating shaft 1380, and a rivet insertion hole wherein a rotating spring stopping shaft 1391 are penetratingly formed along the front and rear direction. One end of the first return spring 1250 is held in the first return spring holding shaft 1251.

In the right side of the second housing 1130, a vertical member 1138, which surrounds and supports the right side of the first housing 1110 from where the door lever connecting unit 1800 is being pulled out (drawn), is protrudedly formed towards the rear side direction. Due to such vertical member 1138, the strength of the portion supporting the door lever connecting unit 1800 is reinforced. In the vertical member 1138, the withdrawing holes from which the door lever connecting unit 1800 is withdrawn are formed respectively. Due to such vertical member 1138, the first housing 1110 is prevented from the damage when an impact is applied thereto.

As illustrated in FIG. 1, the vertical member 1131 is installed in the front surface of the first housing 1110 using a plurality of bolts 1133 and the like, and the horizontal member 1132 is disposed in the concave portion 1124 formed in the upper surface of the first housing 1110. The plurality of bolts 1133 are disposed in both sides of the striker insertion slot 1105 and in both sides of the lower portion of the second housing 1130 and the first housing 1110 respectively.

The striker insertion slot 1105 is formed across the vertical member 1131 and the horizontal member 1132.

As illustrated in FIG. 7, the third housing 1150 has a box-like shape formed with a space therein. The third housing 1150 is formed to have an open front.

Inside the third housing 1150, a second PCB insertion slot 1154 wherein the rear side of the PCB 1900 is inserted is formed. A second motor receiving slot 1151 for receiving the rear side of the motor 1610 is formed inside the third housing 1150.

The locking hooks 1153 are formed in the upper portion and both sides of the third housing 1150.

Each of the locking hooks 1153 is coupled to the corresponding locking hook stopping portion 1126 formed in the first housing 1110 respectively. Thus, the first housing 1110 and the third housing 1150 are coupled thereby. Additionally, the first housing 1110 and the third housing 1150 are coupled using bolts and the like.

A second key connect mount 1152 is formed in the lower portion of the third housing 1150.

A key connect 1550, which will be described later, is installed in the first key connect mount 1127 and the second key connect mount 1152 of the first housing 1110.

A recessed portion 1155 recessed along the left-to-right direction is formed at the left side of the rear side surface of the third housing 1150.

The PCB 1900 is inserted between the first PCB insertion slot and the second PCB insertion slot 1154, and installed in the housing 1100. The PCB 1900 is horizontally disposed in the lower portion inside the housing 1100.

A first sensor 1901, a second sensor 1903, a third sensor 1905, and a fourth sensor 1907 are installed in the PCB 1900. The first sensor 1901, the second sensor 1903, the third sensor 1905, and the fourth sensor 1907 are provided with sensors capable of detecting magnets.

The first sensor 1901 and the second sensor 1903 are disposed on a same line along the left-to-right direction, and the third sensor 1905 and the fourth sensor 1907 are disposed on a same line along the left-to-right direction. When viewing from the front side, the first sensor 1901 is disposed in the left side of the second sensor 1903. When viewing from the front side, the third sensor 1905 is disposed in the left side of the fourth sensor 1907.

The first sensor 1901 and the second sensor 1903 are associated with the opening and the closing operations of the door 1 by detecting the movement of the first sensing unit 1351 formed in the main locking member 1300.

The third sensor 1905 and the fourth sensor 1907 are associated with the locking and the lock-releasing operations of the door 1 by detecting the movement of the second sensing unit 1521 formed in the locking plate 1500.

In addition, a fifth sensor 1911 and the sixth sensor 1910 are connected to the PCB 1900. Limit switches may be provided as the fifth sensor 1911 and the sixth sensor 1910.

The fifth sensor 1911 is disposed between the first housing 1110 and the third housing 1150. More specifically, the fifth sensor 1911 is disposed close to the stopping portion guiding slot 1115.

The fifth sensor 1911 checks whether the main gear 1630 has returned to the original position (basic position) thereof.

The sixth sensor 1910 detects whether the latch 1200 is being rotated while being pressed by the striker 1101.

As illustrated in FIG. 9, the latch 1200 is installed in the first housing 1110 so as to be disposed inside the latch receiving slot 1111.

The latch 1200 is rotatably installed in the first housing 1110 through the latch rotating shaft 1230 which is installed in the second housing 1130.

The latch 1200 is formed in the shape of a plate.

A locking slot 1201 is formed in the outer circumferential surface of the latch 1200.

The width of the locking slot 1201 is getting wider as travelling from the inside towards the outside thereof.

The locking slot 1201 is surrounded by a first surface 1203 which is formed to be flat, a second surface 1205 formed to have a slope and extended from the left end of the first surface 1203, a third surface 1207 being extended from the left end of the second surface 1205, forming an arc, and surrounding the striker 1101, a fourth surface 1209 being extended from the upper right end of the third surface 1207, and a fifth surface 1211 formed to have a slope and extended from the right end of the fourth surface 1209.

The locking slot 1201 is formed to be penetrating along the front and rear direction, and the outer end portion thereof is open.

In the latch 1200, an auxiliary locking slot 1202 is formed in the lower portion of the locking slot 1201. The auxiliary locking slot 1202 is formed in the shape similar to the locking slot 1201, but the depth thereof is shallower than the locking slot 1201.

A spring insertion slot 1213 is formed in the outer circumferential surface of the latch 1200.

The spring insertion slot 1213 is formed to have the shape of a slot or a hole.

A protrusion 1215 is formed outwardly protruded in the left side of outer circumferential surface of the latch 1200.

The protrusion 1215 is disposed in front of the stopping portion guide slot 1115.

The locking slot 1201, the auxiliary locking slot 1202, the spring insertion slot 1213, and the protrusion 1215 are sequentially disposed along the rotating (clockwise) direction of the latch 1200 when closing door.

A first return spring 1250 is provided so that the latch 1200 can be returned automatically when the locking is released.

One end of the first return spring 1250 is held by the first return spring stopping shaft 1251 of the second housing 1130, and middle portion is wound around the latch rotating shaft 1230, and the other end thereof is inserted into the spring insertion slot 1113.

Thus, the other end of the first return spring 1250 can be rotated with the latch 1200 when the latch 1200 is being rotated.

As illustrated in FIG. 10, the main locking member 1300 is slidingly installed inside the locking member receiving slot 1112 formed in the first housing 1110.

The main locking member 1300 comprises a body 1310, a horizontal bar 1340, a stopping portion pressing arm 1330, and a first sensing member 1350. The main locking member 1300 is integrally formed of the body 1310, the horizontal bar 1340, the stopping portion pressing arm 1330, and the first sensing member 1350.

Further, the main locking member 1300 further includes a rotating member 1370 being rotated by the latch 1200, thereby sliding the main locking member 1300.

The body 1310 comprises a first portion 1311, and a second portion 1313 formed to have a step in the first portion 1311 in a way that the front surface thereof is disposed in front of the front surface of the first portion 1311.

The first portion 1311 constitutes the upper left portion of the body 1310, and the second portion 1313 constitutes the remaining portion of the body 1310.

A rotating member insertion slot 1317 is formed in the upper portion of the second portion 1313 wherein a portion of the rotating member 1370, which will be described later, is inserted.

The front and the upper portion of the rotating member insertion slot 1317 are open.

The front of the rotating member insertion slot 1317 is closed by installing the second housing 1130.

The left and the right side surfaces forming the rotating member insertion slot 1317 have the slopes inclining as they travel from the left side towards the right side.

The length of the inclined slope of the left side surface constituting the rotating member insertion slot 1317 is shorter than that of the right side surface constituting the rotating member insertion slot 1317.

The lower side surface forming the rotating member insertion slot 1317 has a slope declining as it travels from the left side towards the right side.

The left side of the body 1310 is curvedly or slantly formed so as not to interfere with the rotating latch 1200.

The lower portion of the rotating member 1370 is disposed in front of the first portion 1311 of the main locking member 1300. Thus, at least a portion of the rotating member 1370 is disposed in front of the main locking member 1300.

The rotating member 1370 is disposed in the front of the first housing 1110, and rotatably installed in the second housing 1130 through the rotating shaft 1380 disposed along the front and rear direction.

The rotating shaft 1380 is installed penetrating through the upper portion of the rotating member 1370.

The rotating shaft 1380 is provided in the form of a rivet and riveted into the second housing 1130.

The rotating member 1370 can be rotated around the center of the rotating shaft 1380 in the clockwise or counterclockwise direction.

In addition, a return spring 1390 which returns the rotating member 1370 may be provided.

One end of the rotating spring 1390 is supported and fixed by the rotating spring stopping shaft 1391 which is riveted in the second housing 1130, and the other end is caught by the right side of the rotating member 1370 and being connected thereby. The center portion of the rotating spring 1390 is inserted into the rotating shaft 1380.

The rotating spring 1390 performs a function of returning the rotating member 1370 to its original position by granting an elastic force capable of rotating the rotating member 1370 in clockwise direction when the rotating member 1370 is forcibly pushed towards the counterclockwise direction and then released.

The rotating member 1370 comprises a locking portion 1371 and an inserting protrusion 1373.

The left lower portion of the locking portion 1371 is protruded towards the left side.

A latch insertion slot is formed in the lower portion of the locking portion 1371 wherein a portion of the end of the latch 1200 is inserted when closing the door. The latch insertion slot is formed to have an open lower portion.

The locking portion 1371 restricts (locks) the position of the latch 1200.

In the lower side of the locking portion 1371, a latch insertion slot, wherein a portion of the end (first surface 1203) of the latch 1200 is inserted when closing the door, is formed. The latch insertion slot is formed to have an open lower portion.

An inserting protrusion 1373 which is downwardly protruded is formed in the right side of the lower surface of the locking portion 1371.

The inserting protrusion 1373 is located inside the rotating member insertion slot 1317.

The reason for this is to prevent the separation of the inserting protrusion 1373 of the rotating member 1370 from the inside of the rotating member insertion slot 1317 when the main locking member 1300 is being slided by the rotating member 1370 due to the rotation of the latch 1200.

The inserting protrusion 1373 slides the main locking member 1300 along the left-to-right direction according to the rotation of the rotating member 1370.

Preferably, the width along the left-to-right direction of the inserting protrusion 1373 is formed to be formed narrower than the width along the left-to-right direction of the rotating member insertion slot 1317.

The main locking member 1300 is installed in the first housing 1110 and locks the latch 1200 through the rotating member 1370.

A stopping lever receiving slot 1314 wherein the stopping lever unit 1450, which will be described later, is to be received is formed in the left side of the back surface of the body 1310.

In addition, a stopping lever shaft hole 1316, wherein the stopping lever shaft 1470 is inserted along the up-down direction, is formed in the left lower side of the body 1310 along the up-down direction. The stopping lever shaft hole 1316 is formed to have an open upper portion and a closed lower portion, the stopping lever shaft 1470 is inserted from the above into the stopping lever shaft hole 1316 when being assembled. The stopping lever shaft hole 1316 is formed to be communicating with the stopping lever receiving slot 1314 which is formed in the upper and lower portion thereof.

A second return spring receiving slot 1318, wherein the second return spring 1460 is to be received, is formed in the left side of the rear side surface of the body 1310. The second return spring receiving slot 1318 is formed to have an open rear side. The second return spring receiving slot 1318 is disposed between the stopping lever receiving slots 1314 disposed in the upper and the lower portions thereof.

A spacing protrusion 1312 is formed in the middle of the left side of the rear side surface of the body 1310.

The spacing protrusion 1312 is disposed in the middle of the second return spring receiving slot 1318, and provides a gap between the first spring portion 1460*a* and the second spring portion 1460*b* of the second return spring 1460.

A sub-locking member insertion slot 1315 wherein the sub-locking member 1400 is inserted is formed in the rear side surface in the right side of the body 1310. The sub-locking member insertion slot 1315 is formed along the left-to-right direction, and its right side is formed to be open. Due to such sub-locking member insertion slot 1315 the sub-locking member 1400 can be guided when moving along the left-to-right direction. The sub-locking member insertion slot 1315 can be referred to as 'coupling unit insertion slot'.

In addition, a stopping protrusion insertion hole 1319 wherein the stopping protrusion 1455 is inserted is formed in the rear side surface of the right side of the body 1310. The stopping protrusion insertion hole 1319 is communicating with the sub-locking member insertion slot 1315.

The body 1310 is formed in this way, and the sub-locking member 1400 is disposed in the rear side of the main locking member 1300. Thus, the strength of the door latch system 5 can be enhanced, and at the same time, size thereof becomes compact as well, therefore it can be applied to the door 1 of the various designs.

A stopping lever unit 1450 is rotatably installed in the rear side surface of the body 1310. Unlike the previous description, the stopping lever unit 1450 may be formed in the sub-locking member.

As illustrated in FIG. 11, the stopping lever unit 1450 includes: a first stopping lever part 1450*a* and a second stopping lever part 1450*b* which is disposed in the lower side of the first stopping lever part 1450*a*.

Such as the first stopping lever part 1450*a* and the second stopping lever part 1450*b* are connecting means installed for sliding both of the main locking member 1300 and the sub-locking member 1400, which will be described later, or sliding only the sub-locking member 1400 in a selective manner.

The first stopping lever part 1450*a* and the second stopping lever part 1450*b* are formed to be the shape of a bar, and a stopping protrusions 1455, which are forwardly protruded, are formed at the ends of the right sides thereof respectively.

Holes 1451, through which the stopping lever shaft 1470 is penetrating, are respectively formed along the up-down direction in the left ends of the first stopping lever part 1450*a* and the second stopping lever part 1450*b*.

The first stopping lever part 1450*a* and the second stopping lever part 1450*b* are rotatably installed in the body 1310 through the stopping lever shaft 1470 installed along the up-down direction in the body 1310.

A guide bar 1457 is formed in the right side of the first stopping lever part 1450*a* and the second stopping lever part 1450*b*.

A first guide bar 1457*a* formed in the first stopping lever part 1450*a* is downwardly protruded, and a second guide bar 1457*b* formed in the second stopping lever part 1450*b* is upwardly protruded.

The first guide bar 1457*a* and the second guide bar 1457*b* enable the first stopping lever part 1450*a* and the second stopping lever part 1450*b* to be rotated individually guided by the inclined surface 1511 formed in the locking plate 1500 which will be described later.

A child lock protrusion 1453 is formed upwardly protruded in the upper right side of the first stopping lever part 1450*a*. The child lock protrusion 1453 is formed in the shape of a cylinder. The child lock protrusion 1453 is disposed on the same line with the guide bar 1457.

The child lock protrusion 1453 is formed for interlocking between the child locking member 1700 and the first stopping lever part 1450*a*, which will be described later.

A second return spring 1460 is installed in the first stopping lever part 1450*a* and the second stopping lever part 1450*b* for returning of the first stopping lever part 1450*a* and the second stopping lever part 1450*b* to their original positions.

The second return spring 1460 includes a first spring portion 1460*a*, a second spring portion 1460*b*, and a spring connecting portion 1465 for connecting the first spring portion 1460*a* and the second spring portion 1460*b*.

The first spring portion 1460*a* is disposed in the upper side of the second spring portion 1460*b*.

The first spring portion 1460*a* and the second spring portion 1460*b* include coil portions 1461 having the shape of a coil and free end portions having the shape of a straight line respectively.

The coil portions 1461 are inserted into the stopping lever shaft 1470 and being fixed thereby. The coil portions 1461 are disposed in the lower side of the first stopping lever part 1450*a* and the upper side of the second stopping lever part 1450*b*, respectively.

The coil portions 1461 and the spring connecting portion 1465 are received in the second return spring receiving slot 1318.

The free ends of the first spring portion 1460*a* and the second spring portion 1460*b* include the first bended portions 1462 bent backward, the second bended portions 1463 disposed along the left-to-right direction, and the third bended portions 1464 bent forward, respectively.

Each of the third bended portions 1464 are being held by the first guide bar 1457*a* and the second guide bar 1457*b* respectively, so that the first spring portion 1460*a* and the second spring portion 1460*b* are connected to the first stopping lever part 1450*a* and the upper side of the second stopping lever part 1450*b*, respectively.

The spring connecting portion 1465 is formed to have the shape of Korean alphabet letter 'ㄷ' (a rectangle without one side).

The spring connecting portion 1465 is connected to the end of the opposite side of the free end portion in the coil portion 1461.

The spring connecting portion 1465 is received in the second return spring receiving slot 1318 and supported by the main locking member 1300.

In this way, one ends of the first spring portion 1460*a* and the second spring portion 1460*b* are held by the first stopping lever part 1450*a* and the second stopping lever part 1450*b* respectively, and the other ends thereof are supported by the main locking member 1300.

Accordingly, the first stopping lever part 1450*a* and the second stopping lever part 1450*b* are rotated by the force applied thereto, then the stopping protrusion 1455 is being moved to the back side, and the force being applied to the first stopping lever part 1450*a* and the second stopping lever part 1450*b* is removed, then the first stopping lever part 1450*a* and the second stopping lever part 1450*b* are reversely rotated by the elastic restoring force of the second return spring 1460, then the stopping protrusion 1455 is returned to its original state (move forward).

That is, the elastic restoring force of the second return spring 1460 is exerting towards the front direction.

The horizontal bar 1340 is formed in length towards the left direction in the left lower side of the body 1310.

The horizontal bar 1340 is being slided inside the load guide slot 1116 so that the sliding of the main locking member 1300 can be performed more stably.

The stopping portion pressing arm 1330 is integrally formed to the horizontal bar 1340, and formed by being bended upwardly from the left end of the horizontal bar 1340.

The stopping portion pressing arm 1330 is formed to be the shape of a bar curved like an arc.

The stopping portion pressing arm 1330 is disposed in the outer side of the latch 1200; therefore, they are not interfered with each other when the latch 1200 is rotated.

A first sensing member 1350 is formed downwardly protruded in the lower side of the right end of the horizontal bar 1340.

In the lower surface of the first sensing member 1350, a first sensing unit 1351 such as a magnet is installed.

The first sensing unit 1351 is detected by the first sensor 1901 or the second sensor 1903 which is disposed in a position corresponding to the first sensing unit 1351 on the PCB 1900. The control unit (not shown) receives such detected signal and controls the motor 1610, which will be described later.

A sub-locking member 1400 is disposed in the right side of the main locking member 1300.

As illustrated in FIG. 12, the sub-locking member 1400 is inserted into the sub-locking member insertion slot 1315 of the main locking member 1300. Thus, the sub-locking member 1400 is installed in the main locking member 1300 so that it can be slided along the left-to-right direction.

The sub-locking member 1400 is slidingly installed inside the locking member receiving slot 1112 formed in the first housing 1110 same as the main locking member 1300.

A door lever connecting unit 1800 is connected to the sub-locking member 1400.

The sub-locking member 1400 includes a first sub-locking member 1400*a* and a second sub-locking member 1400*b* having the shape of a block. The corners of the upper and lower sides of the left side of first sub-locking member 1400*a* and a second sub-locking member 1400*b* are rounded so as to be slided smoothly along the left-to-right direction with respect to the main locking member 1300.

The door lever connecting unit 1800 includes a door in lever connecting part 1800*a* connected to the door in lever (not shown) and a door out lever connecting part 1800*b* connected to the door out lever (not shown). The door in lever connecting part 1800*a* and the door out lever connecting part 1800*b* are provided with wires.

The first sub-locking member 1400*a* is disposed in the upper portion of the second sub-locking member 1400*b*.

The door in lever connecting unit 1800*a* is connected to the first sub-locking member 1400*a*.

The first sub-locking member 1400*a* includes a first stopping member receiving slot 1401*a*, a first spring insertion protrusion 1402*a*, a first stopping threshold 1405*a*, and a manual locking member pressing portion 1407.

The second sub-locking member 1400*b* includes a second stopping member receiving slot 1401*b*, a second spring insertion protrusion 1402*b*, and a second stopping threshold 1405*b*.

The front sides of the first stopping member receiving slot 1401*a* and the second stopping member receiving slot 1401*b* are open.

The first stopping member receiving slot 1401*a* and the second stopping member receiving slot 1401*b* are formed to be corresponding to the shapes of the first stopping member 1801*a* and the second stopping member 1801*b*. Accordingly, the separation of the first stopping member 1801*a* and the second stopping member 1801*b* from the sub-locking member 1400 is prevented even when the door in lever or the door out lever is being pulled.

The first stopping member 1801*a* formed in the end of the door in lever 1800*a* is received in the first stopping member receiving slot 1401*a*.

The first stopping member 1801*a* of the door in lever connecting unit 1800*a* located inside the first stopping member receiving slot 1401*a* will not be separated towards the front side due to the body 1310 of the main locking member 1300.

The second stopping member 1801*b* formed in the end of the door out lever connecting unit 1800*b* is being received inside the second stopping member receiving slot 1401*b*.

The second stopping member 1801*b* of the door in lever connecting unit 1800*b* located inside the second stopping member receiving slot 1401*b* will not be separated towards the front side due to the body 1310 of the main locking member 1300.

A first withdrawing hole 1403*a*, from which the door in lever connecting unit 1800*a* is being pulled, is communicatingly formed in the right end of first stopping member receiving slot 1401*a* in a way that the first withdrawing hole 1403*a* is formed to have a smaller diameter than that of the first stopping member 1801*a*, so that the first stopping member 1801*a* cannot be pulled out through the first withdrawing hole 1403*a* even when the door in lever connecting unit 1800*a* is being pulled out to the right side.

Thus, the first sub-locking member 1400*a* is being slided towards the right side when the door in lever connecting unit 1800*a* is being pulled towards the right side.

A second withdrawing hole 1403*b*, from which the door out lever connecting unit 1800*b* is being pulled, is communicatingly formed in the right end of second stopping member receiving slot 1401*b* in a way that the second withdrawing hole 1403*b* is formed to have a smaller diameter than that of the second stopping member 1801*b*, so that the second stopping member 1801*b* cannot be pulled out through the second withdrawing hole 1403*b* even when the door out lever connecting unit 1800*b* is being pulled out to the right side.

Thus, the second sub-locking member 1400*b* is being slided towards the right side when the door out lever connecting unit 1800*b* is being pulled towards the right side.

A first spring 1803*a* is inserted into the door in lever connecting unit 1800*a* close to the first stopping member 1801*a*.

A first spring insertion protrusion 1402*a* and a second spring insertion protrusion 1402*b* are protrudedly formed towards the right side in the right side ends of the first sub-locking member 1400*a* and the second sub-locking member 1400*b*, and in the upper and lower sides of the first outlet hole 1403*a* and the second outlet hole 1403*b*. The left side ends of the first spring 1803*a* and the second spring 1803*b* are inserted into the first spring insertion protrusion 1402*a* and the second spring insertion protrusion 1402*b* respectively.

The first spring 1803*a* is disposed between the right side end of the first sub-locking member 1400*a* and the first spring receiving slot 1117 of the first housing 1110. The first spring 1803*a* returns the first sub-locking member 1400*a* which had been slided towards the right side by an external force to its original position by sliding it towards the left side using the elastic restoring force of the first spring 1803*a* when the external force is removed.

The second spring 1803*b* is inserted into the door out lever connecting unit 1800*b*.

The second spring 1803*b* is disposed between the right side end of the second sub-locking member 1400*b* and the second spring receiving slot 1119 of the first housing 1110. The second spring 1803*b* returns the second sub-locking member 1400*b* which had been slided towards the right side by an external force to its original position by sliding it towards the left side using the elastic restoring force of the second spring 1803*b* when the external force is removed.

A stopping threshold 1405, where the stopping protrusion 1455 of the stopping lever unit 1450 is being held (caught), is formed in the sub-locking member 1400. The stopping threshold 1405 includes a first stopping threshold 1405*a* and a second stopping threshold 1405*b*.

The first stopping threshold 1405*a* is formed in the rear side of the first sub-locking member 1400*a*, and the second stopping threshold 1405*b* is formed in the rear side of the second sub-locking member 1400*b*.

The first stopping threshold 1405*a* and the second stopping threshold 1405*b* are formed in a way that the left sides of the rear sides of the first sub-locking member 1400*a* and the second sub-locking member 1400*b* are more protruded backward than the right sides thereof.

The right side surfaces of the first stopping threshold 1405*a* and the second stopping threshold 1405*b* are inclinedly formed so that the stopping protrusion 1455 is not easily separated once it is being held (caught).

The stopping protrusion 1455 of the first stopping lever part 1450*a* can be caught by or separated from the first stopping threshold 1405*a*, and the protrusion 1455 of the second stopping lever part 1450*b* can be caught by or separated from the second stopping threshold 1405*b*.

The first stopping lever part 1450*a*, the second stopping lever part 1450*b*, the first stopping threshold 1405*a*, and the second stopping threshold 1405*b* are connecting means for sliding both of the main locking member 1300 and the sub-locking member 1400, or sliding only the sub-locking member 1400.

While the first stopping lever part 1450*a* is caught by the first stopping threshold 1405*a*, and the second stopping lever part 1450*b* is caught by the second stopping threshold 1405*b*, and if the door in lever (not shown) or the door out lever (not shown) is being pulled, then the main locking member 1300 and the sub-locking member 1400 are being slided together towards the left side.

That is, this is a lock released state of the door 1.

On the contrary, while the first stopping lever part 1450*a* is separated from the first stopping threshold 1405*a*, and the second stopping lever part 1450*b* is separated from the second stopping threshold 1405*b*, and if the door in lever (not shown) or the door out lever (not shown) is being pulled, then the main locking member 1300 is staying as it is, and only the sub-locking member 1400 is being slided towards the left side.

That is, this is a locked state of the door 1.

The first sub-locking member 1400*a* is provided with a manual locking member pressing portion 1407 extending from the lower portion of the right side surface towards the right side direction which is an outward direction.

The manual locking member pressing portion 1407 is provided with a horizontal plate, the front surface thereof is more protruded than the front surface of the first sub-locking member 1400*a*.

The manual locking member pressing portion 1407 is located between the first spring receiving slot 1117 of the first housing 1110 and the second spring receiving slot 1119, and being slided simultaneously with the first sub-locking member 1400*a* along the left-to-right direction.

The manual locking member pressing portion 1407 is in contact with the first stopping portion 1563 of the manual locking member 1560 which will be described later.

As illustrated in FIG. 13, the locking plate 1500 is formed in length along the left-to-right direction.

The locking plate 1500 is slidingly installed in the lower rear side surface of the first housing 1110. The locking plate 1500 rotates the stopping lever unit 1450.

The locking plate 1500 includes a lock-releasing cable connecting portion 1501, a lever guide portion 1507, a manual locking guide slotted hole 1515, and a second sensing member 1519.

The lock-releasing cable connecting portion 1501 is disposed in the left end side of the locking plate 1500.

A lock-releasing cable 1810 is connected in the left end of the lock-releasing cable connecting portion 1501, and the lock-releasing cable 1810 is being pulled towards the left side or the right side when the knob (not shown) and the like is operated, thus, the locking plate 1500 is moved towards the left side or the right side.

A stopping member receiving slot, wherein the end of the lock-releasing cable 1810 is being received, is formed in the rear side surface of the lock-releasing cable connecting portion 1501. Thus, assembling of the lock-releasing cable 1810 to the locking plate 1500 becomes easier.

The stopping member of the lock-releasing cable 1810 is formed in the shape of a long cylinder along the up-down direction.

A bended member 1503 protrudedly formed towards the rear side in the lower right side of the lock-releasing cable connecting portion 1501 is formed in the locking plate 1500.

The bended member 1503 has the shape of a horizontal plate.

A stopping protrusion 1506 is formed downwardly protruded in the lower side of the bended member 1503.

The stopping protrusion 1506 is a circular protrusion, and for manually sliding the locking plate 1500 through a key connect 1550.

The key connect 1550 comprises: a head 1551 wherein a cross-shaped slot is formed; a wing 1553 having a key connect opening 1555 wherein a portion of a disk having a larger diameter than that of the head 1551 has been cut-off; and an upper protrusion 1557 upwardly protruded from the center of the wing 1553.

The key connect 1550 is rotatably installed in the lower portion of the housing 1100, and the stopping protrusion 1506 is positioned inside the key connect opening 1555 of the key connect 1550.

At this time, if the head 1551 of the key connect 1550 is manually rotated using a tool such as a key or a driver or the like, the locking plate 1500 can be slided along the left-to-right direction without driving the driving unit 1600.

More specifically, if the head 1551 of the key connect 1550 is rotated, the stopping protrusion 1506 positioned inside the key connect opening 1555 is pushed by the both of the side surfaces inside the key connect opening 1555, thus, the locking plate 1500 is moved along the left-to-right direction.

In other words, the locking plate 1500 is linearly moving due to the rotational movement of the key connect 1550.

Therefore, the door 1 can be manually locked or unlocked by using the key connect 1550.

In addition, in the upper side of the locking plate 1500, a main gear stopping portion 1502 is formed upwardly protruded between the lock-releasing cable connecting portion 1501 and the stopping protrusion 1506.

Further, in the locking plate 1500, a plate-like reinforcing rib is formed at the right side of the main gear stopping portion 1502 so that the damage of the locking plate 1500 can be prevented when operating.

When the main gear 1630 is rotated due to the operation of the motor 1610, which will be described later, the main gear stopping portion 1502 is being pushed by the first stopping portion 1633 and the second stopping portion 1635 formed in the main gear 1630. Therefore, the locking plate 1500 is moved towards the left side or the right side.

The main gear 1630 is disposed in the upper portion of the main gear stopping portion 1502 so that only the main gear stopping portion 1502 is being caught while the other portions of the locking plate 1500 are not being caught when the main gear 1630 is rotating.

In locking plate 1500, a lever guide portion 1507 is formed at the right side of the bended member 1503.

A lever guide portion 1507 is formed forwardly protruded (towards the stopping lever portion 1450) in the front surface of the right side of the locking plate 1500.

The lever guide portion 1507 is formed in the shape of a strip, and formed in a way that first, it is protruded and then bended towards the right side. Thereby, an insertion space 1509, wherein the guide bar 1457 is inserted, is formed between the lever guide portion 1507 and the locking plate 1500. The insertion space 1509 is formed in a way that the upper side, the lower side, and the right side thereof are open.

An inclined surface 1511 is formed in the inner side surface (surface being contacted with the guide bar 1457) of the lever guide portion 1507, and thus, the structure becomes simpler and the durability is enhanced as well. Due to such inclined surface 1511, the thickness along the front and rear direction of the right side of the lever guide portion 1507 becomes thicker as it travels towards the left side.

The upper portion of the lever guide portion 1507 guides the first guide bar 1457*a* of the first stopping lever portion 1450*a*, and the lower portion of the lever guide portion 1507 guides the second guide bar 1457*b* of the second stopping lever portion 1450*b*.

The rotation of the stopping lever unit 1450 is occurring as the lever guide portion 1507 guides the guide bar 1457 towards either the front direction or the rear direction; if the stopping lever unit 1450 is caught by the stopping threshold 1405 due to the sliding of the locking plate 1500, then both of the main locking member 1300 and the sub-locking member 1400 are sliding together (door lock is released); and if the stopping lever unit 1450 is separated from the stopping threshold 1405 due to the sliding of the locking plate 1500, then only the sub-locking member 1400 is sliding (door is locked).

More specifically, when the first guide bar 1457*a* and the second guide bar 1457*b* are disposed in the insertion space 1509 by the lever guide portion 1507, the first stopping lever portion 1450*a* and the second stopping lever portion 1450*b* are being separated from the first stopping threshold 1405*a* of the first sub-locking member 1400*a* and the second stopping threshold 1405*b* of the second sub-locking member 1400*b* respectively, and thus this is the state wherein the door 1 is locked.

When the first guide bar 1457*a* and the second guide bar 1457*b* are separated from the insertion space 1509, the first stopping lever portion 1450*a* and the second stopping lever portion 1450*b* are being caught by the first stopping threshold 1405*a* of the first sub-locking member 1400*a* and the second stopping threshold 1405*b* of the second sub-locking member 1400*b* respectively, and thus this is the state wherein the locking of the door 1 is released.

In this way, the lever guide portion 1507 plays the role of locking the door 1 or releasing the locking of the door 1 by rotating the first stopping lever portion 1450*a* and the second stopping lever portion 1450*b* according to the sliding of the locking plate 1500 along the left-to-right.

A manual locking guide slotted hole 1515 is formed along the left-to-right direction in the upper portion of the right side end of the locking plate 1500. The manual locking guide slotted hole 1515 is formed in a way that the front side, back side, and the right side thereof are open.

A reinforcement structure is formed near the manual locking guide slotted hole 1515 in the front surface of the locking plate 1500, so that the strength of the locking plate can be enhanced.

A second stopping portion 1562 of the manual locking member 1560, which will be described later, is inserted in the manual locking guide slotted hole 1515.

In the center area of the manual locking member 1560, a shaft through-hole, where the manual locking member shaft 1561 is passing through, is penetratingly formed along the up-down direction.

The manual locking member shaft 1561 is received in the manual locking member receiving slot 1125.

The rear side of the manual locking member receiving slot 1125 is blocked by the manual locking member cover 1564 disposed in the rear side of the manual locking member shaft 1561, so that the manual locking member shaft 1561 is not separated from the manual locking member receiving slot 1125. A second stopping portion outlet hole, from which the second stopping portion 1562 is being pulled out, is formed in the manual locking member cover 1564.

The manual locking member 1560 is inserted into the manual locking member insertion hole 1118. Thus, the manual locking member 1560 is rotatably installed in the first housing 1110.

A first stopping portion 1563 which is caught by the manual locking member pressing portion 1407 of the first sub-locking member 1400*a*, is formed in the front side of the manual locking member 1560, and a second stopping portion 1562 which is caught by the locking plate 1500 is formed in the rear side thereof.

In this way, the first stopping portion 1563 and the second stopping portion 1562 are disposed spaced apart along the circumferential direction. The corners of the end portions of the first stopping portion 1563 and the second stopping portion 1562 are rounded.

Due to such manual locking member 1560 the structure becomes simple, and the locking of the door is released when a user inside the vehicle pulls the door in lever once while the door is locked, and the door 1 is opened when the door in lever is being pulled one more time.

The locking plate 1500 is formed in a way that a second sensing member 1519 is formed downwardly protruded in the lower side between the stopping protrusion 1506 and the lever guide portion 1507. More specifically, the lower portion of the second sensing member 1519 is formed to be bending backward.

In the lower surface of the bended portion of the second sensing member 1519, a second sensing unit 1521 such as a magnet is installed.

The second sensing unit 1521 is detected by the third sensor 1905 and the fourth sensor 1907 which are installed in a position corresponding to the second sensing unit 1521 on the PCB 1900. Such signal detected by the third sensor 1905 and the fourth sensor 1907 is transferred to the information device of the vehicle, thus the driver recognize the locking and lock-releasing states of the door 1.

A first stopper protrusion 1107 is protrudedly formed in the one of the locking plate 1500 and the housing 1100, and in the other one thereof, a first stop spring 1570 elastically deformed by the first stopper protrusion 1107 is installed.

In this exemplary embodiment, the first stopper protrusion 1107 is formed backwardly protruded in the rear side surface of the first housing 1110, and the first stop spring 1570 is installed at the right rear side surface of the locking plate 1500.

A stopper slotted hole 1571 where the first stopper protrusion 1107 is penetrating through is formed along the left-to-right direction at the right lower portion of the locking plate 1500.

A first link 1573, wherein the one end of the first stop spring 1570 is inserted, is formed backwardly protruded at the left side of the stopper slotted hole 1571 in the rear side surface of the locking plate 1500.

A second link 1572, wherein the other end of the first stop spring 1570 is inserted, is formed backwardly protruded at the right side of the stopper slotted hole 1571 in the rear side surface of the locking plate 1500.

The first stop spring 1570 is formed by bending the middle portion of a metallic wire. Thus, the first stop spring 1570 is formed to have the shape of a pin ('⊂') in general. In this way, a wire form spring is provided as the first stop spring 1570.

A first insertion portion 1578 which is inserted into the first link 1573 is formed in the one side of the first stop spring 1570. The first insertion portion 1578 is formed to be the shape of a circle.

A first stop portion 1577, whose top and lower portions are formed to be the shape of an arc so as to correspond to the shape of the first stopper protrusion 1107, is formed at the right side of first insertion portion 1578 of the first stop spring 1570. The first stopper protrusion 1107 is received on the first stop portion 1577 when the locking plate 1500 is in the door lock position.

A second stop portion 1575, whose top and lower portions are formed to be the shape of an arc so as to correspond to the shape of the first stopper protrusion 1107, is formed at the right side of first stop portion 1577 of the first stop spring 1570. The first stopper protrusion 1107 is received on the second stop portion 1575 when the locking plate 1500 is in the door lock released position.

In the first stop spring 1570, an elastic deforming portion 1576, whose vertical width is smaller than those of the first stop portion 1577 and the second stop portion 1575, is formed between the first stop portion 1577 and the second stop portion 1575. That is, the vertical width of the elastic deforming portion 1576 is formed smaller that the up-down width of the first stopper protrusion 1107. The upper portion of the elastic deforming portion 1576 is curvedly formed to be downwardly concave, and the lower portion thereof is curvedly formed to be upwardly convex.

In the right end of the first stop spring 1570, a spring end portion 1574 is formed. The vertical width of the spring end portion 1574 is formed to be smaller than that of the second stop portion 1575. The spring end portion 1734 is horizontally disposed along the left-to-right direction in the shape of a straight line.

The shape of the cross-section of the first stopper protrusion 1107 is formed in the shape of a cylinder.

Thus, in order to move the locking plate 1500 from the connected position to the disconnected position (or move towards the opposite direction), the vertical gap of the elastic deforming portion 1576 must be widened through the elastic deformation thereof. That is, in order to move the locking plate 1500 from the connected position to the disconnected position, or in order to move the locking plate 1500 from the disconnected position to the connected position, the locking plate 1500 must be slided by a force which is strong enough to elastically deform the elastic deforming portion 1576 of the first stop spring 1570.

Moreover, when sliding the locking plate 1500, a friction force is generated due to the contact between the elastic deforming portion 1576 of the first stop spring 1570 and the first stopper protrusion 1107.

Thus, the separation of the locking plate 1500 from the connected position or the disconnected position is prevented even when the external impact is applied thereto when the locking plate 1500 is in the connected position or in the disconnected position. That is, the erroneous operation of the locking plate 1500 due to the external impact is prevented.

The exemplary embodiment further includes a driving unit 1600 for rotating the latch 1200 or sliding the locking plate 1500.

As illustrated in FIG. 14, the driving unit 1600 includes a motor 1610, a sub-gear 1620 being rotated by the motor 1610, and a main gear 1630 geared with the sub-gear 1620 and being rotated.

The driving unit 1600 is installed in the rear side surface of the first housing 1110 and in the front surface of the third housing 1150.

The driving unit 1600 is disposed between the rear side surface of the first housing 1110 and in the front surface of the third housing 1150.

The motor 1610 is connected to the PCB 1900 so that it may generate the driving force or stop the generation of driving force by receiving the signal from the PCB 1900.

The motor 1610 is disposed in a way that the angle between the shaft 1611 of the motor 1610 and the front surface of the housing 1100 becomes zero degree (horizontal) or a preferred angle.

A worm gear 1613 is installed in the shaft 1610 of the motor.

In the sub-gear 1620, a small diameter gear and a large diameter gear are connected through the same shaft. The sub-gear 1620 is integrally formed of a small diameter gear and a large diameter gear.

The large diameter gear of the sub-gear 1620 is engaged with the worm gear 1613.

The small diameter middle spur gear of the sub-gear 1620 is engaged with the main gear 1630.

The main gear 1630 is provided as a spur gear and receives the driving force of the motor 1610 via the sub-gear 1620.

As illustrated in FIGS. 15 and 16, in the main gear 1630, a geared portion 1632, wherein gear teeth 1638 are formed, is formed in a portion of the peripheral surface of the main gear 1630; and a non-geared portion 1643, wherein no gear teeth 1638 are formed, is formed in the remaining portion of the peripheral surface thereof.

The geared portion 1632 is formed only in a portion of the right side of the main gear 1630.

The non-geared portion 1643 is formed in the remaining portion of the main gear 1630 not in the geared portion 1632. The non-geared portion 1643 is formed to be flat or curved.

That is, the gear teeth 1638 are not formed around the entire circumference of the main gear 1630 but only in a portion thereof. Therefore, the thickness of the non-geared portion 1643 along the forward and backward direction can be reduced while the durability of the main gear 1630 is maintained.

The thickness of the geared portion 1632 along the forward and backward direction is formed to be thicker than that of the non-geared portion 1643. Therefore, the durability of the geared portion 1632 can be enhanced.

The main gear 1630 includes a plastic portion 1634 and a metal portion 1642 which is inserted into the plastic portion 1634. The main gear 1630 is formed by inserting the metal portion 1642 into the plastic portion 1634.

The plastic portion 1634 includes a plastic plate portion 1645 formed in the shape of a plate, and a geared portion 1632 backwardly and protrudedly formed in a portion of the outer circumferential surface of the plastic plate portion 1645.

The plastic plate portion 1645 is formed in the shape of a circular disk, and the insert protrusions 1637 are backwardly and protrudedly formed in the rear side surface thereof. Four of the insert protrusions 1637 are formed around the insert hole 1636 wherein the main gear shaft 1114 is inserted.

A stopping portion 1631 is formed in the lower left portion of the front surface of the plastic plate portion 1645 for rotating the latch 1200. The stopping portion 1631 is formed in the shape of a bar, and protrudedly formed towards the front direction.

The stopping portion 1631 is installed slidingly along the front and rear direction in an outer container 1649 forwardly protruded in the front surface of the plastic plate portion 1645.

The outer container 1649 is formed in a way that the front side thereof is open and the inside thereof is hollow. A sliding guide slotted hole 1649*a* is formed in the left and the right sides of the outer container portion 1649. The guide slotted hole 1649*a* is formed in length along the front and rear direction. The guide slotted hole 1649*a* is penetratingly formed along the left-to-right direction.

The stopping portion 1631 includes a head portion 1631*a* and an inner container portion 1631*b* formed in the rear side of the head portion 1631*a*.

An inclined surface is formed in the left front surface of the head portion 1631*a*. Due to such inclined surface, the stopping portion pressing portion 1330 can push the head portion 1631*a* smoothly.

The end of the outer side of the head portion 1631*a* is outwardly formed protruded further than the latch 1200. Thus, even when the head portion 1631*a* is pressed by the stopping portion pressing portion 1330, the interference between the rotating latch 1200 and the stopping portion pressing portion 1330 is prevented.

The inner container portion 1631*b* is inserted into the outer container 1649.

An outer container stopping protrusion 1631*c* is formed outwardly protruded at both sides of the outer circumference of the inner container 1631*b*. The outer container stopping protrusion 1631*c* is inserted into the guide slotted hole 1649*a*.

The inner container portion 1631*b* is formed in a way that the rear side thereof is open and the inside thereof is hollow.

A stopping portion return spring 1648 which returns the stopping portion 1631 to its original position is disposed between the inner container portion 1631*b* and the outer container 1649.

A coil spring is provided as the return spring 1648. The front end of the return spring 1648 is inserted into the inner container 1631*b*.

Due to such stopping portion 1631 the door 1 can be manually opened by pulling the door lever or the door out lever even if the driving unit 1600 fails during closing the door 1 using the driving unit 1600 or after it has been closed.

In ordinary times, the stopping portion 1631 plays the role of holding the latch 1200 to the main locking member 1300 by automatically rotating the latch 1200 using the driving force of the motor 1610 if the door 1 is closed to some degree even if the door 1 is not closed completely when a user closes the door 1.

In addition, a fifth sensor detecting portion 1641 is formed in the outer circumferential surface of the plastic plate portion 1645 so as to be disposed in the rear side of the stopping portion 1631. The fifth sensor detecting portion 1641 is formed in a way that it presses the fifth sensor 1911, which is a limit switch, when the main gear 1630 returns to the basic position. Thus, the main gear 1630 can return to the original position (basic position) again after moving the locking plate 1500, or being rotated for moving the latch 1200.

A portion of the plastic portion 1634 is cutoff. A main gear stopping portion 1502 is inserted into the cutoff space of the plastic portion 1634. Due to this, a first stopping portion 1633 and a second stopping portion 1635 are formed in the lower portion of the plastic portion 1634 for sliding the locking plate 1500. The first stopping portion 1633 is continuously formed in the lower end of the geared portion 1632.

The first stopping portion 1633 and the second stopping portion 1635 are spaced apart from each other.

The first stopping portion 1633 and the second stopping portion 1635 play the role of sliding the locking plate 1500 towards the left side or the right side by pushing the main gear stopping portion 1502 according to the rotation of the main gear 1630.

In addition, the main gear stopping portion 1502 is disposed in the front side of the metal portion 1642.

The metal portion 1642 includes a plate portion 1644 formed in the shape of a plate, and a plurality of the protrusions 1639 forwardly and protrudedly formed along the circumference of the plate portion 1644.

The plate portion 1644 is formed in the shape of a disk. In the center area of the plate portion 1644, the insert protrusion slots 1646 are formed around insert hole 1636 wherein the latch rotating shaft 1230 is inserted. The insert protrusions 1637 are inserted into the insert protrusion slots 1646.

The protrusions 1639 are inserted into the geared portion 1632 and the inside of the stopping portion 1631 of the plastic portion 1634. Thus, the durability of the geared portion 1632 and the stopping portion 1631 can be enhanced further.

The protrusions 1639 which are inserted in the geared portion 1632 are formed divided in multiple numbers, and the protrusion 1639 which is disposed inside the stopping portion 1631 is formed to have a longer length than those of the protrusions 1639 inside the geared portion 1632.

Since the opening and the closing of the door 1 using the latch 1200, and the locking and the lock-releasing of the door 1 using the locking plate 1500 can be performed by a single driving unit 1600, the structure is simple, and it can be compactly configured, and the manufacturing cost can be reduced.

As illustrated in FIG. 17, the child locking member 1700 is slidingly installed in the housing 1100 along the left-to-right direction so as to be disposed in the upper portion of the sub-locking member 1400.

More specifically, the child locking member 1700 is disposed in the upper portion of the first sub-locking member 1400*a*.

The child locking member 1700 is formed in the shape of a plate, and received in the child locking member receiving slot 1122 of the first housing 1110. Thus, the child locking member 1700 can be slided along the left-to-right direction with respect to the housing 1100.

A locking protrusion 1722 is formed backwardly protruded in the child locking member 1700. The left side surface of the locking protrusion 1722 is inclinedly formed.

In the right front surface of the child locking member 1700, a child locking operation protrusion 1710 is formed forwardly protruded. The child locking operation protrusion 1710 is inserted into the operation protrusion slotted hole 1134 formed in the second housing 1130.

When the child locking member 1700 is moved towards the left side, the child lock protrusion 1453 of the first stopping lever part 1450*a* is pushed towards the rear side direction by the locking protrusion 1722. In this way, when the right side of the first stopping lever part 1450*a* is moved towards the rear side then the first stopping lever part 1450*a* is separated from the first stopping threshold 1405*a*. And if when the child locking member 1700 is moved towards the right side, the first stopping lever part 1450*a* is returned to its original state. Thus, the first stopping lever part 1450*a* is caught by the first stopping threshold 1405*a*.

In this way, the first stopping lever part 1450*a* may be caught by or separated from the first stopping threshold 1405*a* according to the movement of the child locking member 1700.

A second stopper protrusion 1721 is protrudedly formed in the one of the child locking member 1700 and the first housing 1100, and a second stop spring protrusion 1730, which applies an elastic force to the second stop spring protrusion 1721, is installed in the remaining one thereof.

In this exemplary embodiment, the second stopper protrusion 1721 is protrudedly formed towards the rear side direction in the upper right side of the back surface of the child locking member 1700, and the second stop spring 1730 is installed in the front surface of the first housing 1110. The second stop spring 1730 is disposed in the rear side of the child locking member 1700.

As illustrated in FIG. 18, in the front surface of the first housing 1110, a stop spring receiving slot 1104 is formed in length along the left-to-right direction so that it is communicating with the child locking member receiving slot 1122 and disposed in the rear side of the child locking member receiving slot 1122. The stop spring receiving slot 1104 is correspondingly formed to the shape of the second stop spring 1730, and the portion where the elastic deforming portion 1732, which will be described later, is being received, is formed in a way that the vertical width thereof is longer than that of the elastic deforming portion 1732, thereby enabling the elastic deformation of the elastic deforming portion 1732.

The second stop spring 1730 is formed by bending the center portion of a metal based material. Thus, the second stop spring 1730 is formed in the shape of a pin ('⊂') on the whole. In this way, a wire form spring is provided as the second stop spring 1730.

In the second stop spring 1730, a first stop portion 1731, being formed in the shape of an arc corresponding to the shape of the second stopper protrusion 1721, is formed in the far right end thereof. The second stopper protrusion 1721 is being received in the first stop portion 1731 when the child locking member 1700 is in the connected position.

In the second stop spring 1730, a second stop portion 1733, whose upper portion and lower portion are being formed in the shape of an arc respectively, is formed in the left side thereof. The second stopper protrusion 1721 is being received in the second stop portion 1733 when the child locking member 1700 is in the disconnected position.

In the second stop spring 1730, an elastic deforming portion 1732, whose vertical width is smaller than those of the first stop portion 1731 and the second stop portion 1733, is formed between the first stop portion 1731 and the second stop portion 1733. That is, the vertical width of the elastic deforming portion 1732 is formed to be smaller than the vertical width of the second stopper protrusion 1721. The elastic deforming portion 1732 is horizontally disposed along the left-to-right direction in the shape of a straight line.

The shape of the cross-section of the second stopper protrusion 1721 is formed in the shape of a cylinder.

Thus, the second stop spring 1730 is elastically deformed by the second stopper protrusion 1721 when the child locking member 1700 is in at least in a portion between the connected position and disconnected position. That is, in order to move the child locking member 1700 from the connected position to the disconnected position, or in order to move the child locking member 1700 from the disconnected position to the connected position, the child locking member 1700 must be slided by a force which is strong enough to elastically deform the second stop spring 1730.

Moreover, when sliding the child locking member 1700, a friction force is generated due to the contact between the elastic deforming portion 1732 of the second stop spring 1730 and the second stopper protrusion 1721.

Thus, the separation of the child locking member 1700 from the connected position or the disconnected position is prevented even when the external impact is applied thereto when the child locking member 1700 is in the connected position or in the disconnected position. That is, the erroneous operation of the child locking member 1700 due to the external impact is prevented.

A spring end portion 1734 is formed at the left end of the second stop spring 1730. The vertical width of the spring end portion 1734 is formed to be narrower than that of the elastic deforming portion 1732. The spring end portion 1734 is horizontally disposed along the left-to-right direction in the shape of a line.

The door latch system 5 of the present invention can perform lock-releasing operation without any functional jamming even lock-releasing operation is performed while the door lever (not shown) is being pulled under the locking state of the door 1.

This will be described in sequence as follows.

The door lever (not shown) of the door 1, which is under locked state, is being pulled.

At this time, since the stopping lever unit 1450 is not caught by the sub-locking member 1400, the sub-locking member 1400 is being slided towards the opposite side of the main locking member 1300 along the door lever (not shown) which is being pulled without affecting the main locking member 1300.

If lock-releasing operation is performed using a key, a remocon, and the like during performing such operation, the stopping lever unit 1450 rotates forwardly in order to be connected to the sub-locking member 1400.

However, since the stopping lever unit 1450 is rotated while the door lever (not shown) is being pulled, the stopping lever unit 1450 is not connected to the sub-locking member 1400 which is spaced apart from the main locking member 1300, but instead, the stopping lever unit 1450 is entered into the space separated between the main locking member 1300 and the sub-locking member 1400.

At this time, if the door lever (not shown), which is being pulled, is released, the sub-locking member 1400 is moved towards the main locking member 1300 due to the elastic restoring force of the spring.

The sub-locking member 1400 enters the inside of the stopping lever unit 1450, and thus the coupling of the stopping lever unit 1450 to the sub-locking member 1400 is completed. In the context of that, the sub-locking member 1400 can be referred to as 'coupling unit'.

The sensors installed in the PCB 1900 of the door latch system 5 of the present invention are connected to a room lamp (not shown), an instrument panel (not shown), and the like, a user can easily recognize the opening and closing state of the door 1.

Hereinafter, an operational process of the door latch system 5 having the aforementioned configuration and according to the third exemplary embodiment of the present invention will be described.

<Door Closing>

As illustrated in FIG. 19, when the user closes the door 1, the striker 1101 presses the latch 1200, and the latch 1200 is rotated in a clockwise direction thereby.

The latch 1200 presses the sixth sensor 1910 while being rotated along the clockwise direction, and the control unit recognizes that the door 1 is closing, however, the motor 1610 is not operating yet. At this time, as illustrated in FIG. 20, the outer circumferential surface of the latch 1200 pushes the locking protrusion 1320 of the main locking member 1300, and the main locking member 1300 is pushed towards the right side. Therefore, the first sensing unit 1351 is not detected by the first sensor 1901.

Next, the latch 1200 further rotates clockwise by the force of the user closing the door 1, as illustrated in FIG. 21, and the first sensing unit 1351 is detected by the first sensor 1901 as the locking protrusion 1320 is being inserted into the auxiliary locking slot 1201.

In this way, when the sixth sensor 1910 and the first sensor 1901 are all detected, the control unit operates the motor 1610.

That is, after the latch 1200 is rotated along the clockwise direction for a certain degree while the latch 1200 is being pressed by the striker 1101, the motor 1610 begins to operate.

Due to this configuration, the erroneous operation of the motor 1610 is prevented when the door 1 is opened.

The protrusion 1215 of the latch 1200 is pushed in a clockwise direction by the clockwise rotation of the stopping portion 1631 installed in the front surface of the main gear 1630 due to the operation of the motor 1610. Consequently, the locking portion 1371 of the rotating member 1370 is inserted into the locking slot 1201 of the latch 1200, and the door 1 is closed thereby.

At this time, the locking portion 1371 of the rotating member 1370 is rotated towards the clockwise direction by the elastic force of the rotating spring 1390 and positioned inside the locking slot 1201, and the first surface of the latch 1200 is inserted into the latch insertion slot of the locking portion 1371 thereby.

As the stopping portion 1631 is being rotated by the motor 1610, and arrived at the door closing position, and then the locking portion 1371 is inserted into the locking slot 1201, and the first sensing unit 1351 is detected by the first sensor 1901 thereby. In this way, when the first sensing unit 1351 is detected by the first sensor 1901 while the motor is being operated for closing the door, the control unit determines that the stopping portion 1631 is being rotated up to the door closing position and rotates the stopping portion 1631 in a counterclockwise direction using the motor 1610. As illustrated in FIG. 22, the control unit operates the motor 1610 until the fifth sensing unit 1641 presses the fifth sensor 1911. Thus, the main gear 1630 is returned to the basic position. In such a way, since the main gear 1630 is returned to the basic position after the operations of door closing or door locking, the driver can manually lock the door or release the closing of the door.

When an emergency situation occurs such that fingers or clothes of a child are trapped between the door and the vehicle body while the door 1 is being closed by operating the motor 1610, the door lever (not shown) is being pulled, and then, the second sensor 1903 detects the first sensing unit 1351 which has been moved towards the right side, and the motor 1610 is being rotated in the reversed direction, and the stopping portion 1631 is being moved to the lock-releasing position (basic position), and thus, the door can be opened thereby.

<Door Locking>

As illustrated in the FIGS. 23 and 27, the operation wherein the lock-released state of the door 1 becomes a locked state by a key, a locking button, a knob, a door out lever sensor, and presetting the critical speed of the vehicle and the like will be described.

When a door locking (signal) is entered through the motor 1610, the motor 1610 is operated and rotates the main gear 1630 in a counterclockwise direction.

When the main gear 1630 is rotated in a counterclockwise direction, the second stopping portion 1635 located in the rear side surface of the main gear 1630 pushes the main gear stopping portion 1502 of the locking plate 1500 and slides the locking plate 1500.

At this time, the locking plate 1500 is being moved to the right side, as illustrated in FIG. 26, the first stopping lever part 1450*a* and the second stopping lever part 1450*b* are inserted into the insertion space 1509 along the inclined surface 1511 of the lever guide portion 1507, and the stopping protrusion 1455 is moved towards the rear side direction thereby, and the stopping protrusion 1455 is separated from the first sub-locking member 1400*a* and the second sub-locking member 1400*b* respectively. Due to this action, the door 1 becomes locked; therefore, the force will not be transferred to the main locking member 1300 when the door lever (not shown) is being pulled.

As illustrated in FIG. 27, the second stopping portion 1635 pushes the locking plate 1500 until the second sensing unit 1521 of the locking plated 1500 is detected by the fourth sensor 1907, and returns to its original position.

<Door Lock-Releasing>

The operation that a locked state of a door 1 becomes an unlocked state by a key, a locking button, a knob, a door out lever sensor, arrive, and a preset critical value of a vehicle speed and the like will be described.

When a door lock-releasing (signal) is entered through the motor 1610, as illustrated in FIG. 28, the motor 1610 is operated and rotates the main gear 1630 in a clockwise direction.

When the main gear 1630 is rotated in a clockwise direction, the first stopping portion 1633 located in the rear side surface of the main gear 1630 pushes the main gear stopping portion 1502 and slides the locking plate 1500.

At this time, the locking plate 1500 is being moved to the left side, and the first stopping lever part 1450*a* and the second stopping lever part 1450*b* are separated from the insertion space 1509 of the lever guide portion 1507, and the stopping protrusion 1455 is moved towards the front direction thereby, and the stopping protrusion 1455 is caught by the first sub-locking member 1400*a* and the second sub-locking member 1400*b* respectively. Due to this action, the door 1 becomes lock released; therefore, the force will be transferred to the main locking member 1300 when the door lever (not shown) is being pulled.

The first stopping portion 1633 pushes the locking plate 1500 until the second sensing unit 1521 of the locking plated 1500 is detected by the third sensor 1905, and returns to its original position.

<Lock-Releasing of the Door from Inside the Vehicle Using Door in Lever>

As illustrated in FIG. 29, when the door 1 is in a locked state, as illustrated in FIG. 30, if the door in lever (not shown) is being pulled once, the first sub-locking member 1400*a* is being slided to the right side.

At this time, the manual locking member pressing portion 1407 of the first sub-locking member 1400*a* is slided towards the right side direction, and at the same time pushes the first stopping portion 1563 of the manual locking member 1560. Due to this action, the second stopping portion 1562 of the manual locking member 1560 id moved towards the left side direction according to "the principle of the lever." In addition, the second stopping portion 1562 moves the locking plate 1500 towards the left side direction.

As the locking plate 1500 is being moved to the left side, and the first stopping lever part 1450*a* and the second stopping lever part 1450*b* are separated from the insertion space 1509 of the lever guide portion 1507, and the stopping protrusion 1455 is moved towards the front direction by the second return spring 1460, and the stopping protrusion 1455 is caught by the first sub-locking member 1400*a* and the second sub-locking member 1400*b* respectively. Due to this action, the door 1 becomes lock released.

At this time, if the door in lever (not shown) is pulled one more time, the latch 1200 is separated from the locking portion 1371 of the locking member 1300, and the door 1 is opened thereby.

<Door Locking from Inside the Vehicle Using Child Locking Member>

When the first stopping lever part 1450*a* is caught by the first stopping threshold 1405*a*, and the second stopping lever part 1450*b* is caught by the second stopping threshold 4405*b*, which is a lock-released state of the door 1, the child lock protrusion 1453 of the first stopping lever part 1450*a* is disposed spaced apart in the left side of the child locking member 1700, as illustrated in FIG. 32.

In this state, when the child locking operation protrusion 1710 formed in the child locking member 1700 is pushed towards the left side, as illustrated in FIG. 33, the locking protrusion portion 1722 pushes the child lock protrusion 1453 towards the rear side direction.

Due to this operation, the first stopping lever part 1450*a* is separated from the first stopping threshold 1405*a*; and therefore the first locking member 1400*a* is not being slided together with the main locking member 1300.

That is, when the door in lever (not shown) is being pulled, only the first sub-locking member 1400*a* can be slided therefore the door can be locked from the inside.

Such a locked state can be released only when the child locking member 1700 is being slided towards the right side, the door 1 cannot be opened from the inside of the vehicle when it is in a child locking state, but the door 1 can be opened only from the outside of the vehicle. Thus, the children and the elderly can be protected from the accidents caused by the unexpected opening and closing of the door 1.

In addition, preferably, the door 1 locking function from inside the vehicle using the child locking member is installed only in the rear side seats.

<Door Opening when Motor Fails>

As illustrated in FIG. 34, the motor 1610 may fail under the situations like when the stopping portion 1631 is moved to the door closing position for automatically closing the door 1 using the motor 1610, or during moving, or during the time of returning to its basic position.

In such cases, when the door lever is being pulled, the locking member 1300 is moved to the right side so does the stopping portion pressing arm 1330 move to the right side.

Due to this operation, the stopping portion pressing arm 1330 presses the head portion 1631*a* of the stopping portion 1631. When the head portion 1631*a* is being pressed the head portion 1631*a* is moved towards the rear side direction further than the protrusion 1215 of the latch 1200, and so the coupling between the stopping portion 1631 and the latch 1200 is released thereby.

Later, as illustrated in FIG. 36, when the user pulls the door 1, the striker 1101 rotates the latch 1200 counterclockwise, and the door 1 is opened thereby.

In this way, even the driving unit 1600 fails during the time of closing the door 1 through the driving unit 1600 or after the door is closed, the door 1 can be manually opened by pulling the door lever.

When the user releases the door lever, the stopping portion 1621 is being slided by the return spring 1648 and returned to its original position.

<Installation of Door Latch System>

The door latch system 5 is installed in the center area of the opposite side of the portion 3 wherein the door is rotatably connected to the body of the vehicle. The door latch system 5 is disposed in a way that the upper surface is facing the inside of the vehicle, and the front surface is facing the body of the vehicle, and the rear side surface is facing the door 1. That is, the center portion of the rear side surface of the door latch system 5 is disposed so as to face the door window 2 when the door window 2 is coming down. When coming down, the door window 2 is not coming down straightly but coming down slantly. Due to this feature, when the door window 2 is coming down, the center portion of the left side of the rear side surface of the door latch system 5 is coming closer to the door window 2. Thus, if the center portion of the left side of the rear side surface of the door latch system 5 is backwardly protruded, it will encounter the coming door window 2. However, in the main gear 1630 disposed in the left rear side of the door latch system 5 according to the third exemplary embodiment of the present invention, the gear teeth 1638 are formed only in a portion of the right side of the outer circumferential surface, so that the gear teeth 1638 can be formed to be thick and the thickness of the left center portion of the main gear 4630 can be reduced while maintaining the durability thereof. Thus, the interference between the door window 2 and the door latch system 5 is prevented when the door latch system 5 is being installed in the door 1.

<Assembling of Door Latch System>

Assembling process of the above described door latch system according to the first exemplary embodiment is as follows.

Members (locking plate driving unit etc.) which are being installed in the rear side surface of the first housing 1110 are installed. Then, the third housing 1150 is coupled to the rear side surface of the first housing 1110 with bolts or rivets.

In addition, the main locking member 1300, the sub-locking member 1400, the child locking member 1700, and the like are installed in the front side of the first housing 1110. The latch 1200, the first return spring 1250, the rotating member 1370, and the rotating spring 1390 are installed in the rear side surface of the second housing 1130 by the first return spring stopping shaft 1251, the rotating shaft 1380, and the return spring stopping shaft 1391. In succession, the first housing 1110 and the second housing 1130 are coupled to each other with bolts or rivets, and the assembling is completed thereby.

Through such assembling process, the assembling of the door latch system may become more facilitated.

Embodiment 2

In describing the door latch system according to the second exemplary embodiment of the present invention, same symbols will be used for the same or the similar elements as those of the door latch system according to the first exemplary embodiment of the present invention, and the detailed description and illustration will be omitted.

As illustrated in FIGS. 40 and 41, the door latch system according to the second exemplary embodiment is characterized in that and further includes a locking driving unit 2650 for sliding of a locking plate 2500, wherein the locking driving unit 2650 and the locking plate 2500 is connected through a rack 2653 and a pinion 2652.

The locking driving unit 2560 includes a motor 2651, a pinion 2652 connected to the shaft of the motor 2561, and a rack 2653 geared with the pinion 2652.

The motor 2651 is disposed in the lower side of the locking plate 2500.

The shaft of the motor is disposed along the front and rear direction, so that the interference of the door with the other members can be minimized thereby.

The motor 2651 of the locking driving unit 2560 is provided in a size smaller than that of the motor 2610 of the driving unit 2600.

The motor 2651 is installed by being received in the locking motor receiving slot formed in the lower portion in the left lower side of the first housing 2110. The locking motor receiving slot is formed along the front and rear direction in a way that the rear side thereof is open.

The rack 2653 is disposed along the left-to-right direction.

The rack 2653 is installed at the left rear side of the locking plate 2500.

In the rack 2653, two installation holes are formed in the upper portion of the gear teeth; and in the locking plate 2500, installation protrusions 2654, which are to be inserted into the installation holes, are formed backwardly protruded. By these installation holes and the installation protrusions 2654, the rack 2653 is installed in the locking plate 2500.

Further, a reinforcing material is further formed along the left-to-right direction in the upper side and the lower side of the installation holes in the rear side of the rack 2653.

The main gear 2630 of the driving unit 2600 is formed so as not to interfere with the locking plate 2500. That is, the main gear 2630 only rotates the latch when rotating, and does not move the locking plate 2500. The exemplary embodiment as described above is separately provided with a driving unit 2600 for rotating the latch a locking driving unit 2650 and a locking driving unit 2650 for moving the locking plate 2500.

The locking driving unit 2650 and the locking plate 2500 are connected through the rack 2653 and the pinion 2652, so that the reverse rotation of the pinion 2651 becomes possible even the motor 2651 of the locking driving unit 2650 fails. Therefore, the user can manually move the locking plate 2500 through the lock-releasing cable 2810 and the like when the motor 2651 fails or no power is supplied to the vehicle, thereby enhancing the safety. In addition, the rack 2563 and the pinion 2652 of the present exemplary embodiment may be replaced by a worm and a worm gear having the shape of a straight line.

Hereinafter, an operational process of the door latch system according to the second exemplary embodiment of the present invention having the aforementioned configuration will be described.

<Door Locking>

As illustrated in the FIG. 41, the operation wherein the lock-released state of the door 1 becomes a locked state by a key, a locking button, a knob, a door out lever sensor, and presetting the critical speed of the vehicle and the like will be described.

When a door locking (signal) is entered through the motor 2561, as illustrated in FIG. 40, the motor 2561 is operated and rotates the pinion 2652.

When the pinion 2652 is rotated, the rack 2653 geared with the pinion 2652 is moving towards the right side. The locking plate 2500 is moving toward the right side as the rack 2653 is being moved, and the stopping protrusions are separated from the first sub-locking member and the second sub-locking member respectively. Due to this action, the door becomes locked; therefore, the force will not be transferred to the main locking member when the door lever (not shown) is being pulled.

<Door Lock-Releasing>

As illustrated in the FIG. 40, the operation wherein a locked state of the door becomes the lock-released state by a key, a locking button, a knob, a door out lever sensor, and presetting the critical speed of the vehicle and the like will be described.

When a door lock-releasing (signal) is entered through the motor 2561, as illustrated in FIG. 41, the motor 2561 is operated and rotates the pinion 2652 in the reverse direction.

When the pinion 2652 is rotated in the reverse direction, the rack 2653 geared with the pinion 2652 is moving towards the left side. The locking plate 2500 is moving toward the left side as the rack 2653 is being moved, and the stopping protrusions are caught by the first sub-locking member and the second sub-locking member respectively. Due to this action, the door becomes lock-released; therefore, the force will be transferred to the main locking member when the door lever (not shown) is being pulled.

<Door Lock-Releasing when Motor of the Locking Driving Unit Fails>

When no power is supplied to the motor 2561 of the locking driving unit 2560 due to the accident and the like, or the motor of the locking driving unit fails, the lock-releasing operation using the lock-releasing cable 2810 or the door in lever will be described.

When the user pulls the lock-releasing cable 2810 or the door in lever, since the reverse rotation becomes possible even when no power is supplied to the motor 2651, the locking plate 2500 is moved to the left side. Therefore, the locking of the door can be released.

Since the other operation is same as the above described first exemplary embodiment, the detailed description on this matter will be omitted.

Embodiment 3

In describing the door latch system according to the second exemplary embodiment of the present invention, same symbols will be used for the same or the similar elements as those of the door latch system according to the first and the second exemplary embodiments of the present invention, and the detailed description and illustration will be omitted.

As illustrated in FIGS. 42 and 43, another door latch system according to the present exemplary embodiment is characterized in that and further includes a driving unit 3600 for rotating the latch, wherein the driving unit 3600 includes a motor 3610 and a main gear 3630 being rotated by the motor 3610, and the motor 3610 and the main gear 3630 are connected through a first worm 3613, a first worm gear 3621 gearing with the first worm 3613, a second worm 3622, and a second worm gear 3638 gearing with the second worm 3622.

As illustrated in FIG. 42, a pressing portion reinforcing member 3331 made of a metal is inserted in the stopping portion pressing portion 3330 of the main locking member 3330. The pressing portion reinforcing member 3331 may be disposed in front of the main locking member 3300. Owing to such pressing portion reinforcing member 3331, the strength of the main locking member 3300 can be more enhanced.

A metal plate having the shape of a strip is provided as the pressing portion reinforcing member 3331 wherein a plurality of injection molding material through-holes is disposed spaced apart in lengthwise. The pressing portion reinforcing member 3331 is curvedly formed so as to correspond to the shape of the stopping portion pressing portion 3330.

The pressing portion reinforcing member 3331 is disposed across from the top end of the stopping portion pressing portion 3330 up to the top portion of the first sensing member 3350.

As illustrated in FIG. 43, the shaft of the motor 3610 is disposed along the left-to-right direction.

The main gear 3630 is rotated by the motor 3610, and in the front thereof, a stopping portion for rotating the latch is formed forwardly protruded. Since the stopping portion is same as that of the first exemplary embodiment described above, the detailed description on this matter will be omitted. The main gear 3630 rotates only the latch since it is not contacting with the locking plate as described in the second exemplary embodiment.

The second worm gear 3638 is formed in a portion of the circumferential surface of the main gear 3630.

The main gear 3630 is rotated around the center of the main gear shaft 3114 disposed along the front and rear direction.

The motor 3610 and the main gear 3630 are connected through a first worm 3613 installed in the shaft of the motor 3610, a first worm gear 3621 gearing with the first worm 3613, a second worm 3622 installed in the first worm gear 3621, and a second worm gear 3638 gearing with the second worm 3622 and formed in the main gear 3630.

That is, a reduction gear is disposed between the motor 3610 and the main gear 3630. The reduction gear includes a first worm gear 3621 and a second worm 3622 installed in the first worm gear 3621. The shaft of the reduction gear is disposed along the up-down direction. The first worm gear 3621 is disposed in the upper side of the second worm 3622 and integrally formed therewith.

Thus, the first worm 3613 is rotated when the motor 3610 is operated; the first worm gear 3621 is rotated as the first worm 3613 is rotated; the second worm 3622 integrally formed with the first worm gear 3621 is rotated when the first worm gear 3621 is rotated; and the main gear 3630 is rotated as the second worm 3622 is rotated.

The shaft of the reduction gear is rotatably installed in the reduction gear shaft supporting plates 3623. The reduction gear shaft supporting plates 3623 are disposed in the upper and the lower sides of the reduction gear respectively. In the rear side surface of the first housing 3110 and in the front surface of the third housing, the supporting plate insertion slots, wherein the reduction gear shaft supporting plates 3623 are inserted, are formed so that the reduction gear can be easily installed in the housing.

When such reduction gear is provided, the speed of the motor 3610 is greatly reduced so that the closing operation of the door through the motor 3610 is smoothly performed and the driving torque is secured as well. In addition, since the speed is reduced when closing the door, the door can be opened emergently when a safety related accident happens wherein a body or clothes are squeezed by the door.

Embodiment 4

In describing the door latch system according to the fourth exemplary embodiment of the present invention, same symbols will be used for the same or the similar elements as those of the door latch system according to the first, the second, and the third exemplary embodiments of the present invention, and the detailed description and illustration will be omitted.

As illustrated in FIGS. 44 and 51, a door latch system according to the present exemplary embodiment is characterized in that and further includes a driving unit 4600 for rotating the latch and a child locking member 4700 movably installed in the housing, wherein the driving unit 4600 moved the child locking member 4700.

The driving unit 4600 includes a motor 4610 and a main gear 4630 rotated by the motor 4610.

The shaft of the motor 4610 is disposed along the left-to-right direction.

A stopping portion 4631 rotating the latch is formed forwardly protruded in front of one side of the main gear 4630. Thus, the latch can be rotated through the main gear 4630.

Since the main gear 4630 is same as that of the first exemplary embodiment, the detailed description on this matter will be omitted.

A child locking member 4700, which will be described later, is caught by a first stopping portion 4633 and a second stopping portion 4635. That is, the child locking member 4700 is being slided towards the left side or the right side by the main gear 4630.

A reduction gear which is same as that of the third exemplary embodiment is disposed between the motor 4610 and the main gear 4630. Therefore the detailed description and operation of the reduction gear will be omitted.

The child locking member 4700 is installed in the rear side surface of the first housing 4110 of the housing in a way that it is movable along the left-to-right direction.

A child locking member receiving slot is formed in the rear side surface of the first housing 4110, wherein the child locking member receiving slot is formed so as to communicate with the locking member receiving slot. The child locking member receiving slot is formed to have an open rear side.

The child locking member 4700 is disposed in the lower side of the driving unit 4600, and in the rear side of the locking plate 4500.

The child locking member 4700 is formed to have the shape of a plate just like the locking plate 4500.

A main gear stopping protrusion 4710 being caught by the first stopping portion 4633 or the second stopping portion 4635 is formed in the upper left side of the child locking member 4700. The main gear stopping protrusion 4710 is formed protruded towards the rear side.

A third sensing unit installation portion 4740 is formed in the rear side of the center area of the child locking member 4700.

The third sensing unit installation portion 4740 is formed in the shape of a bar vertically disposed along the up-down direction, and a third sensing unit 4741 is installed in the lower end thereof. A magnet may be provided as the third sensing unit 4741.

A seventh sensor 4904 and an eighth sensor 4902 for detecting the third sensing unit 4741 are provided spaced apart along the left-to-right direction in the PCB 4900.

A child lock protrusion 4453 is formed upwardly protruded in the upper side of a first stopping lever part 4450*a* disposed in the upper side of the stopping lever unit.

A protrusion guide portion 4720 is formed in the right front surface of the third sensing unit installation portion 4740 in the child locking member 4700.

The protrusion guide portion 4720 is formed protruded towards the front direction (towards the first stopping lever part 4450*a*).

The protrusion guide portion 4720 is formed in the shape of a strip, and formed in a way that first, it is forwardly protruded and then bended towards the right side. Thereby, an insertion space, wherein the child lock protrusion 4453 is inserted, is formed between the protrusion guide portion 4720 and the front surface of the child locking member 4700. The insertion space is formed in a way that the upper side, the lower side, and the right side thereof are open.

An inclined surface is formed in the inner side surface (surface being contacted with the child lock protrusion 4453) of the protrusion guide portion 4720, and thus, the structure becomes simpler and the durability is enhanced as well. Due to such inclined surface, the thickness along the forward and rear direction of the right side of the protrusion guide portion 4720 becomes thicker as it travels towards the left side.

The rotation of the first stopping lever part 4450*a* of the stopping lever unit is accomplished as the protrusion guide portion 4720 guides the child lock protrusion 4453.

Further, a second stopper protrusion 4108 is protrudedly formed in the rear side surface of the first housing 1110 of the housing, and a second stop spring 4730 being elastically deformed by the second stopper protrusion 4108 is formed in the rear side of the child locking member 4700.

The second stopper protrusion 4108 is formed backwardly protruded in the rear side surface of the first housing 4110, and the second stop spring 4730 is formed in the right rear side surface of the child locking member 4700.

A stopper slotted hole 4701, through which the second stopper protrusion 4108 is penetrating, is formed along the left-to-right direction at the right side of the child locking member 4700.

A first link 4703, wherein the one side of the second stop spring 4730 is inserted, is backwardly protruded in the left side of the stopper slotted hole 4701 in the rear side surface of the child locking member 4700.

A second link 4702, wherein the other side (end) of the second stop spring 4730 is inserted, is backwardly protruded in the right side of the stopper slotted hole 4701 in the rear side surface of the child locking member 4700.

The second stop spring 4730 is formed by bending the middle portion of a metallic wire. Thus, the second stop spring 4730 is formed to have the shape of a pin ('⊂') in general. In this way, a wire form spring is provided as the second stop spring 4730.

A first insertion portion which is inserted into the first link 4703 is formed in the one side of the second stop spring 4730.

A first stop portion formed in the shape of an arc in a way that the upper and lower portion thereof is corresponding to the shape of the second stopper protrusion 4108 at the right side of the first insertion portion in the second stop spring 4730. The second stopper protrusion 4108 is received in the first stop portion when the child locking member 4700 is in the child lock position.

A second stop portion formed in the shape of an arc in a way that the upper and lower portion thereof is corresponding to the shape of the second stopper protrusion 4108 at the right side of the first insertion portion in the second stop spring 4730. The second stopper protrusion 4108 is received in the first stop portion when the child locking member 4700 is in the child lock-released position.

Elastic deforming portions, whose widths are smaller than those of the first stopping portion and the second stopping portion, are formed between the first stopping portion and the second stopping portion 4730.

A spring end portion is formed in the right side end of the second stopping portion 4730.

As described above, the second stop spring 4630 of the present exemplary embodiment is formed into the same or similar shape of the first stop spring of the first stop spring of the first exemplary embodiment.

The shape of the cross-section of the second stopper protrusion 4108 is formed to be the shape of a cylinder.

Thus, in order to move the child locking member 4700 from the child lock-released position to the child lock position (or to move towards the opposite direction), the elastic deforming portion should be elastically deformed so that the up-down distance of the elastic deforming portion is enlarged, then the child locking member 4700 can be moved thereafter. That is, in order to move the child locking member 4700 from the child lock-released position to the child lock position, or in order to move the child locking member 4700 from the child lock position to the child lock-released position, the child locking member 4700 must be slided with the force strong enough to elastically deform the elastic deforming portion of the second stop spring 4730.

<Door Locking from Inside the Vehicle Using Child Locking Member>

When the driver inputs a door lock signal from inside the vehicle through button and the like using the child locking member 4700, the motor 4610 of the driving unit 4600 is operated. As illustrated in FIG. 48(*b*), when the motor 4610 is operated the main gear 4630 is rotated. When the main gear rotates 4630 the main gear stopping protrusion 4710 is caught by the second stopping portion 4635, and the child locking member 4700 is slided towards the right side.

In this way, when the child locking member 4700 is slided, as illustrated in FIG. 49, the child lock protrusion 4453 of the first stopping lever part 4450*a* is caught by the protrusion guide portion 4720 and guided towards the rear side. Due to this action, the first stopping lever part 4450*a* is separated from the first stopping threshold of the first sub-locking member. The first sub-locking member and the main locking member 4300 are separated, and thus the first sub-locking member and the main locking member 4300 are not slided together.

Meanwhile, the motor 4610 is operating until the third sensing unit 4741 is detected by the eighth sensor 4902.

In this way, after the child locking is enforced automatically through the driving unit 4600, as illustrated in FIG. 48(*c*), the motor 4610 is rotated reversely and moved towards its basic position.

<Door Lock-Releasing from Inside the Vehicle Using Child Locking Member>

When the driver inputs a door lock-releasing signal from inside the vehicle through button and the like using the child locking member 4700, the motor 4610 of the driving unit 4600 is operated. As illustrated in FIG. 48(*b*), when the motor 4610 is operated the main gear 4630 is rotated. When the main gear rotates 4630 the main gear stopping protrusion 4710 is caught by the first stopping portion 4633, and the child locking member 4700 is slided towards the left side.

In this way, when the child locking member 4700 is slided, as illustrated in FIG. 51, the child lock protrusion 4453 of the first stopping lever part 4450*a* is separated the protrusion guide 4720 and the right side of the first stopping lever part 4450*a* is moved towards the front due to the elastic force of the second return spring. Due to this action, the first stopping lever part 4450*a* is caught by the first stopping threshold of the first locking member. The first sub-locking member and the main locking member 4300 are connected, and thus the first sub-locking member and the main locking member 4300 are slided together.

Meanwhile, the motor 4610 is operating until the third sensing unit 4741 is detected by the seventh sensor 4904.

In this way, after the child lock-releasing is enforced automatically through the driving unit 4600, as illustrated in FIG. 50(*c*), the motor 4610 is rotated reversely and moved towards its basic position.

Since the operation of rotating the latch when the door is closed through the driving unit 4600 is same as the first exemplary embodiment, the detailed description on this matter will be omitted.

Embodiment 5

In describing the door latch system according to the fifth exemplary embodiment of the present invention, same symbols will be used for the same or the similar elements as those of the door latch system according to the first, the second, the third, and the fourth exemplary embodiments of the present invention, and the detailed description and illustration will be omitted.

As illustrated in FIGS. 52 to 54, the door latch system according to the exemplary embodiment further includes a driving unit for driving the latch 5200, wherein the driving unit includes a motor 5610, and the latch 5200 is rotated by the motor 5610, and the motor 5610 and the latch 5200 are connected through a spur gear.

Only a horizontal bar 5340 is formed at the left side of the main locking member 5300. That is the stopping portion pressing portion of the first exemplary embodiment is not formed.

The driving unit includes a motor 5610 and a main gear 5630 rotated by the motor 5610.

The driving unit is disposed in the upper side of the locking plate 5500.

The shaft of the motor 5610 is disposed along the front and rear direction.

A spur gear 5613 is installed in the shaft of the motor 5610. The shaft of the spur gear 5613 is also disposed along the front and rear direction.

The motor 5610 is installed in a first housing 5110 through a motor supporting protrusion portion 5102 formed backwardly protruded in the rear side surface of the first housing 5110.

A motor supporting surface is formed inside the motor supporting protrusion portion 5102 so as to correspond to the shape of the motor 5610. The motor supporting surface is contacted to the motor 5610. In addition, a motor insertion slot, wherein the motor supporting protrusion portion 5102 and the motor 5610 are inserted, is formed in the third housing.

A stopping portion 5631 rotating the latch 5200 is formed forwardly protruded in the front of the left lower portion of the main gear 5630.

The main gear 5630 is rotated around the center of the main gear shaft disposed along the front and rear direction.

A spur gear is provided as the main gear 5630, and the gear teeth 5638 is formed only in a portion of the circumferential surface.

A plurality of sub-gears 5620 is disposed between the motor 5610 and the main gear 5630.

Each of the sub-gears 5620 comprises a spur gear of a small diameter and a spur gear of a large diameter through a same axis. The sub-gear is integrally formed with a gear of a small diameter and a gear of a large diameter.

The spur gear 5613 is geared with the gear of large diameter of the sub-gear 5620.

The main gear 5630 is geared with the gear of small diameter of the sub-gear 5620.

The sub-gears 5620, wherein a gear of small diameter and a gear of large diameter are integrally formed, are provide in multiple numbers and can be interlocked to each other.

A small diameter gear of a sub-gear 5620 is interlocked with a large diameter gear of another sub-gear 5620, and a small diameter gear of the another sub-gear 5620 is interlocked with a large diameter gear of yet another sub-gear 5620, and in this way, the speed is reduced by a plurality of sub-gears.

In this way, the rate of gear reduction can be adjusted through the multiple numbers of the spur gears interlocked to one another.

In this way, since the motor 5610 and the main gear 5639 are connected through the spur gear 5613, the reverse rotation of the main gear 5630 becomes possible even when the motor 5610 fails. Therefore, the door can be opened through the following procedure when the motor 5610 fails even when it is moved to the door closing position.

When the user pulls the door lever, the holding of the latch 5200 is released by the rotation of the rotating member 5370. At this state, if the user pulls the door in the direction of door opening, the striker 1101 is lifted thereby, and the door is opened since the latch 5200 is rotated towards the direction of door opening. In this way, the safety of the door latch system of the exemplary embodiment is enhanced since the door can be manually opened even when the motor 5610 fails.

Further, a first stopping portion and a second stopping portion, wherein the locking plate 5500 is caught by, are formed in the main gear 5630 as described as in the first exemplary embodiment. Thus, when the main gear 5630 is rotated due to the motor 5610 operation, the locking plate 5500 can be moved towards the left side or the right side.

Therefore, the driving unit can not only rotate the latch 5200 but also move the locking plate 5500, so that the door closing, door locking, and door lock-releasing can be automatically accomplished as in the first exemplary embodiment.

Embodiment 6

In describing the door latch system according to the sixth exemplary embodiment of the present invention, same symbols will be used for the same or the similar elements as those of the door latch system according to the first, the second, the third, the fourth, and the fifth exemplary embodiments of the present invention, and the detailed description and illustration will be omitted.

As illustrated in FIGS. 55 to 59, the door latch system of the present invention according to the sixth exemplary embodiment of the present invention is characterized in that and includes: a housing; a latch 6200 rotatably installed in the housing; a main locking member 6300 slidingly installed in the housing for locking the latch; a sub-locking member slidingly installed in the housing and disposed at one side of the main locking member 6300; a stopping lever unit 6450 rotatably installed in any one of the main locking member and the sub-locking member wherein a stopping protrusion is formed; a stopping threshold formed in the other one of the main locking member 6300 and the sub-locking member wherein a stopping protrusion is being caught by; and a locking plate 6500 slidingly installed in a housing for rotating the stopping lever unit 6450, wherein a lever guide portion is formed in the locking plate 6500, and a guide bar is formed in the stopping lever unit 6450, so that the rotation of the stopping lever unit 6450 is accomplished as the guide bar is guided by the lever guide portion, and thus it becomes a door locking state or a door lock-releasing state, and a locking driving unit which releases the connection between the main locking member 6300 and the sub-locking member, or connects the main locking member 6300 and the sub-locking member, by moving the locking plate 6500.

As illustrated in FIG. 55, the main locking member 6300 is same as that of the first exemplary embodiment, however, only a horizontal bar 6340 is formed at the left side thereof. That is the stopping portion pressing portion of the first exemplary embodiment is not formed in the main locking member 6300.

As illustrated in FIG. 56, the locking driving unit includes a motor 6610 and a main gear 6630 rotated by the motor 5610. The locking driving unit is connected to the control unit (ECU) installed in the vehicle, and controlled by the control unit installed in the vehicle.

The motor 6610 is installed in the rear side surface of the first housing 6110 of the housing. The motor 6610 is disposed in the right upper portion of the first housing 6110. The shaft of the motor 6610 is disposed horizontally along the left-to-right direction. A small motor is provided as the motor 6610 since it only plays the role of locking or lock-releasing of the door. Thus, the door latch system can be maintained in a compact form and the manufacturing cost can be reduced.

A worm 6613 is installed in the shaft of the motor 6610. Thus, the shaft of the worm 6613 is disposed along the left-to-right direction.

The main gear 6630 is a worm gear gearing with the worm 6613. Thus, the motor 6610 and the main gear 6630 are connected through a worm 6613 and a worm gear gearing with the worm 6613. Owing to this, the door latch system is maintained in a compact form, and the structure thereof can be simplified as well.

The main gear 6630 is rotatably installed in the rear side surface of the first housing 6110. The main gear 6630 is disposed in the center portion of the first housing 6110, and disposed in the upper portion of the locking plate 6500. The main gear 6630 is disposed in the lower side of the motor 6610.

In the main gear 6630, a geared portion 6632, wherein gear teeth are formed, is formed in a portion of the peripheral surface thereof, and a non-geared portion is formed in a portion of the remaining portion of the peripheral surface.

The geared portion 6632 is formed in a portion of the upper portion and the lower portion of the main gear 6630. The non-geared portion is formed in a portion of the lower portion of the main gear 6630.

An opening is formed in the lower portion of the main gear 6630. The opening is formed in a way that the front, the rear, and the bottom sides thereof are open. Due to such an opening, a first stopping portion 6633 and the second stopping portion 6635 are formed in the main gear 6630 for sliding the locking plate 6500 which will be described later. The first stopping portion 6633 is disposed in the right side of the opening, and the second stopping portion 6635 is disposed in the left side of the opening.

The circumference of the insertion hole, wherein the shaft is inserted, and the geared portion 6632, and the first and the second stopping portions 6633 and 6635 are formed to be thicker than the other portions of the main gear 6630. Thus, the light weight of the main gear 6630 is maintained, and the durability is maintained as well.

A gear return spring 6650, which returns the main gear 6630 to the basic position, is provided.

A coil spring is provided as the gear return spring 6650. Preferably, the gear return spring 6650 is curvedly formed in the shape of an arc.

A gear return spring slot 6647, wherein the gear return spring 6650 is received, is formed in the front surface of the main gear 6630. The gear return spring slot 6647 is curvedly formed in the shape of an arc, and the front side thereof is open. That is, the portion facing the first housing 6110 in the gear return spring slot 6647 is open.

In addition, a pushing rib 6140 is protrudedly formed towards the rear side in the rear surface of the first housing 6110. The pushing rib 6140 is formed in the shape of an arc whose upper portion is open. The pushing rib 6140 is disposed between the insertion hole, wherein the shaft of the main gear 6630 is inserted, and the geared portion 6632, and the first and the second stopping portions 6633 and 6635.

In the main gear 6630, two rib insertion slots 6648, wherein the pushing rib 6140 is inserted, are respectively formed in each of the both side surfaces which form the gear return spring slot 6647, and communicate with the gear return spring slot 6647.

As illustrated in FIG. 56, the locking plate 6500 is disposed in the lower portion of the main gear 6630 along the left-to-right direction.

As illustrated in FIG. 58, the locking plate 6500 includes, an lock-releasing cable connecting portion 6501, a lever guide portion 6507 disposed in the right side of the lock-releasing cable connecting portion 6501, a manual locking guide slotted hole 6515 disposed in the right side of the lever guide portion 6507, and a first stop spring 6570.

A stopping protrusion 6506 is formed downwardly protruded in the lower portion of the locking plate 6500 so as to be disposed in the right side of the lock-releasing cable connecting portion 6501. The stopping protrusion 6506 is inserted into the key connect opening of the key connect.

In the upper portion of the locking plate 6500, a main gear stopping portion 6502 is formed upwardly protruded so as to be disposed between the stopping protrusion 6506 and the hook guiding portion 6507. The main gear stopping portion 6502 is inserted into the opening of the main gear 6630. Thus, when the main gear 6630 is rotated, the main gear stopping portion 6502 is caught by the main gear 6630, and the locking plate 6500 is being slid towards the left side or the right side. When the locking plate 6500 is moved to the right side, the stopping lever unit 6450 is released from the stopping threshold of the sub-locking member, and the main locking member 6300 and the sub-locking member are disconnected from each other thereby. When the locking plate 6500 is moved to the left side, the stopping lever unit 6450 is caught by the stopping threshold of the sub-locking member, and the main locking member 6300 and the sub-locking member are connected to each other thereby.

An electrical connecting member 6572 is installed in the front surface of the locking plate 6500 which is a surface facing the first housing 6110. The electrical connecting member 6572 may be made of a metal plate which conducts electricity and disposed along the up-down direction.

Inside the first housing 6110, a first, a second, and a third electrical wires 921, 922, and 923 are installed in the rear surface facing the front surface of the locking plate 6500. The first, the second, and the third electrical wires 921, 922, and 923 are connected to the control unit which is installed inside the vehicle.

The first, the second, and the third electrical wires 921, 922, and 923 are inserted into the first housing 6110 and installed thereby.

The ends of the first, the second, and the third electrical wires 921, 922, and 923 are externally exposed through the opening which is a cutoff area of a portion of the rear surface of the first housing 6110. The (upper) ends of the first, the second, and the third electrical wires 921, 922, and 923 are horizontally disposed.

The (lower) end of the second electrical wire 922 is disposed above the (lower) ends of the first electrical wire 921 and the third electrical wire 923.

The (lower) ends of the first electrical wire 921 and the third electrical wire 923 disposed spaced apart along the horizontal direction (left-to-right direction) which is the direction along which the locking plate 6500 is being slided.

When the locking plate 6500 is being slid, the electrical connecting member 6572 connects the first and the second electrical wires 921 and 922, or connects the second and the third electrical wires 922 and 923.

Hereinafter, operation process of the door latch system having the above described configuration and according the sixth exemplary embodiment of the present invention will be described.

<Door Closing>

When the user closes the door which is opened, the striker 1101 installed in the vehicle body presses the latch 6200, and then the latch 6200 is rotated in a clockwise direction thereby.

The locking portion of the rotating member 6370 is inserted into the locking slot of the latch 6200, and the door is closed thereby.

<Door Locking>

The operation wherein the lock-released state of the door becomes a locked state by a key, a locking button, a knob, a door out lever sensor, and presetting the critical speed of the vehicle and the like will be described.

When a door locking (signal) is entered through the motor 6610, the motor 6610 is operated and rotates the main gear 6630 in a counterclockwise direction.

When the main gear 6630 is rotated in a counterclockwise direction, the second stopping portion 6635 pushes the main gear stopping portion 6502 of the locking plate 6500 and slides the locking plate 6500.

When the locking plate 6500 is moved to the right side, the stopping lever unit 6450 is released from the stopping threshold of the sub-locking member, and the connection between the main locking member 6300 and the sub-locking member is released. Due to this action, the state of the door becomes a locked state, therefore, the force will not be transferred to the main locking member 6300 when the door lever (not shown) is being pulled.

The motor 6610 is operating until the electrical connecting member 6572 installed in the locking plate 6500 connects the second electrical wire 922 and the third electrical wire 923 to each other. Later, the motor 6610 stops its operation.

When the main gear 6630 is being rotated in the counterclockwise direction, the pushing rib 6140 presses the gear return spring 6650, and the gear return spring 6650 is compressed thereby. When the force rotating the main gear 6630 is removed (when the operation of the motor 6610 is stopped), the main gear 6630 is returned to the original position due to the restoring force of the compressed gear return spring 6650.

<Door Lock-Releasing>

The operation wherein the locked state of the door becomes a lock-released state by a key, a locking button, a knob, a door out lever sensor, and presetting the critical speed of the vehicle and the like will be described.

When a door lock-releasing (signal) is entered through the motor 6610, the motor 6610 is operated and rotates the main gear 6630 in a clockwise direction.

When the main gear 6630 is rotated in a clockwise direction, the first stopping portion 6633 pushes the main gear stopping portion 6502 of the locking plate 6500 and slides the locking plate 6500.

At this time, the locking plate 6500 is moved to the left side, the stopping lever unit 6450 is caught by the stopping threshold of the sub-locking member, and the main locking member 6300 and the sub-locking member are connected to each other thereby. Due to this action, the state of the door becomes a lock-released state, and therefore the force will be transferred to the main locking member 6300 when the door lever is being pulled.

The motor 6610 is operating until the electrical connecting member 6572 installed in the locking plate 6500 connects the second electrical wire 922 and the first electrical wire 921 to each other. Later, the motor 6610 stops its operation.

When the main gear 6630 is being rotated in the clockwise direction, the pushing rib 6140 presses the gear return spring 6650, and the gear return spring 6650 is compressed thereby. When the force rotating the main gear 6630 is removed (when the operation of the motor 6610 is stopped), the main gear 6630 is returned to the original position due to the restoring force of the compressed gear return spring 6650.

<Door Opening>

When the door is in an unlocked state, if the door lever is being pulled by the user, the door lever connecting unit pulls the sub-locking member and the main locking member 6300 to the right side. Due to this action, the locking portion of the rotating member 6370 is released from the locking slot of the latch 6200. At this time, the latch 6200 is returned to the original position by the first return spring. Thus, the striker 1101 can be released from the door latch system.

Since the process of door locking from inside the vehicle using child locking member and the process of door lock-releasing from inside the vehicle using the door in lever are same as the above described first exemplary embodiment, description on this matter will be omitted.

Embodiment 7

In describing the door latch system according to the seventh exemplary embodiment of the present invention, same symbols will be used for the same or the similar elements as those of the door latch system according to the first, the second, the third, the fourth, the fifth, and the sixth exemplary embodiments of the present invention, and the detailed description and illustration will be omitted.

As illustrated in FIG. 60, the door latch system of the present exemplary embodiment, the gear return spring for returning of the main gear 7630 of the locking driving unit is excluded.

All of the elements of the door latch system according to the seventh exemplary embodiment are same as those of the sixth exemplary embodiment except that the gear return spring is excluded.

Hereinafter, the operation of the door latch system according to the seventh exemplary embodiment will be described.

<Door Locking>

The operation wherein the lock-released state of the door becomes a locked state by a key, a locking button, a knob, a door out lever sensor, and presetting the critical speed of the vehicle and the like will be described.

When a door locking (signal) is entered through the motor 7610, the motor 7610 is operated and rotates the main gear 7630 in a counterclockwise direction.

When the main gear 7630 is rotated in a counterclockwise direction, the second stopping portion pushes the main gear stopping portion 7502, and the locking plate is being slided.

When the locking plate is moved to the right side, the stopping lever unit is released from the stopping threshold of the sub-locking member, and the connection between the main locking member and the sub-locking member is released. Due to this action, the state of the door becomes a locked state; therefore, the force will not be transferred to the main locking member when the door lever (not shown) is being pulled.

The motor 7610 is operating until the electrical connecting member installed in the locking plate connects the second electrical wire and the third electrical wire to each other. Later, the motor 7610 stops its operation.

<Door Lock-Releasing>

The operation wherein the locked state of the door becomes a lock-released state by a key, a locking button, a knob, a door out lever sensor, and presetting the critical speed of the vehicle and the like will be described.

When a door lock-releasing (signal) is entered through the motor 7610, the motor 7610 is operated and rotates the main gear 7630 in a clockwise direction.

When the main gear 7630 is rotated in a clockwise direction, the first stopping portion pushes the main gear stopping portion 7502 and slides the locking plate.

At this time, the locking plate is moved to the left side, the stopping lever unit is caught by the stopping threshold of the sub-locking member, and the main locking member and the sub-locking member are connected to each other thereby. Due to this action, the state of the door becomes a lock-released state, and therefore the force will be transferred to the main locking member when the door lever is being pulled.

The motor 7610 is operating until the electrical connecting member installed in the locking plate connects the second electrical wire and the first electrical wire to each other. Later, the motor 7610 stops its operation.

Embodiment 8

In describing the door latch system according to the eighth exemplary embodiment of the present invention, same symbols will be used for the same or the similar elements as those of the door latch system according to the first, the second, the third, the fourth, the fifth, the sixth, and the seventh exemplary embodiments of the present invention, and the detailed description and illustration will be omitted.

As illustrated in FIG. 61, the door latch system according to the exemplary embodiment of the present invention is characterized in that and includes a locking driving unit 8650 for sliding the locking plate 8500, and the locking driving unit 8650 and the locking plate 8500 are connected through a rack 8653 and a pinion 8652. In addition, the rack 8563 and the pinion 8652 of the present exemplary embodiment may be replaced by a worm and a worm gear having the shape of a straight line.

The locking driving unit 8650 includes a motor 8651, a pinion 8652 connected to the shaft of the motor 8651, and a rack 8653 gearing with the pinion 8652.

The motor 8651 is disposed in the lower side of the center of the locking plate 8500.

Since the shaft of the motor 8651 is disposed along the front and rear direction, the interference of the door with other members can be minimized.

A small motor is provided as the motor 8651 of the locking driving unit 8650.

The motor 8651 is installed by being received in the locking motor receiving slot formed in the lower side of the center of the rear of the first housing. The locking motor receiving slot is formed along the front and rear direction in a way that the rear side thereof is open.

The rack 8653 is disposed along the left-to-right direction.

The rack 8653 is disposed in the rear side of the center of the locking plate 8500.

In the rack 8653, two installation holes are formed in the upper portion of the gear teeth; and in the locking plate 8500, installation protrusions 8654, which are to be inserted into the installation holes, are formed backwardly protruded. By these installation holes and the installation protrusions 8654, the rack 8653 is installed in the locking plate 8500.

Further, a reinforcing material is further formed along the left-to-right direction in the upper side and the lower side of the installation holes in the rear side of the rack 8653.

Embodiment 9

In describing the door latch system according to the ninth exemplary embodiment of the present invention, same symbols will be used for the same or the similar elements as those of the door latch system according to the first, the second, the third, the fourth, the fifth, the sixth, the seventh, and the eighth exemplary embodiments of the present invention, and the detailed description and illustration will be omitted.

As illustrated in FIG. 62, the door latch system according to the exemplary embodiment of the present invention is characterized in that and includes a locking driving unit 9650 for sliding the locking plate 9500, and the locking driving unit 9650 and the locking plate 9500 are connected through a rack 9653 and a pinion 9652.

The locking driving unit 9650 includes a motor 9651, a pinion 9652 connected to the shaft of the motor 9651, and a rack 9653 gearing with the pinion 9652. In addition, the rack 9563 and the pinion 9652 of the present exemplary embodiment may be replaced by a worm and a worm gear having the shape of a straight line.

The motor 9651 is disposed in the upper center portion of the locking plate 9500.

Since the shaft of the motor 9561 is disposed along the up-down direction, the width of the door latch system along the front and rear side direction can be minimized.

A small motor is provided as the motor 9651 of the locking driving unit 9650.

The motor 9651 is installed by being received in the locking motor receiving slot formed in the lower side of the center of the rear side of the first housing 9110. The locking motor receiving slot is formed along the front and rear side direction in a way that the rear side thereof is open. A motor supporting protrusion portions 9107 disposed in both side of the motor 9651 are formed backwardly protruded in the rear side surface of the first housing 9110.

The rack 9653 is disposed along the left-to-right direction.

The rack 9653 is disposed in the center of the locking plate 9500.

In the rack 9653, two installation holes are formed in the upper portion of the gear teeth; and in the locking plate 9500, installation protrusions, which are to be inserted into the installation holes, are formed upwardly protruded. In addition, a rack receiving slot wherein the lack 9653 is received is formed in the upper portion of the locking plate 9500. By these installation holes and the installation protrusions, the rack 9653 is installed in the locking plate 9500. Also, the rack 9653 may be integrally formed with the locking plate 9500.

Embodiment 10

In describing the door latch system according to the tenth exemplary embodiment of the present invention, same symbols will be used for the same or the similar elements as those of the door latch system according to the first, the second, the third, the fourth, the fifth, the sixth, the seventh, the ninth, and the tenth exemplary embodiments of the present invention, and the detailed description and illustration will be omitted.

As illustrated in FIGS. 63 to 68, the door latch system according to the exemplary embodiment of the present invention further includes a child locking member 700, a child locking driving unit for moving the child locking member 700, wherein a protrusion guide portion 720 is formed in the child locking member 700, and a child lock protrusion 453 is formed in the stopping lever unit, so that the rotation of the stopping lever unit can be accomplished as the protrusion guide portion guides the child lock protrusion 453.

As illustrated in FIG. 63, the child locking member 700 is installed in the rear side surface of the first housing 110 of the housing in a way that it is slidable (movable) along the left-to-right direction.

The child locking member 700 is disposed in the upper side of the child locking member 700.

A child locking member receiving slot wherein the child locking member receiving slot is formed is formed in the rear side surface of the first housing 110, wherein the child locking member receiving slot is formed to be communicating with the locking member receiving slot wherein the stopping lever unit is received. The child locking member receiving slot is formed to have an open backside.

A child lock protrusion 453 is formed upwardly protruded in the upper right side of a first stopping lever part **450*a* of the stopping lever unit. The first stopping lever part 450*a* is disposed in a location further forward in the front side of the child locking member 700**.

As illustrated in FIG. 64, a protrusion guide portion 720 is formed forwardly protruded in the front surface of the child locking member 700. The protrusion guide portion 720 is formed in a way that first, it is forwardly protruded and then bended towards the left side. Thereby, an insertion space, wherein the child lock protrusion 453 is formed in a way that the upper side, the lower side, and the left side thereof are open.

The rotation of the first stopping lever part **450*a* can be accomplished as the protrusion guide portion 720 guides the child lock protrusion 453**.

The child locking member 700 and the child lock motor 750 of the child locking driving unit, which will be described later, are connected through the child rack 710 and the child pinion.

A child rack 710 is formed in the rear side of the child locking member 700.

The child rack 710 is disposed along the left-to-right direction. Accordingly, the child locking member 700 is formed to have the shape of Korean alphabet letter 'ㄷ' (a rectangle without one side) in general when viewed in a plan view.

The child rack 710 is exposed towards the backside of the first housing 110.

An electrical connecting member 741 is formed upwardly protruded in the right upper side of the child locking member 700. The electrical connecting member 741 is formed of an electrically conducting material such as a metal. The electrical connecting member 741 is formed in length along the front and rear side direction.

The child locking driving unit moves the child locking member 700 including a child lock motor 750 along the left-to-right direction.

A child pinion 751 is installed in the shaft of the child lock motor 750.

The child pinion 751 is gearing with the child rack 710. In addition, the child rack 710 and the child pinion 751 may be replaced by a child worm and a child worm gear having the shape of a straight line.

Further, in the first housing 110, a first, a second, and a third child electrical wires 91, 92, and 93 are installed in the inner surface facing the upper surface of the child locking member 700. The first, the second, and the third child electrical wires 91, 92, and 93 are disposed inside the child locking member receiving slot. The first, the second, and the third child electrical wires 91, 92, and 93 are disposed in the upper side of the electrical connecting member 741.

The first, the second, and the third child electrical wires 91, 92, and 93 are connected to a control unit installed in the vehicle.

The first, the second, and the third child electrical wires 91, 92, and 93 are insertingly formed in the first housing 110.

The ends of the first, the second, and the third child electrical wires 91, 92, and 93 are externally exposed through the portion wherein a portion of the inner surface of the first housing 110. The ends of the first, the second, and the third child electrical wires 91, 92, and 93 are disposed along the horizontal direction.

The ends of the second child electrical wire 92 are disposed in the front side of the first and the third child electrical wires 91 and 93 respectively.

The ends of the first and the third child electrical wires 91 and 93 are disposed spaced apart along the horizontal (left-to-right) direction which is the direction along which the child locking member 700 is being slided.

When the child locking member 700 is being slided, the electrical connecting member 741 connects the first and the second child electrical wires 91 and 92, or connects the second and the third child electrical wires 92 and 93.

<Door Locking from Inside the Vehicle Using Child Locking Member>

When the driver inputs a door lock signal from inside the vehicle through button and the like using the child locking member 700, the child lock motor 750 of the child locking driving unit is operated. When the child lock motor 750 is operated the child pinion 751 is rotated. When the child pinion 751 rotates, the child rack 710 gearing with the child pinion 751 is moved towards the left direction. The child locking member 700 wherein the child rack 710 is integrally formed also moves towards the left direction.

In this way, when the child locking member 700 is slided, as illustrated in FIG. 67, the child lock protrusion 453 of the first stopping lever part 450*a* is caught by the protrusion guide portion 720 and guided towards the backside. Due to this action, the first stopping lever part 450*a* is separated from the first stopping threshold of the first sub-locking member. The first sub-locking member and the main locking member are separated, and thus the first sub-locking member and the main locking member are not slided together.

Meanwhile, the child lock motor 750 is operating until the electrical connecting member 741 connects the second and the third electrical wires 92 and 93 to each other.

<Door Lock-Releasing from Inside the Vehicle Using Child Locking Member>

When the driver inputs a door lock-releasing signal from inside the vehicle through button and the like using the child locking member 700, the child lock motor 750 of the child locking driving unit is operated. When the child lock motor 750 is operated the child pinion 751 is rotated. When the child pinion 751 rotates in the reverse direction, the child rack 710 gearing with the child pinion 751 is moved towards the right direction. The child locking member 700 wherein the child rack 710 is integrally formed also moves towards the right direction.

In this way, when the child locking member 700 is slided, as illustrated in FIG. 68, the child lock protrusion 453 of the first stopping lever part 450*a* is separated from the protrusion guide portion 720, and then the right side of the first stopping lever part 450*a* is moved forward due to the elastic force of the second return spring. Due to this action, the first stopping lever part 450*a* is caught by the first stopping threshold of the first sub-locking member. The first sub-locking member and the main locking member are connected, and thus the first sub-locking member and the main locking member are slided together.

Meanwhile, the child lock motor 750 is operating until the electrical connecting member 741 connects the first and the second electrical wires 91 and 92 to each other.

Embodiment 11

In describing the door latch system according to the eleventh exemplary embodiment of the present invention, same symbols will be used for the same or the similar elements as those of the door latch system according to the first, the second, the third, the fourth, the fifth, the sixth, the seventh, the ninth, the tenth, and the eleventh exemplary embodiments of the present invention, and the detailed description and illustration will be omitted.

As illustrated in FIGS. 69 to 71, according to the door latch system of the present exemplary embodiment, a lock-releasing cable 4810' is installed in a locking plate 4500', and a direction switch unit 20 is installed between the lock-releasing cable 4810' and a knob 6.

The driving unit including a motor 4610' moves a child locking member 4700' and closes the door 1 automatically by rotating the latch as described in the fourth exemplary embodiment.

The motor 4610' is disposed in the upper side of the child locking member 4700' and a locking plate 4500'. The motor 4610' is installed in the upper rear surface of a first housing 4110'.

A latch is installed in the left front surface of the first housing 4110'.

The child locking member 4700' is installed in the rear surface of the first housing 4110' in a way that it is slidable along the left-to-right direction.

A PCB 4900' is disposed in the lower side of the child locking member 4700' and the locking plate 4500'. The PCB 4900' is installed in the lower side of the right rear side of the first housing 4110'.

As illustrated in FIG. 69, the locking plate 4500' is formed to have the shape of a plate and installed in the rear side of the first housing 4110' in a way that it is slidable along the left-to-right direction. The locking plate 4500' is disposed in the rear side of the child locking member 4700'.

A lock-releasing cable connecting portion 4501' wherein a lock-releasing cable 4810' is installed is formed in the right rear side surface of the locking plate 4500'.

In the locking plate 4500', a worm gear 4563' which will be described later, a second sensing member, a lever guide portion, a lock-releasing cable connecting portion 4501', and a manual locking guide slotted hole is sequentially disposed from the left side. Due to this, the lock-releasing cable 4810' is being pulled out together with a door lever connecting portion 4800' towards the right side of the first housing 4110'.

A lock-releasing cable 4810' is connected to the left end of the lock-releasing cable connecting portion 4501' so that when a knob 6 and the like is operated, the locking plate 4500' is moved towards the left side or the right side as the lock-releasing cable 4810' is being pulled towards the left side or the right side.

A first stopping member receiving slot, wherein the first stopping member of the lock-releasing cable 4810' is received is formed in the rear side of the lock-releasing cable connecting portion 4501'. Therefore, the assembling of the lock-releasing cable 4810' to the locking plate 4500' becomes easier.

The stopping member of the lock-releasing cable 4810' is formed in the shape of a long cylinder along the up-down direction.

A direction switch unit 20 includes a direction switch housing and a switching lever 30 which is rotatably installed in the direction switch housing.

As illustrated in FIG. 70, the direction switch housing includes a first direction switch housing 21, and a second direction switch housing 22 covering the rear side of the first direction switch housing 21.

A receiving slot is formed in the rear side surface of the first direction switch housing 21 for receiving individual elements respectively. The receiving slot is formed to have an open rear side.

A first guide slot 24 for guiding the knob 6 and a second guide slot 23 for guiding a cable block 40 connected to the lock-releasing cable 4810' are formed in the first direction switch housing 21.

A second stopping member receiving slot 41 wherein the second stopping member of the lock-releasing cable 4810' is received is formed in the rear side surface of the cable block 40. Therefore, the lock-releasing cable 4810' is connected to the cable block 40.

The first guide slot 24 and the second guide slot 23 are formed along the left-to-right direction. The withdrawing holes, through which the knob 6 or the lock-releasing cable 4810' is withdrawn, are communicatingly formed in the right and the left sides of the first guide slot 24 and the second guide slot 23 respectively.

The first guide slot 24 is disposed in the lower side of the second guide slot 23.

Sliding protrusions, which are inserted into the sliding slots formed in the front surfaces of the knob 6 and the cable block 40 respectively, are formed in the first guide slot 24 and the second guide slot 23. Owing to the sliding slots and the sliding protrusions the knob 6 and the cable block 40 can be smoothly slided.

A slotted hole 25, wherein the switching lever 30 can be moved, is formed in the first direction switch housing 21 communicating with the first and the second guide slots 24 and 23. The slotted hole 25 is disposed between the first and the second guide slots 24 and 23.

The slotted hole 25 is formed in length along the left-to-right direction. A switching lever 30 is inserted in the slotted hole 25.

A rotating shaft 26 of the switching lever 30 is formed in the first direction switch housing 21 so that it is disposed inside the slotted hole 25. The rotating shaft 26 is disposed between the first and the second guide slots 24 and 23.

A first connecting protrusion **6*a* is formed backwardly protruded in the rear side surface of the knob 6**.

A second connecting protrusion 42 is formed backwardly protruded in the rear side surface of the cable block 40.

The first and the second connecting protrusions **6*a* and 42** are formed to be the shape of a cylinder.

The switching lever 30 is formed to be the shape of a long bar, and disposed along the up-down direction.

A first connecting protrusion insertion slot, wherein the first connecting protrusion **6*a*, is inserted is formed in the one side of the switching lever 30; and a second connecting protrusion insertion slot, wherein the second connecting protrusion 42 is inserted, is formed in the other side thereof (of the switching lever 30). Accordingly, the knob 6 is rotatably connected to the one side of the switching lever 30, and the lock-releasing cable 4810' is rotatably connected to the other side thereof (of the switching lever 30**).

A shaft insertion hole, wherein the rotating shaft 26 is inserted, is formed between the one end and the other end of the switching lever 30.

Accordingly, the rotating shaft 26 is disposed in the one side and the other side of the switching lever 30. That is, the rotating shaft 26 is disposed between the knob 6 and the cable block 40.

Due to the switching lever 30 installed in this way, when the knob 6 is pressed (moved to the left) the cable block 40 is moved towards the right side. When the cable block 40 is moved towards the right side, the locking plate 4500' is moved towards the right side, the door is locked thereby. And, when the knob is being pulled (moved to the right) the cable block 40 is moved towards the left side. When the cable block 40 is moved towards the left side, the locking plate 4500' is moved towards the left side, the door becomes lock-released thereby.

In this way, the switching lever 30 reverses the direction of the force applied to the knob 6 and delivers the force to the locking plate 4500' according to "the principle of the lever."

Therefore, even when the withdrawing direction of the lock-releasing cable 4810' is changed, the operation of the knob 6 can be maintained same as usual.

Due to this, as illustrated in FIG. 71, when the door latch system is installed in the door 1, it is possible that the electrical products such as the motor 4610' and the PCB 4900' can be directing towards the upper side of the vehicle, therefore the wetting of the motor 4610' and the PCB 4900' is prevented.

A locking driving unit 4650' for sliding the locking plate 4500' along the left-to-right direction is further included.

The locking driving unit 4650' includes a motor 4651', a worm 4652' connected to the shaft of the motor, and a worm gear gearing with the worm 4562'. Thus, the motor 4651' and the locking plate 4500' are connected through the worm 4652' and the worm gear 4653' having the form of a straight line. In this way, the reduction ratio can be reduced even with a simple configuration by using the worm 4652'.

The motor 4651' is disposed in the lower side than the locking plate 4500', and installed in the lower side of left an rear side of the first housing 4110'.

Since the shaft of the motor 4651' is disposed along the left-to-right direction, the interference of the door 1 with the other members can be minimized.

The motor 4651' of the locking driving unit 4650' is provided in a smaller form than that of the motor 4610' of the driving unit. Thus, even when the motor 4651' fails, the reverse rotation of the motor 4651' becomes possible, so that the locking plate 4500' can be moved by an external force.

The worm gear 4653' is formed to have the form of a straight line as same as the rack, and disposed along the left-to-right direction.

The worm gear 4653' is disposed in the upper side of the worm 4652'.

The worm gear 4653' is installed at the left side of the locking plate 4500'. The worm gear 4653' can be integrally formed in the locking plate 4500'.

Embodiment 12

In describing the door latch system according to the twelfth exemplary embodiment of the present invention, same symbols will be used for the same or the similar elements as those of the door latch system according to the first, the second, the third, the fourth, the fifth, the sixth, the seventh, the ninth, the tenth, the eleventh, and the twelfth exemplary embodiments of the present invention, and the detailed description and illustration will be omitted.

As illustrated in FIGS. 72 and 73, the door latch system according to the exemplary embodiment further includes: a child locking member 700' movably installed in the housing, and a child locking driving unit for moving the child locking member 700', wherein the child locking member 700' and the child locking driving unit are connected through a child worm 751' and a child worm gear 710'.

The child locking member 700' is formed as similarly as the tenth exemplary embodiment.

The child locking member 700' is installed in the right rear side of the first housing 110'.

The child locking driving unit includes a child lock motor 750'.

The child lock motor 750' is disposed in the middle of the rear side of the first housing 110'. That is, the child lock motor 750' is disposed spaced apart from the left end of the first housing 110'.

The child lock motor 750' is disposed at the left side of the child locking member 700', and the shaft thereof is disposed along the left-to-right direction.

The child locking member 700' and the child lock motor 750' are connected through the child worm 751' and the child worm gear 710'.

The child worm 751' is installed in the shaft of the child lock motor 750'.

The child worm gear 710' is formed in the shape of a straight line as same as that of the rack, and geared with the child worm 751'.

The child worm gear 710' is disposed along the left-to-right direction.

The child worm gear 710' is integrally formed in the rear side surface of the child locking member 700'.

Further, a child lock sensor 790 is provided in the right rear side of the first housing 110'. A limit switch is provided as the child lock sensor 790. The child lock sensor 790 is disposed at the right side of the first housing 110' and detects whether the child locking member 700' is in the position of child lock-releasing. More specifically, when the child locking member 700' is moved towards the right side by the child lock motor 750', the child locking member 700' pushed the switch of the child lock sensor 790, and thus the child lock sensor 790 detects the child lock-releasing thereby.

In addition, a locking plate 500' is installed in the rear side surface of the first housing 110' in a way that it is movable along the left-to-right direction and to be disposed in the lower side of the child locking member 700'.

A lock-releasing cable 810' is connected to the right side of the locking plate 500' as same as the eleventh exemplary embodiment. The lock-releasing cable 810' is withdrawn towards the right side of a housing 100'. A direction switching unit 20 is installed between the lock-releasing cable 810' and a knob 6.

The locking plate 500' is moved along the left-to-right side by a locking driving unit 650'.

The locking driving unit 650' includes a motor 651', a worm 652' connected to the shaft of the motor, and a worm gear 653' gearing with the worm 652' as same as the eleventh exemplary embodiment.

The shaft of the motor 651' is disposed along the left-to-right direction.

The motor 651' is disposed in the lower side of the locking plate 500'. The motor 651' is disposed in the middle of the rear side of the first housing 110'.

The worm gear 653' is installed in the right lower side of the locking plate 500'. The worm gear 653' may be integrally formed in the locking plate 500'.

Further, a sensor pressing portion 521' is formed upwardly protruded at the left side of the locking plate 500'.

The sensor pressing portion 521' presses a locking sensor 907. A limit switch may be provided as the locking sensor 907. Thus, the locking sensor 907 detects door locking through the locking plate 500'.

The locking sensor 907 is installed in the rear side surface of the first housing 110', and is disposed spaced apart from the left end of the first housing 110'.

After all of the components are disposed in this way, as illustrated in FIG. 73, and when the door latch system is being installed in the door 1, the motor 651' of the locking driving unit and the child lock motor 750' of the child locking driving unit 650' are disposed closer to the upper side of the vehicle than the striker insertion slot, and thus the wetting thereof is prevented thereby.

As described above, although the present invention has been described with reference to the preferred exemplary embodiments, various changes and alterations of the present invention can be made by those skilled in the art without departing from the spirit and the scope of the present invention written in the claims described herein below.

DESCRIPTION OF SYMBOLS

Description of Numerals for Major Elements in Drawings

1100: housing
1200: latch
1300: main locking member
1400: sub-locking member
1450: stopping lever unit

1500: locking plate
1600: driving unit
1700: child locking member
1800: door lever connecting unit
1900: PCB

The invention claimed is:

1. A door latch system comprising:
a housing;
a latch rotatably installed in the housing;
a main locking member slidingly installed in the housing for locking the latch;
a coupling unit slidingly installed in the housing and positioned adjacent to the main locking member;
a stopping lever unit rotatably installed in the main locking member wherein a stopping protrusion is formed;
a stopping threshold formed in the coupling unit wherein the stopping protrusion is caught by;
an actuation unit mounted on the housing, and
a locking plate slidingly installed in the housing and operated by the actuation unit to rotate the stopping lever unit, wherein
a lever guide portion is formed in the locking plate, and a guide bar is formed in the stopping lever unit, so that the rotation of the stopping lever unit is accomplished as the guide bar is guided by the lever guide portion,
wherein the stopping lever unit is caught by the stopping threshold when the locking plate slides in a first direction and
wherein the stopping lever unit is separated from the stopping threshold when the locking plate slides in a second direction which is opposite to the first direction.

2. The door latch system according to claim 1, wherein
a stopping lever shaft of the stopping lever unit is formed along the up-down direction.

3. The door latch system according to claim 1, wherein
the lever guide portion is protrudedly formed towards the stopping lever unit; and in the lever guide portion, an inclined surface is formed on the surface being contacted with the guide bar.

4. The door latch system according to claim 1, wherein
a driving unit for rotating the latch is further included;
a stopping portion for rotating the latch is formed in the driving unit;
the stopping portion is installed in the driving unit slidably along the front and rear side direction; and
a stopping portion pressing arm for pressing the stopping portion is formed in the main locking member.

5. The door latch system according to claim 4, wherein
a stopping portion return spring which returns the stopping portion to the original position is further provided in the driving unit.

6. The door latch system according to claim 5, wherein
the stopping portion is protrudedly formed towards the outside further from the latch.

7. The door latch system according to claim 4, wherein
a stopping portion reinforcing member made of a metallic material is inserted in the stopping portion pressing arm.

8. The door latch system according to claim 1, wherein
a manual locking member is rotatably installed in the housing; and a first stopping portion caught by the coupling unit, and a second stopping portion caught by the locking plate, are formed in the manual locking member.

9. The door latch system according to claim 8, wherein
the first stopping portion and the second stopping portion are disposed spaced apart along a circumferential direction.

10. The door latch system according to claim 1, wherein
a rotating member being rotated by the latch and sliding the main locking member is further included; at least a portion of the rotating member is disposed in front of the main locking member; and the coupling unit is disposed in rear side of the main locking member.

11. The door latch system according to claim 10, wherein
a coupling unit insertion slot into which the coupling unit is inserted is formed in rear side of the main locking member.

12. The door latch system according to claim 1, wherein
the actuation unit comprises a locking driving unit for sliding the locking plate is further included.

13. The door latch system according to claim 12, wherein
the locking driving unit includes a motor; and the motor and the locking plate are connected through a rack and a pinion.

14. The door latch system according to claim 12, wherein
the locking driving unit includes a motor, and the motor and the locking plate are connected through a worm and a worm gear.

15. The door latch system according to claim 13, wherein
the motor is disposed in a lower side of the locking plate, and the shaft of the motor is disposed along the front and rear side direction.

16. The door latch system according to claim 13, wherein
the motor is disposed in a upper side of the locking plate, and a shaft of the motor is disposed along the up-down direction.

17. The door latch system according to claim 12, wherein
the locking driving unit includes a motor and a main gear being rotated by the motor; and the motor and the main gear are connected through the worm and the worm gear engaging with the worm.

18. The door latch system according to claim 17, wherein
the motor is disposed in a upper side of the locking plate; and the shaft of the motor may be disposed along the left-to-right direction.

19. The door latch system according to claim 1, wherein
a driving unit for rotating the latch is further included; the driving unit includes a motor and a main gear rotated by the motor; and the motor and the main gear are connected through a spur gear.

20. The door latch system according to claim 19, wherein
the main gear is rotated centered around a shaft disposed along the front and rear side direction; and a shaft of the motor is disposed along the front and rear side direction.

21. The door latch system according to claim 1, wherein
a driving unit for rotating the latch is further included; the driving unit includes a motor and a main gear rotated by the motor; and the motor and the main gear are connected through a first worm, a first worm gear gearing with the first worm, a second worm installed in the first worm gear, and a second worm gear gearing with the second worm.

22. The door latch system according to claim 21, wherein
the main gear is rotated around the center of the shaft disposed along the front and rear side direction, and a shaft of the motor is disposed along the left-to-right direction.

23. The door latch system according to claim 1, wherein the main gear is rotated around a center of the shaft disposed along the front and rear side direction, and a shaft of the motor is also be disposed along the front and rear side direction.

24. The door latch system according to claim 1, wherein a driving unit for rotating the latch or sliding the locking plate is further included; the locking driving unit includes a motor and a main gear rotated by the motor; and the motor and the main gear are connected through a worm, a worm gear gearing with the worm, and a middle spur gear installed in the worm gear.

25. The door latch system according to claim 1, wherein a driving unit for rotating the latch and a child locking member movably installed in the housing are further included, and the driving unit moves the child locking member.

26. The door latch system according to claim 25, wherein the driving unit includes a main gear, wherein a stopping portion for rotating the latch is formed in the main gear, and a first stopping portion and a second stopping portion for sliding the child locking member are formed in the main gear.

27. The door latch system according to claim 25, wherein a protrusion guide portion is formed in the child locking member, and a child lock protrusion is formed in the stopping lever unit, so that the rotation of the stopping lever unit is accomplished as the protrusion guide portion guides the child lock protrusion.

28. The door latch system according to claim 1, wherein a child locking member which is movably installed in the housing, and a child locking driving unit for moving the child locking member are further included, wherein a protrusion guide portion is formed in the child locking member, and a child lock protrusion is formed in the stopping lever unit, so that the rotation of the stopping lever unit is accomplished as the protrusion guide portion guides the child lock protrusion.

29. The door latch system according to claim 1, wherein a child locking member movably installed in the housing, and a child locking driving unit for moving the child locking member are further included, wherein the child locking member and the child locking driving unit are connected through a child rack and a child pinion.

30. The door latch system according to claim 1, wherein a child locking member movably installed in the housing, and a child locking driving unit for moving the child locking member are further included, wherein the child locking member and the child locking driving unit are connected through a child worm and a child worm gear.

31. The door latch system according to claim 1, wherein a lock-releasing cable is installed in the locking plate; a direction switch unit is installed between the lock-releasing cable and a knob; the direction switch unit includes a direction switch housing and a switching lever which is rotatably installed in the direction switch housing; the knob is rotatably connected to the one side of the switching lever; the lock-releasing cable is rotatably connected to the other side of the switching lever; and a rotating shaft of the switching lever is disposed between the one side and the other side of the switching lever.

32. The door latch system according to claim 31, wherein a first guide slot for guiding the knob and a second guiding slot for guiding the lock-releasing cable are formed in the direction switch housing; and a slotted hole, wherein the switching lever is movable so as to communicate with the first and the second guide slots, is formed in the direction switch housing.

* * * * *